US011623332B2

(12) United States Patent
Yagi et al.

(10) Patent No.: US 11,623,332 B2
(45) Date of Patent: Apr. 11, 2023

(54) STAPLE REMOVAL DEVICE

(71) Applicant: MAX CO., LTD., Tokyo (JP)

(72) Inventors: Nobuaki Yagi, Tokyo (JP); Katsuya Hakozaki, Tokyo (JP); Tooru Yoshie, Tokyo (JP); Tomokazu Matsui, Tokyo (JP)

(73) Assignee: MAX CO., LTD., Tokyo (JP)

( * ) Notice: Subject to any disclaimer, the term of this patent is extended or adjusted under 35 U.S.C. 154(b) by 0 days.

(21) Appl. No.: 17/293,440

(22) PCT Filed: Nov. 13, 2019

(86) PCT No.: PCT/JP2019/044584
§ 371 (c)(1),
(2) Date: May 12, 2021

(87) PCT Pub. No.: WO2020/100951
PCT Pub. Date: May 22, 2020

(65) Prior Publication Data

US 2021/0402582 A1 Dec. 30, 2021

(30) Foreign Application Priority Data

Nov. 13, 2018 (JP) ..... JP2018-213338
Nov. 13, 2018 (JP) ..... JP2018-213339
Dec. 27, 2018 (JP) ..... JP2018-245546

(51) Int. Cl.
*B25C 11/00* (2006.01)

(52) U.S. Cl.
CPC ..... *B25C 11/00* (2013.01)

(58) Field of Classification Search
CPC ..... B25C 11/00
See application file for complete search history.

(56) References Cited

U.S. PATENT DOCUMENTS 3,528,643 A 9/1970 Munson et al.
6,634,633 B1 10/2003 Maruchi
(Continued)

FOREIGN PATENT DOCUMENTS

JP 2000-094362 A 4/2000
JP 2000-127064 A 5/2000
(Continued)

OTHER PUBLICATIONS

Machine Translation of JP-2016101653-A by Tsuchiyah Hiroshi. "Sheet Processing Device" (Year: 2016).*
(Continued)

*Primary Examiner* — Nirvana Deonauth
(74) *Attorney, Agent, or Firm* — Weihrouch IP

(57) ABSTRACT

A staple removal device includes: a placement table on which a paper bundle is placed, the paper bundle being bound by a staple and including a first paper surface; a moving portion arranged at a position facing the first paper surface, the moving portion being movable in a direction along the first paper surface and including a wedge plate inclined in a wedge shape toward a tip end thereof; a driving portion configured to move the moving portion toward a crown portion and insert the wedge plate between the crown portion and the first paper surface; and an abutment portion arranged at a position facing the first paper surface, the abutment portion being abutted against the crown portion from a direction opposite to an insertion direction of the wedge plate after the wedge plate is inserted between the crown portion and the first paper surface.

14 Claims, 94 Drawing Sheets

(56) References Cited

U.S. PATENT DOCUMENTS

| | | | |
|---|---|---|---|
| 2004/0022563 | A1 | 2/2004 | Maruchi et al. |
| 2019/0184537 | A1 | 6/2019 | Hakozaki et al. |

FOREIGN PATENT DOCUMENTS

| | | | |
|---|---|---|---|
| JP | 5565180 | B2 | 8/2014 |
| JP | 2015-147271 | A | 8/2015 |
| JP | 2016-101653 | A | 6/2016 |
| JP | 2018-047535 | A | 3/2018 |
| NL | 2006273 | C2 | 8/2012 |

OTHER PUBLICATIONS

International Search Report and Written Opinion issued in Application No. PCT/JP2019/044584 dated Feb. 10, 2020, 8 pages.
Extended European Search Report for EP Application No. 19885087.7 dated Jun. 29, 2022. (9 pp.).

* cited by examiner

110C

STAPLE REMOVAL DEVICE

CROSS REFERENCE TO RELATED APPLICATION

This application is a 35 U.S.C. 371 National Phase Entry Application from PCT/JP2019/044584, filed Nov. 13, 2019, which claims priority to Japanese Patent Application Nos. 2018-213338, filed Nov. 13, 2018, 2018-213339, filed Nov. 13, 2018, and 2018-245546, filed Dec. 27, 2018, the disclosures of which are incorporated herein in their entirety by reference, and priority is claimed to each of the foregoing.

TECHNICAL FIELD

The present disclosure relates to a staple removal device that removes a staple from a paper bundle.

BACKGROUND ART

In related art, a staple removal device that removes a staple from a paper bundle formed by using a staple (needle) including a crown portion and a pair of leg portions to bind a plurality of pieces of paper has been used.

According to a general staple removal device, after paper near a staple is pressed by a pressing member, an insertion member is inserted between a paper bundle and a crown portion of the staple and moved forward to remove the staple from the paper bundle. For example, each of Patent Literatures 1 and 2 describes a binding member removing device which includes a pressing unit including a substantially U-shaped abutment portion that is abutted against an upper surface of a document bundle, and an insertion member that is inserted between a paper bundle and a staple binding the paper bundle.

CITATION LIST

Patent Literature

[Patent Literature 1] Patent Literature 1: JP-A-2000-094362

[Patent Literature 2] Patent Literature 2: JP-A-2000-127064

SUMMARY OF INVENTION

Technical Problem

However, when the insertion member is inserted between the paper bundle and a crown portion, a load generated at the time of pushing the insertion member needs to be supported by a load (pressing force) provided by a pressing plate that presses the paper bundle. In general, the load (pressing force) provided by the pressing plate increases in accordance with increases in a thickness of the paper bundle and the number of pieces of paper. Therefore, when the load provided by the pressing plate is not sufficient, both the staple and the paper bundle may be pushed (shifted) in an insertion direction of the insertion member by the load that pushes the insertion member, and thus the staple may not be removed from the paper bundle.

On the other hand, even if a sufficient load can be secured by the pressing plate, when the staple is pulled out from a thin paper bundle formed of a small number of pieces of paper, paper near the staple may not withstand the load that pushes the insertion member in the insertion direction, and thus the paper may be broken. Such a phenomenon is particularly noticeable when a corner portion of the paper bundle is bound or when an edge portion of the paper bundle is bound.

A binding state of the staple that binds the paper bundle also varies depending on a type of the paper, the number of pieces of the paper, and types of the staple binding device and the staple to be used, and thus there are various cases where the crown portion is recessed from a surface of the paper bundle instead of being located on the surface of the paper bundle. According to the general staple removal device, the insertion member protrudes by a predetermined amount from a placement table on which the paper bundle is placed toward the paper bundle, and is thus inserted between the paper bundle and the crown portion.

However, such a method has the following problem. That is, for example, when the staple is removed from a thin paper bundle or a paper bundle whose corner portion is bound, the paper bundle may be moved by a pushing force of the insertion member and the insertion member may not be inserted between the paper bundle and the crown portion. In order to solve this problem, it is necessary to increase a protrusion amount by which the insertion member protrudes toward the paper bundle. On the other hand, when the staple is removed from a thick paper bundle while the protrusion amount of the insertion member is adapted for the thin paper bundle, the insertion member may hit the paper bundle and break the paper bundle. As described above, an optimum value of the protrusion amount (height) of the insertion member relative to the paper bundle varies depending on the types of the paper bundle and the staple.

The present invention has been made to solve the above problem, and an object thereof is to provide a staple removal device capable of reliably removing a staple from a paper bundle without damaging the paper bundle.

Solution to Problem

A staple removal device of the present disclosure includes: a placement portion on which a paper bundle bound by a staple including a crown portion and a pair of leg portions is placeable, the paper bundle including a first paper surface on which the crown portion is exposed; a moving portion which is arranged at a position facing the first paper surface in a state where the paper bundle is placed on the placement portion, and is movable in a direction along the first paper surface, the moving portion including a tip end portion which is inclined in a wedge shape toward a tip end thereof; a driving portion configured to move the moving portion toward the crown portion in the state where the paper bundle is placed on the placement portion and to insert the tip end portion between the crown portion and the first paper surface; and an abutment portion which is arranged at a position facing the first paper surface in the state where the paper bundle is placed on the placement portion, the abutment portion being abutted against the crown portion from a direction opposite to an insertion direction of the tip end portion at least after the tip end portion is inserted between the crown portion and the first paper surface.

In the present disclosure, when the tip end portion of the moving portion is inserted between the paper bundle and the crown portion of the staple, the paper bundle and the staple are pushed and moved by a pushing force of the tip end portion in the insertion direction of the tip end portion. Since the crown portion moving in the insertion direction is abutted against the abutment portion, the movement of the paper bundle and the staple in the insertion direction can be restricted.

As described above, when the staple is removed, the paper bundle and the staple can be restricted from being pushed in the insertion direction by the pushing force of the moving portion in the insertion direction, so that damage of paper can be prevented during staple removal or failure of the staple removal can be prevented.

Another staple removal device of the present disclosure is a staple removal device configured to remove a staple from a paper bundle bound by the staple which includes a crown portion and a pair of leg portions. The staple removal device includes: a placement portion which includes a placement surface on which the paper bundle is placeable; an insertion portion which is arranged to face a paper surface of the paper bundle on a side where the crown portion is exposed in a state where the paper bundle is placed on the placement surface, the insertion portion being insertable between the crown portion and the paper surface; an insertion portion moving portion which is connected to the insertion portion and configured to move the insertion portion along the paper surface; and an insertion portion adjustment portion which is connected to the insertion portion and is configured to adjust a position of the insertion portion relative to the placement surface in a thickness direction of the paper bundle.

Another staple removal device of the present disclosure is a staple removal device configured to remove a staple from a paper bundle bound by the staple which includes a crown portion and a pair of leg portions. The staple removal device includes: a placement portion which includes a placement surface on which the paper bundle is placeable; an insertion portion which is arranged to face a paper surface of the paper bundle on a side where the crown portion is exposed in a state where the paper bundle is placed on the placement surface, the insertion portion being insertable between the crown portion and the paper surface; a moving portion which is connected to the insertion portion and configured to move the insertion portion along the paper surface; and a placement portion adjustment portion which is connected to the placement portion and is configured to adjust a position of the placement surface relative to the insertion portion in a thickness direction of the paper bundle.

As described above, according to each of the other staple removal devices of the present disclosure, even when types of paper and staples and binding positions vary, the position of the insertion portion relative to the placement surface in the thickness direction of the paper bundle or the position of the placement portion relative to the insertion portion in the thickness direction of the paper bundle can be adjusted by operating the insertion portion adjustment portion or the placement portion adjustment portion. Therefore, an optimum protrusion amount of the insertion portion relative to the placement table can be set in accordance with various situations such as the types of the paper and the staples. As a result, damage to the paper during the staple removal or failure of the staple removal can be prevented.

Advantageous Effects of Invention

According to each of the above-described staple removal devices, the staple can be reliably removed from the paper bundle without damaging the paper bundle.

DESCRIPTION OF EMBODIMENTS

First Embodiment

Hereinafter, an example of a staple removal device 100 according to a first embodiment will be described with reference to the drawings.

[Overall Configuration Example of Staple Removal Device 100]

Figure 1:
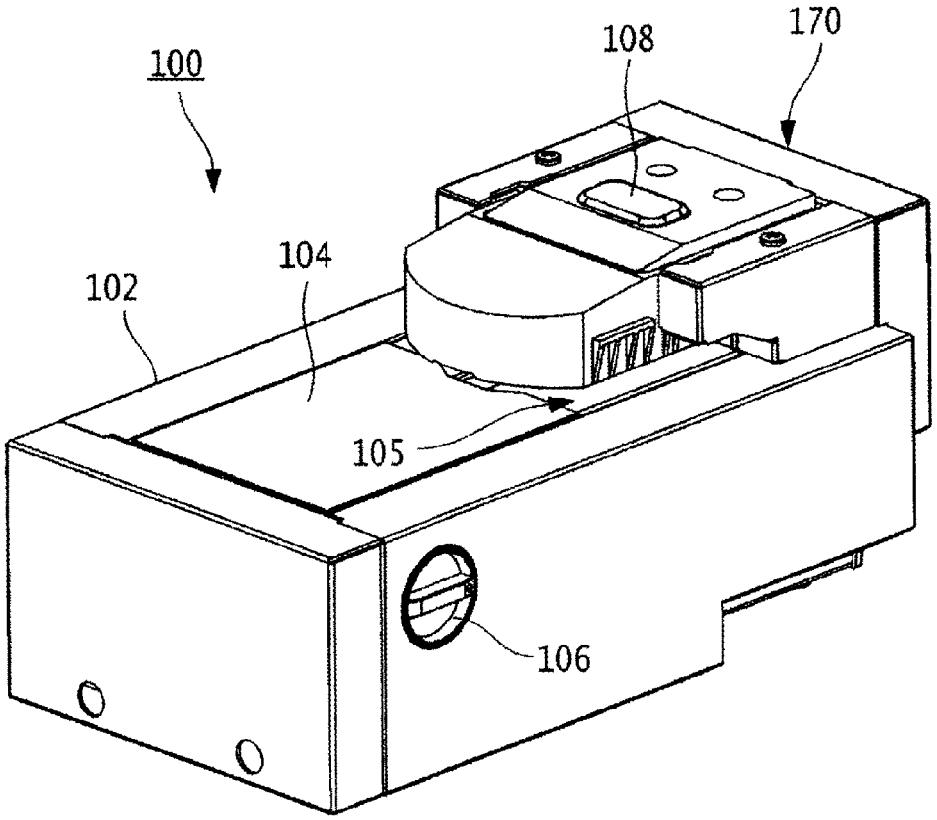
FIG. 1 is a perspective view of a staple removal device according to a first embodiment as viewed obliquely from a front side.
Figure 2:
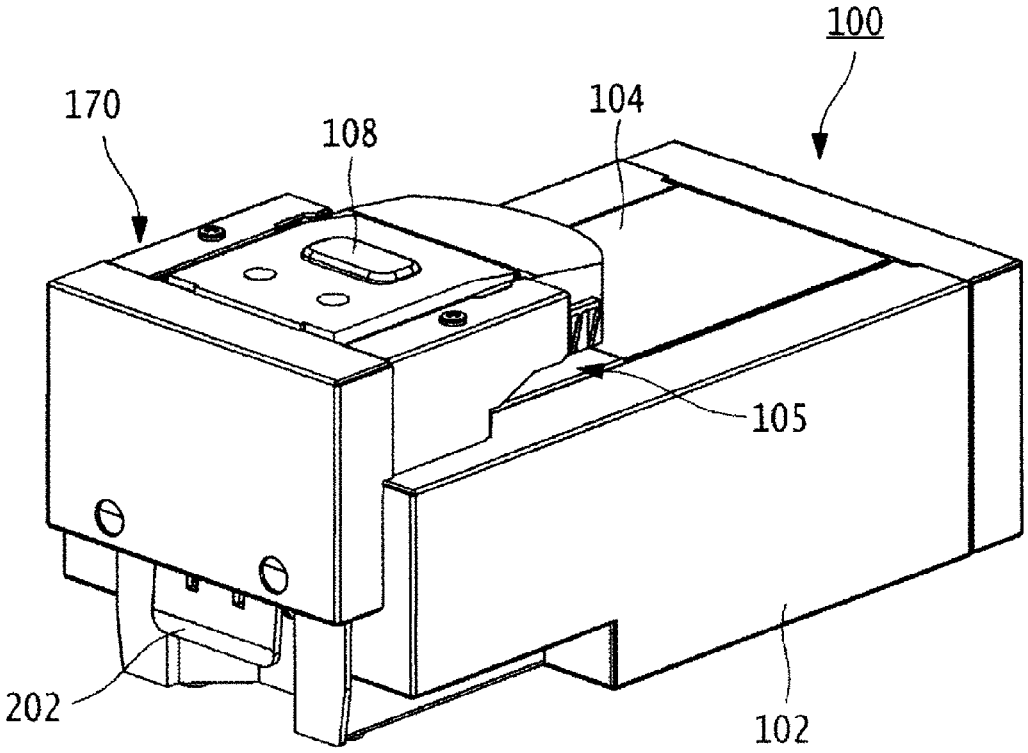
FIG. 2 is a perspective view of the staple removal device according to the first embodiment as viewed obliquely from a rear side.
Figure 3:
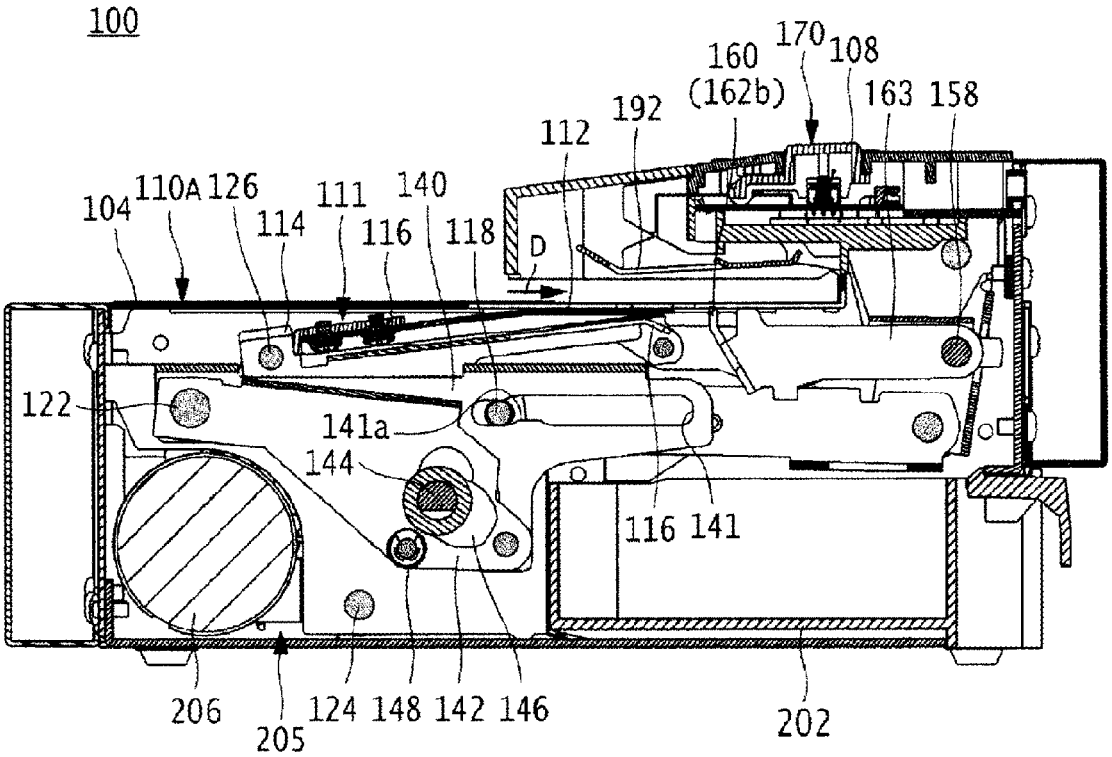
FIG. 3 is a cross-sectional view of the staple removal device according to the first embodiment.

FIG. 1 is a perspective view of the staple removal device 100 according to the present embodiment as viewed obliquely from a front side. FIG. 2 is a perspective view of the staple removal device 100 according to the present embodiment as viewed obliquely from a rear side. FIG. 3 is a cross-sectional view of the staple removal device 100 according to the present embodiment.

The staple removal device 100 is a device configured to automatically remove a staple from a paper bundle formed by bounding with the staple. The staple removal device 100 includes a housing 102 which has a substantially rectangular parallelepiped shape, a placement table (placement portion) 104 which is provided on an upper surface portion of the housing 102 so as to place the paper bundle thereon, and a paper pressing mechanism portion 170 which presses the paper bundle placed on the placement table 104. A paper bundle insertion opening 105 through which the paper bundle is inserted is provided between the placement table 104 and the paper pressing mechanism portion 170.

In the present embodiment, a side where the paper pressing mechanism portion 170 (a portion exposed from the housing 102) is provided is referred to as the rear side of the staple removal device 100, while an opposite side thereof is referred to as the front side of the staple removal device 100. A side where a blade adjustment knob 106 to be described later below is provided is referred to as a left side of the staple removal device 100, while an opposite side thereof is referred to as a right side of the staple removal device 100. A side where the placement table 104 is provided is referred to as an upper side of the staple removal device 100, while an opposite side thereof is referred to as a lower side of the staple removal device 100.

A start switch 108 is provided on an upper surface portion of the paper pressing mechanism portion 170 such that an operation of the staple removal device 100 is started when a user operates the start switch 108. A board 197 that supports the start switch 108 and an irradiation member 199 is provided inside the paper pressing mechanism portion 170. The blade adjustment knob 106, which is configured to adjust a protrusion amount of a wedge plate 112 relative to the placement table 104, is provided at a front portion of a left side surface of the housing 102. A dust box 202 that accommodates the staple removed from the paper bundle is provided at a rear portion of the housing 102. The dust box 202 is attachable to and detachable from the rear portion of the housing 102.

The start switch 108 is arranged substantially at a left-right direction center of an upper surface of the paper pressing mechanism portion 170. More specifically, the start switch 108 is arranged substantially at a left-right direction center of the staple removal device 100 behind a position where staple removal is performed. During the staple removal, a paper bundle P may be gripped by the user so as not to move. In this case, depending on a binding position, the user grips with a right hand or a left hand that is easier to grip, and operates the start switch 108 with the other hand, so that the operation may be performed with either the left hand or the right hand. Therefore, by arranging the start switch 108 substantially at the left-right direction center of the upper surface of the paper pressing mechanism portion 170, the left and right hands can perform the operation in the same manner. Since the start switch 108 is arranged behind the position where the staple removal is performed, the start switch 108 is not hidden by the paper bundle P at the time of the operation, and thus the operation is easily performed.

Figure 4A:
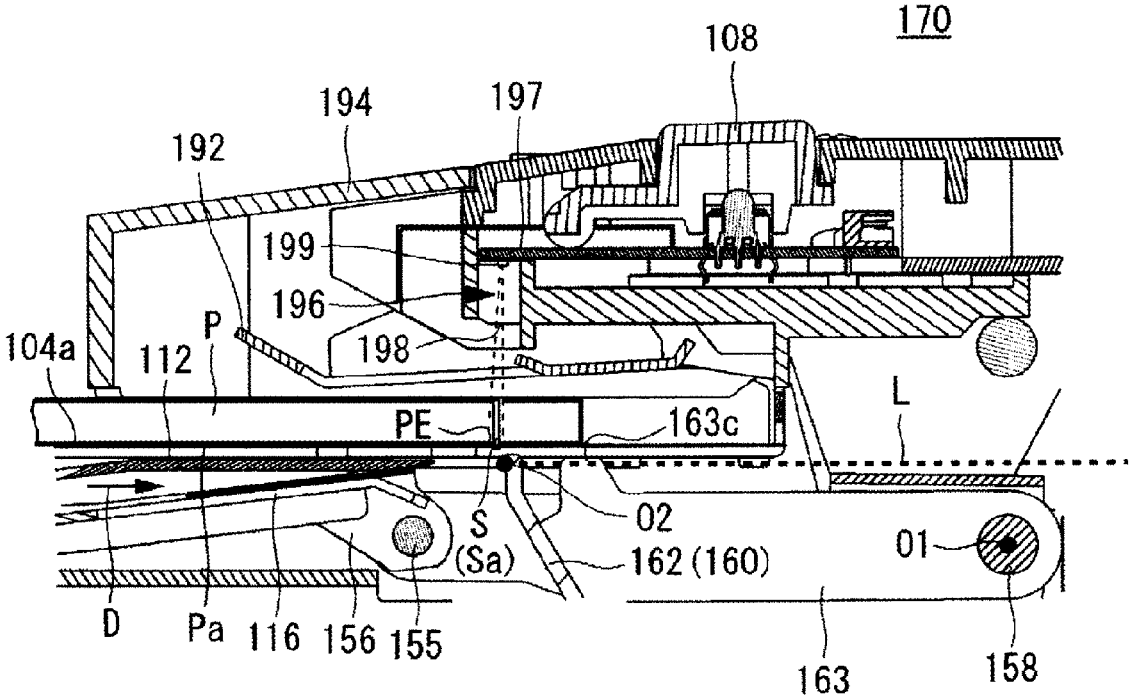
FIG. 4A is a main part enlarged view of a paper pressing mechanism portion according to the first embodiment.
Figure 4B:
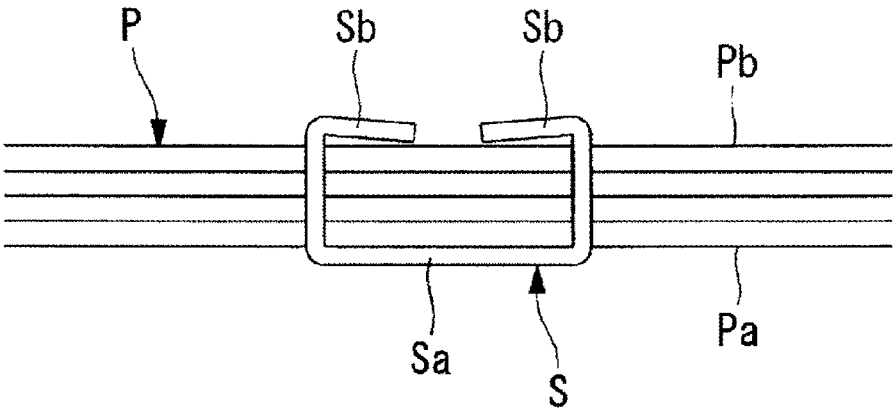
FIG. 4B is an explanatory view of a paper bundle bound with a staple according to the first embodiment.
Figure 4C:
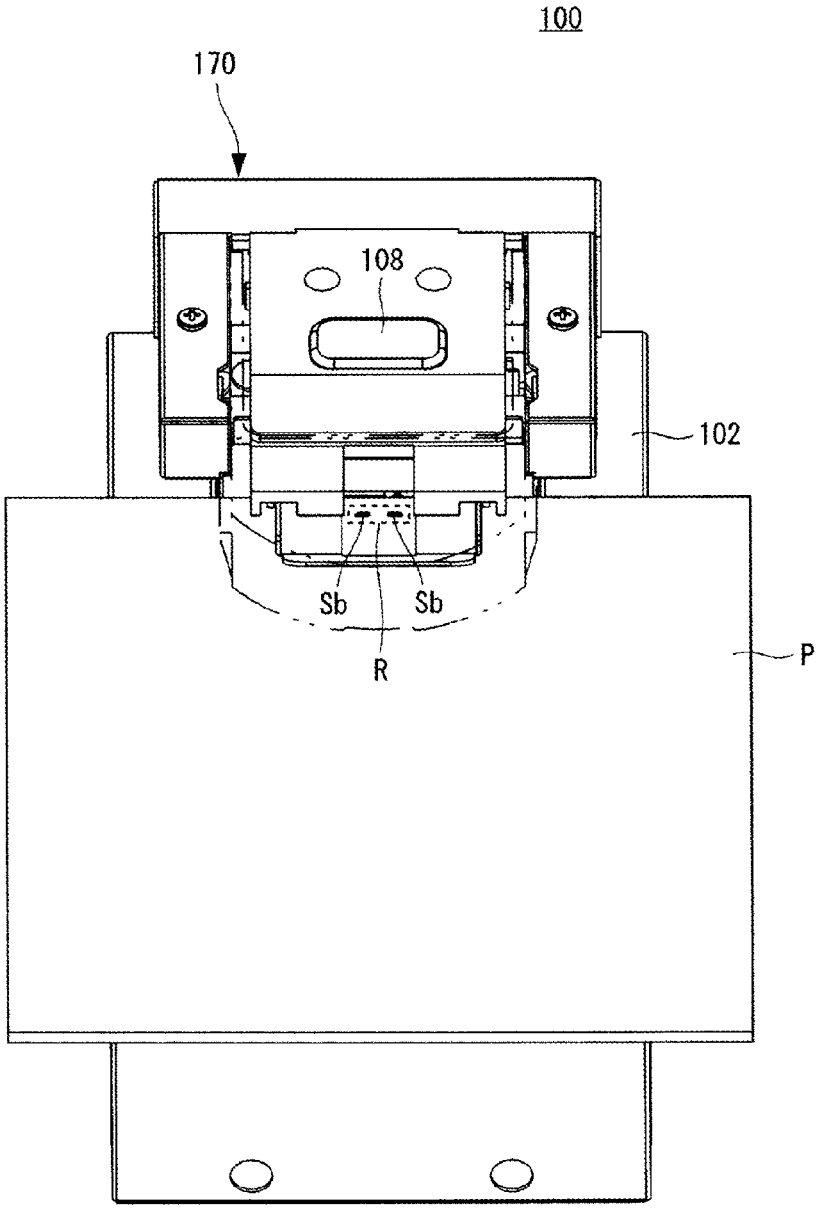
FIG. 4C shows an irradiation range of an illumination portion of the paper pressing mechanism portion according to the first embodiment.
Figure 5:
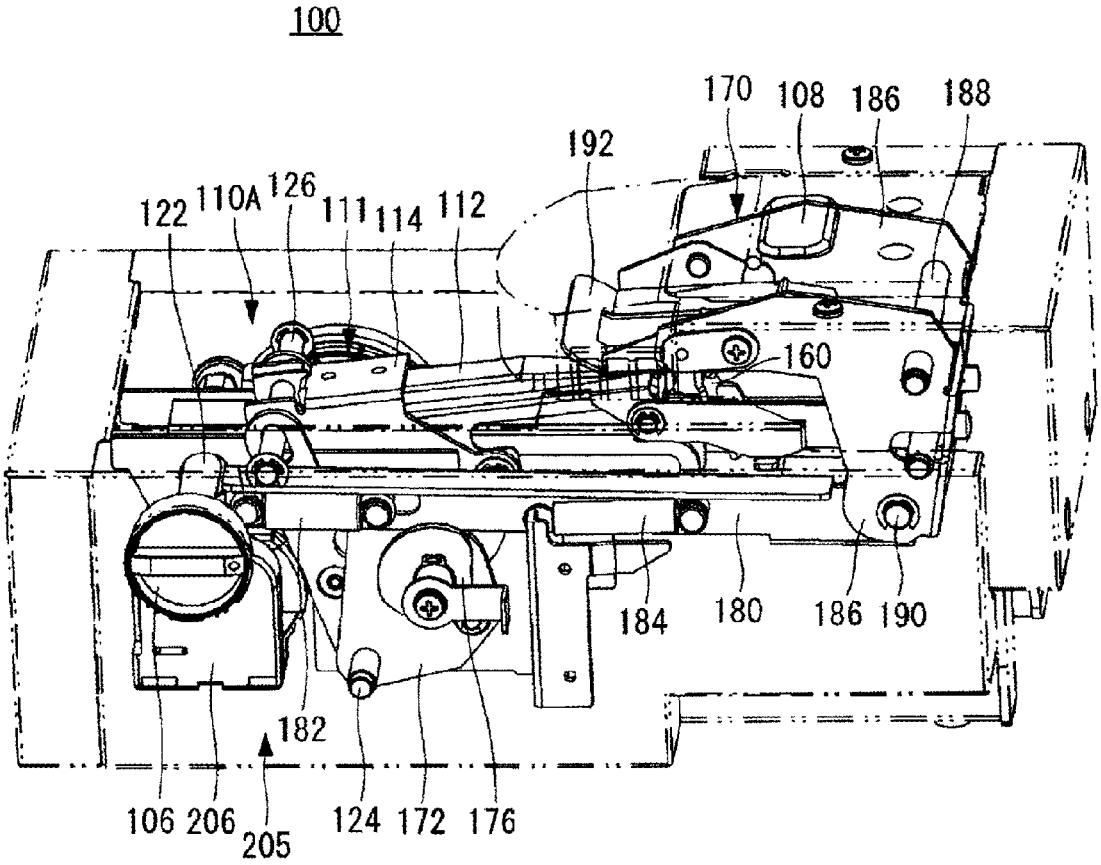
FIG. 5 is a perspective view showing an internal configuration of the staple removal device according to the first embodiment.
Figure 6:
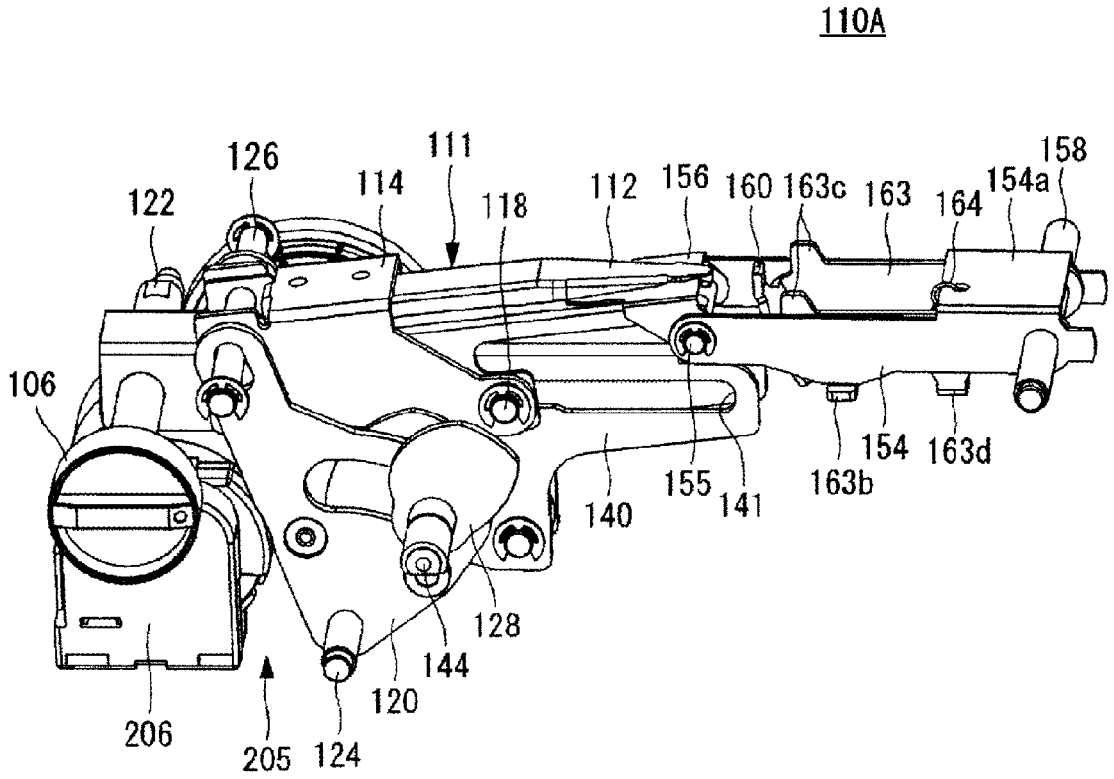
FIG. 6 is a perspective view of a staple pulling mechanism portion according to the first embodiment.
Figure 7:
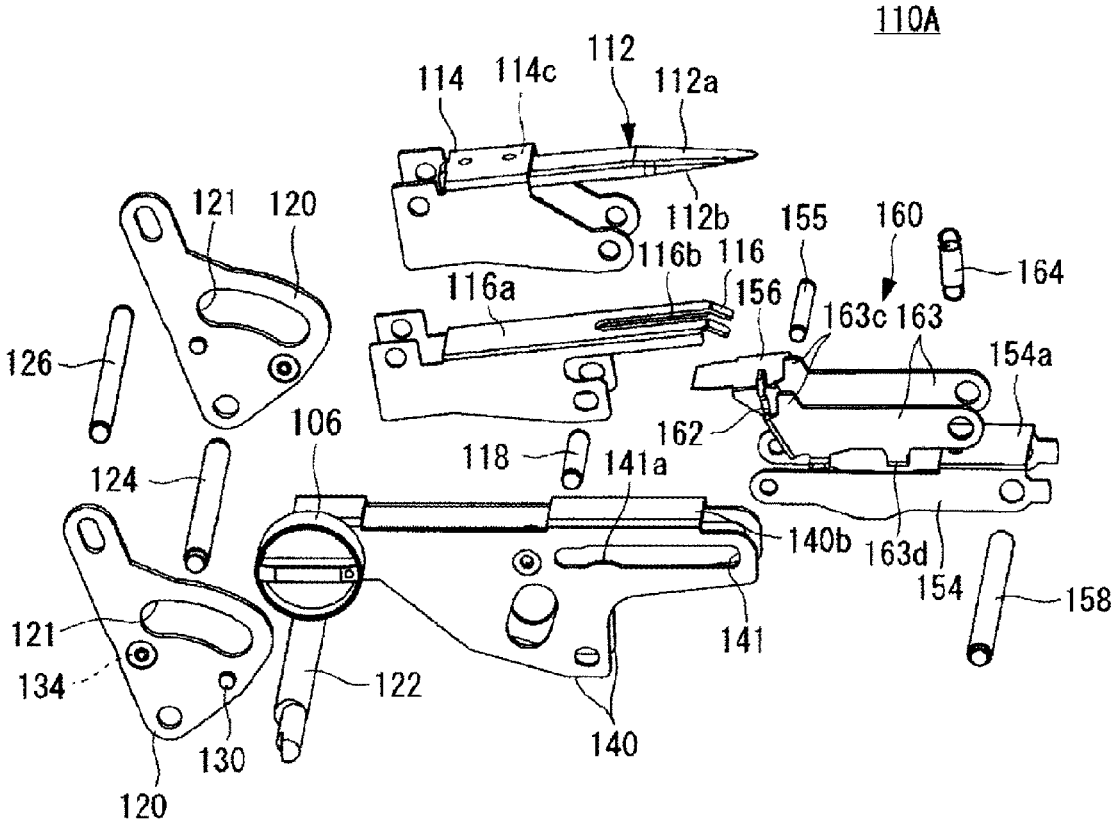
FIG. 7 is an exploded perspective view of the staple pulling mechanism portion according to the first embodiment.
Figure 8:
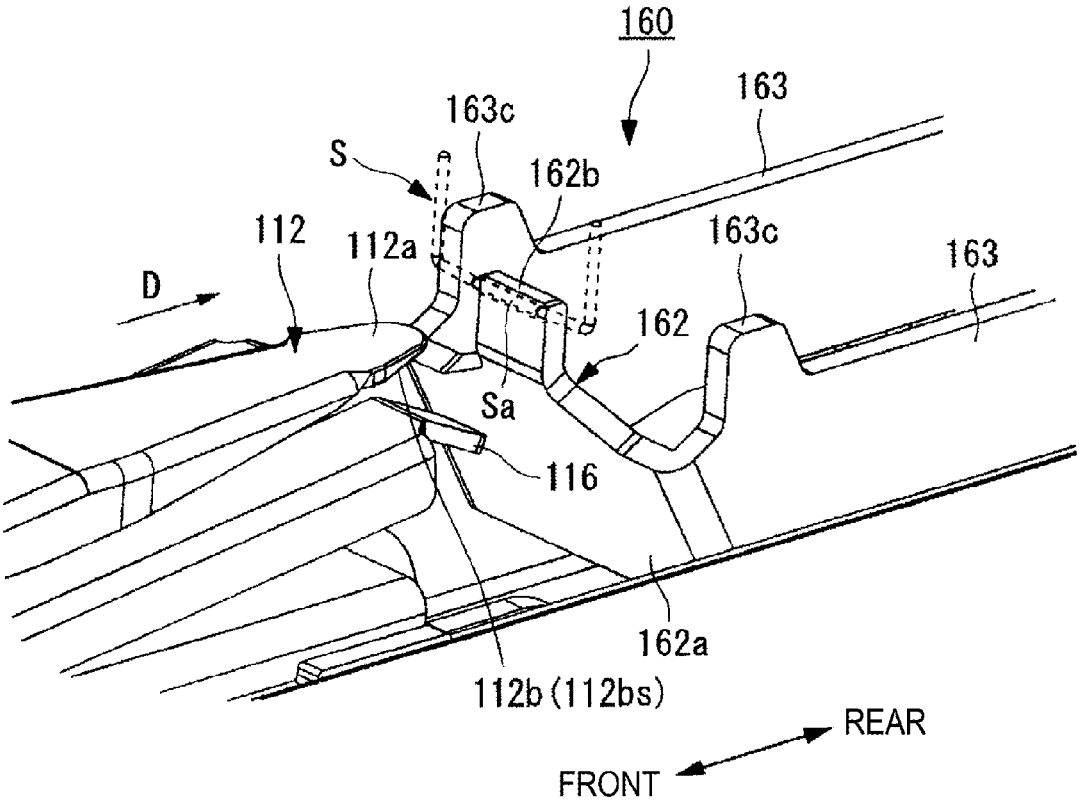
FIG. 8 is a perspective view of a staple pressing mechanism according to the first embodiment.

FIG. 4A is a main part enlarged view of the paper pressing mechanism portion 170 shown in FIG. 3. FIG. 4B is an explanatory view of the paper bundle P according to the present embodiment. FIG. 4C shows an irradiation range R of an illumination portion 196 of the paper pressing mechanism portion 170. FIG. 5 is a perspective view showing an internal configuration of the staple removal device 100. FIG. 6 is a perspective view of a staple pulling mechanism portion 110A. FIG. 7 is an exploded perspective view of the staple pulling mechanism portion 110A. FIG. 8 is a main part perspective view of the staple pressing mechanism 160. For convenience, a state where the paper bundle P is placed on the placement table 104 is shown.

The staple removal device 100 includes the staple pulling mechanism portion 110A that pulls a staple S from the paper bundle P, the paper pressing mechanism portion 170 that presses the paper bundle P placed on the placement table 104, and a driving portion 205 that drives the staple pulling mechanism portion 110A and the paper pressing mechanism portion 170. The staple pulling mechanism portion 110A is provided inside the housing 102, and the paper pressing mechanism portion 170 is provided to extend from inside to outside of the housing 102.

First, the paper bundle P bound by the staple S will be described with reference to FIGS. 4A, 4B, and 4C. The staple S includes a crown portion Sa and a pair of leg portions Sb, Sb formed by bending two longitudinal direction end portions of the crown portion Sa. The paper bundle P is formed by penetrating the pair of leg portions Sb, Sb of the staple S from a first paper surface Pa of a lowermost piece of paper toward a second paper surface Pb of an uppermost piece of paper among a plurality of stacked pieces of paper, and bending the penetrated leg portions Sb, Sb inward to bind the stacked pieces of paper. The binding position of the staple S is located, for example, at a corner portion or an edge portion of a piece of paper. In the present embodiment, the staple S is removed from such a paper bundle P.

Referring back to FIGS. 3, 4A, and 4B, the driving portion 205 is connected to a motor 206 configured by a DC motor, for example, and connected to a drive shaft 144 via a plurality of gears (not shown). The motor 206 is driven, for example, by turning on the start switch 108. The motor 206 drives the staple pulling mechanism portion 110A and the paper pressing mechanism portion 170 by rotating the drive shaft 144. Specifically, the driving portion 205 moves a moving portion 111 toward the crown portion Sa along the first paper surface Pa and inserts a tip end portion of the wedge plate 112 between the crown portion Sa and the first paper surface Pa while holding the tip end portion of the wedge plate 112 at a height between the crown portion Sa and the first paper surface Pa or in the vicinity thereof in the state where the paper bundle P is placed on the placement table 104. In the present embodiment, movement of the wedge plate 112 from the front side to the rear side in the housing 102 is referred to as forward movement, and movement of the wedge plate 112 from the rear side to the front side in the housing 102 is referred to as backward movement. A direction in which the wedge plate 112 moves forward is referred to as an insertion direction D.

The staple pulling mechanism portion 110A includes: the placement table 104 on which the paper bundle P can be placed, the paper bundle P being bound by the staple S which includes the crown portion Sa and the pair of leg portions Sb, Sb and including the first paper surface Pa on which the crown portion Sa is exposed and the second paper surface Pb on which the leg portions Sb, Sb are exposed; the moving portion 111 arranged at a position facing the first paper surface Pa in the state where the paper bundle P is placed on the placement table 104, the moving portion 111 being movable in a direction along the first paper surface Pa and including the wedge plate 112 whose tip end portion is inclined in a wedge shape toward a tip end thereof; and the staple pressing mechanism 160 arranged at a position facing the first paper surface Pa in the state where the paper bundle P is placed on the placement table 104, the staple pressing mechanism 160 including an abutment portion 162*b* which is configured to be abutted against the crown portion Sa from a direction opposite to the insertion direction D of the tip end portion of the wedge plate 112 at least after the tip end portion of the wedge plate 112 is inserted between the crown portion Sa and the first paper surface Pa.

The moving portion 111 includes the wedge plate 112 which is movable from the front side to the rear side of the housing 102 and is movable in the direction opposite to the insertion direction D, a wedge plate support portion 114 that supports the wedge plate 112, and a crown holder 116 that supports the crown portion Sa of the staple S to be pulled out from the paper bundle P.

As shown in FIG. 7 and the like, the wedge plate 112 includes a first surface 112*a* which faces the first paper surface Pa, and a second surface 112*b* located on a side opposite to the first surface 112*a*. The tip end portion of the wedge plate 112 is inserted between the paper bundle P and the crown portion Sa to pull out the crown portion Sa from the paper bundle P. The wedge plate 112 is a slim and long plate-shaped member whose tip end side has a tapered shape that can be easily inserted between the paper bundle and the crown portion Sa of the staple S. More specifically, the tip end side of the wedge plate 112 is configured such that a plate thickness thereof gradually decreases toward the tip end portion. A base end portion of the wedge plate 112 is attached to the wedge plate support portion 114.

The wedge plate support portion 114 is a member formed by bending a flat plate. The wedge plate 112 is attached to a lower surface of a ceiling surface portion 114*c* (see FIG. 7) of the wedge plate support portion 114. A wedge plate shaft 118 is attached to a lower portion of the wedge plate support portion 114 via a shaft hole. The wedge plate shaft 118 is a shaft configured to move the wedge plate 112 in parallel along a paper bundle surface (the placement table 104). A wedge plate drive shaft 126 is attached to a front portion of the wedge plate support portion 114 via a shaft hole. The wedge plate drive shaft 126 is a shaft that moves the wedge plate 112 forward and backward.

The crown holder 116 is a member configured to support the crown portion Sa of the staple S to be pulled out from the paper bundle P, and is arranged to face the wedge plate 112 on an inner side of the wedge plate support portion 114. As shown in FIG. 7, the crown holder 116 is a member formed by bending a metal plate, and includes a support plate 116*a*. A groove 116*b* which is cut out in a concave shape from a rear end portion of the support plate 116*a* to a substantially central portion thereof is formed on a rear end side of the support plate 116*a*. The groove 116*b* is a groove that allows a staple pressing portion 162 to pass therethrough without collision when the crown holder 116 moves forward and backward. The wedge plate shaft 118 is attached to a lower portion of a side wall of the crown holder 116 via a shaft hole. The wedge plate drive shaft 126 is attached to a front portion of the side wall of the crown holder 116 via a shaft hole. With such a configuration, the crown holder 116 can move forward and backward integrally with the wedge plate 112.

As shown in FIG. 8, the staple pressing mechanism 160 includes the staple pressing portion 162 which is formed of a plate material having a convex shape in a plan view, and a support member 163 that supports the staple pressing portion 162.

The staple pressing portion 162 includes a body 162*a* and the abutment portion 162*b* which is continuous with the body 162*a* and protrudes upward from an upper end central portion of the body 162*a*. The abutment portion 162*b* is movable in a direction away from the first paper surface Pa (see FIG. 4A), and moves in the direction away from the first paper surface Pa following movement of the crown portion Sa while abutting against an inclined surface 112*bs* of the second surface 112*b* when the crown portion Sa is moved in the direction away from the first paper surface Pa by the inclined surface 112*bs* of the tip end portion of the wedge plate 112 as the tip end portion is inserted between the crown portion Sa and the first paper surface Pa and moved in the insertion direction D.

The abutment portion 162*b* is arranged such that a flat surface thereof faces the wedge plate 112 and the crown portion Sa, and is configured to be capable of being abutted against the crown portion Sa pressed by the wedge plate 112. That is, the flat surface of the abutment portion 162*b* is substantially orthogonal to the insertion direction D of the wedge plate 112. A left-right direction width of the abutment portion 162*b* is selected to have, for example, a length that allows the crown portion Sa to be supported by a pushing force of the wedge plate 112 and allows the abutment portion 162*b* to be inserted into the groove 116*b* of the crown holder 116. In the present embodiment, the left-right direction width of the abutment portion 162*b* is slightly shorter than a longitudinal direction length of the crown portion Sa of the staple S.

As shown in FIG. 4A, the abutment portion 162*b* is arranged downstream of (behind) the crown portion Sa of the staple S of the paper bundle P placed on the placement table 104 in the insertion direction D of the wedge plate 112. The abutment portion 162*b* is arranged such that an upper end portion thereof is located at a certain distance from a surface 104*a* of the mounting table 104. Here, the certain distance is a distance at which the tip end portion of the wedge plate 112, which is inserted between the paper bundle P and the crown portion Sa and moved forward, does not collide with the abutment portion 162*b* while the crown portion Sa of the staple S moved by pushing of the wedge plate 112 is always abutted against the abutment portion 162*b*, that is, a distance at which the abutment portion 162*b* is not idle.

As shown in FIGS. 4A and 6 to 8, the support member 163 is formed by a pair of flat plate members which are bent rearward from two side surface portions of the body 162*a* of the staple pressing portion 162. A shaft 158 is attached to a rear portion of the support member 163 via a shaft hole. A rib portion 163*b* which protrudes outward is formed at a lower end portion of the support member 163. A lower end portion of an ejector lever 154, which will be described later below, is capable of being abutted against the rib portion 163*b*. As a result, when the ejector lever 154 moves downward, the rib portion 163*b* is biased downward, and the support member 163 and the staple pressing portion 162 can be moved downward. A protruding portion 163*c* which protrudes upward from an upper edge of the support member 163 is formed at a front upper end portion of the support member 163. The protruding portion 163*c* is abutted against a back surface of the placement table 104 and is biased toward the placement table 104 by a tension spring 164. As a result, the staple pressing portion 162 attached to the support member 163 can be held at a certain height.

As shown in FIGS. 4A, 6, and 7, an ejector 156 is rotatably attached to a front portion of the ejector lever 154 via a shaft 155, and is configured to be capable of being inserted between the wedge plate 112 and the crown holder 116. When the staple S is pulled out while the wedge plate 112 and the crown holder 116 are moved backward, the ejector 156 is abutted against the crown portion Sa held by the crown holder 116 and thus causes the staple S to fall into the dust box 202 below.

The ejector lever 154 which includes a pair of flat plate members is arranged to overlap an outer side of the support member 163 of the staple pressing mechanism 160, and is supported by the rib portion 163*b* of the support member 163. The shaft 158 is attached to a rear portion of the ejector lever 154 via a shaft hole. The ejector lever 154 is configured to be rotatable about the shaft 158 which serves as a fulcrum.

The ejector lever 154 includes a ceiling surface portion 154*a*. One end portion of the tension spring 164 is attached to the ceiling surface portion 154*a*, while the other end portion of the tension spring 164 (see FIGS. 6 and 7) is attached to an attachment piece 163*d* formed on the support member 163 on one side of the staple pressing mechanism 160. As a result, the staple pressing mechanism 160 is integrally operated in conjunction with an operation of the ejector lever 154.

As shown in FIGS. 3 and 7, a pull-down link 140 includes a pair of flat plate members formed by bending a metal plate, for example, and is arranged below and inside the crown holder 116. A long hole 141 which extends along a front-rear direction is formed in the pull-down link 140. A long diameter of the long hole 141 is determined based on a front-rear direction movement range of the wedge plate 112. The wedge plate shaft 118 is slidably inserted into the long hole 141. As a result, the wedge plate 112 and the crown holder 116 attached to the wedge plate shaft 118 can be moved forward and backward by moving along a long diameter direction of the long hole 141 of the pull-down link 140. An adjustment fulcrum shaft 122 is attached to a front end portion of the pull-down link 140. The pull-down link 140 is configured to be rotatable about the adjustment fulcrum shaft 122 which serves as a fulcrum.

A protruding portion 141*a* which protrudes upward is formed on a lower end edge of the long hole 141. A long diameter direction length (section) of the protruding portion 141*a* is set to a length that allows the wedge plate 112 to be lifted and kept pressed against the first paper surface Pa until the wedge plate 112 is inserted between the first paper surface Pa of the paper bundle P and the crown portion Sa. This is because, once the wedge plate 112 is inserted between the paper bundle P and the crown portion Sa, the wedge plate 112 is held in this state, and thus it is not necessary to lift the wedge plate 112 thereafter. As a result, a force that presses the wedge plate 112 against the paper bundle P can be prevented from constantly acting on the paper bundle P, and thus the paper bundle P can be prevented from being damaged.

Figure 9A:
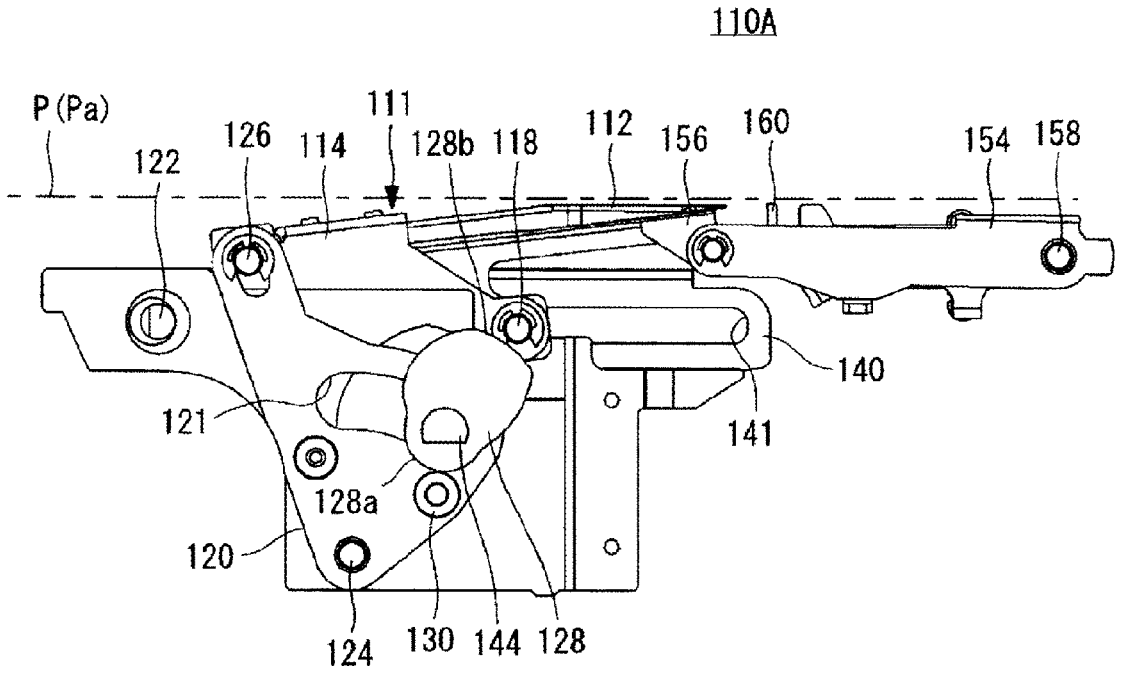
FIG. 9A is a side view of a drive lever, a drive cam, and a drive cam roller according to the first embodiment.
Figure 9B:
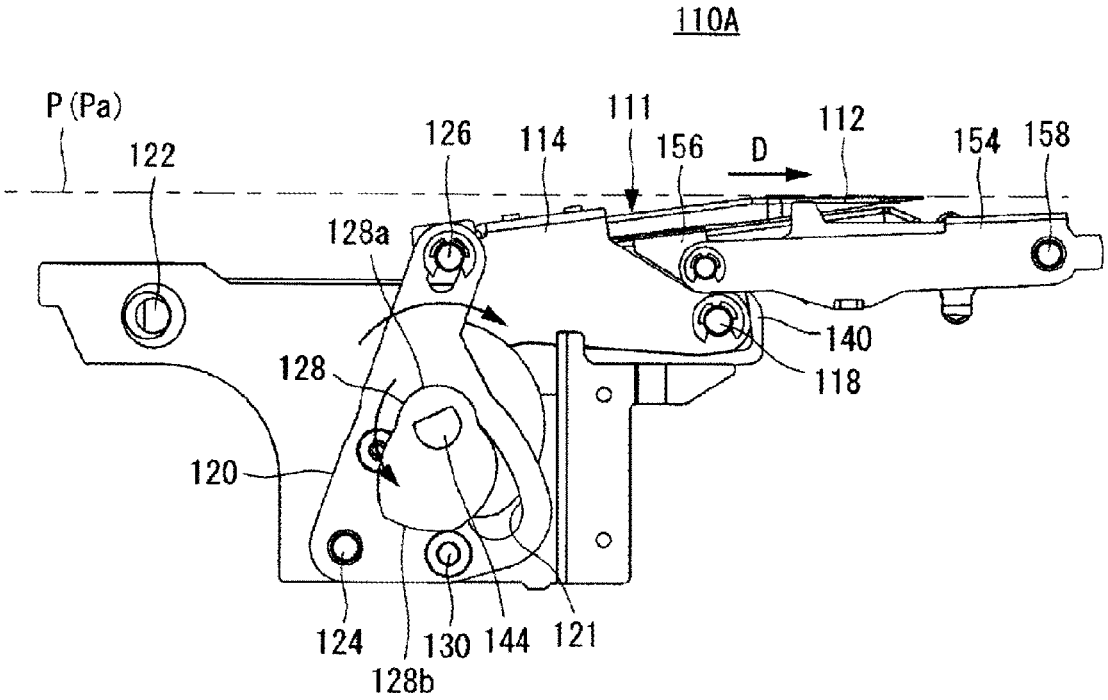
FIG. 9B is a side view of the drive lever, the drive cam, and the drive cam roller according to the first embodiment.

FIGS. 9A and 9B are side views of a drive lever 120, a drive cam 128, and a drive cam roller 130.

The drive lever 120 includes a pair of flat plate members having an inverted triangular shape, and is arranged outside the pull-down link 140. A fulcrum shaft 124 is attached to a lower end portion of the drive lever 120. The drive lever 120 is rotatable about the fulcrum shaft 124 which serves as a fulcrum. The wedge plate drive shaft 126 is attached, via a shaft hole, to a portion that protrudes from an upper end of a front portion of the drive lever 120. As a result, when the drive lever 120 rotates, the moving portion 111 attached to the wedge plate drive shaft 126 can move forward and backward. A long hole 121 through which the drive shaft 144 is inserted is formed in an upper portion of the drive lever 120.

The drive cam 128 is attached to the drive shaft 144 on an outer side of the drive lever 120. The drive cam 128 includes at least a first cam portion 128*a* at a first distance from a cam axis thereof and a second cam portion 128*b* at a second distance, which is longer than the first distance, from the cam axis. A drive cam roller 130 is attached to a rear side of the drive lever 120. The drive cam roller 130 is provided to be capable of being abutted against the drive cam 128.

Figure 10A:
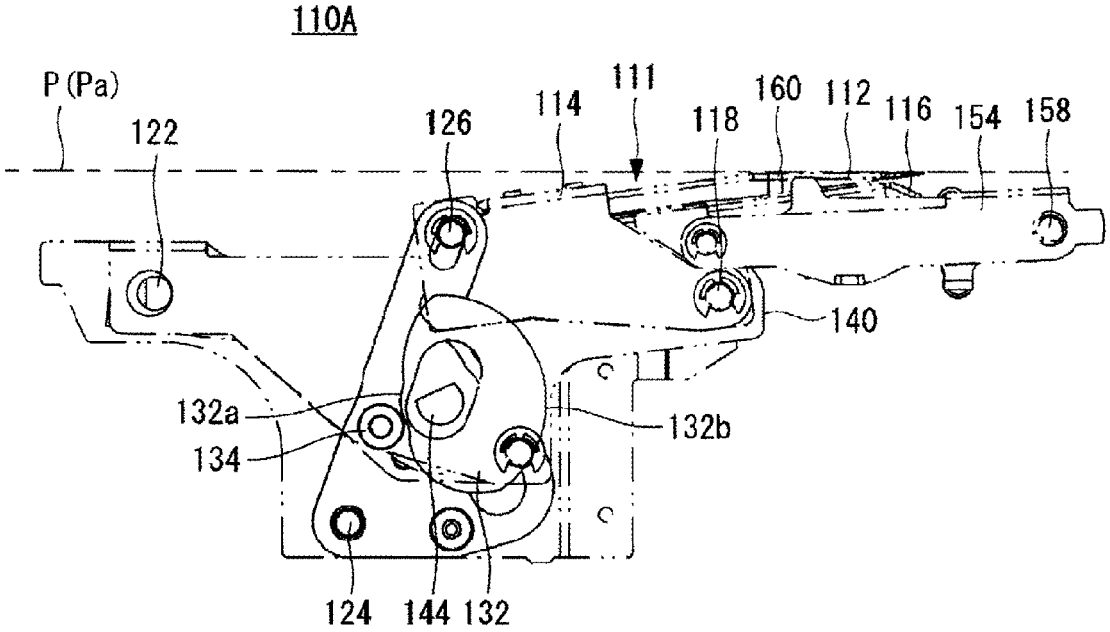
FIG. 10A is a side view of a drive return cam and a drive return cam roller according to the first embodiment.
Figure 10B:
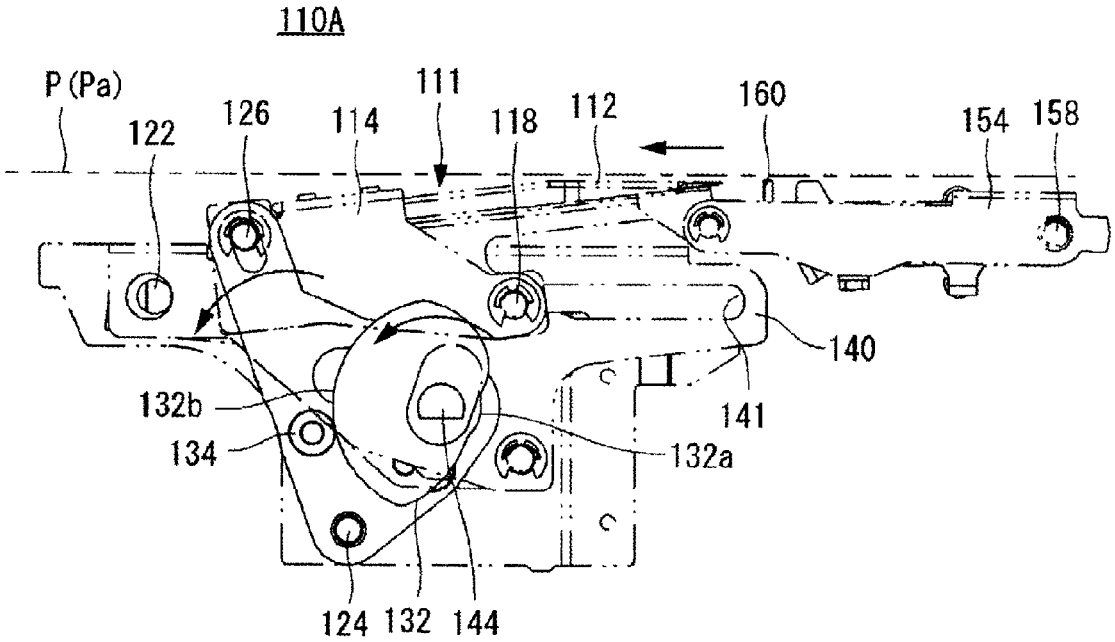
FIG. 10B is a side view of the drive return cam and the drive return cam roller according to the first embodiment.

FIGS. 10A and 10B are side views of a drive return cam 132 and a drive return cam roller 134.

The drive return cam 132 is attached to the drive shaft 144 on an inner side of the drive lever 120. The drive return cam 132 includes at least a first cam portion 132*a* at the first distance from a cam axis thereof and a second cam portion 132*b* at the second distance, which is longer than the first distance, from the cam axis. The drive return cam roller 134 is attached to a front side of the drive lever 120. The drive return cam roller 134 is provided to be capable of being abutted against the drive return cam 132.

Figure 11A:
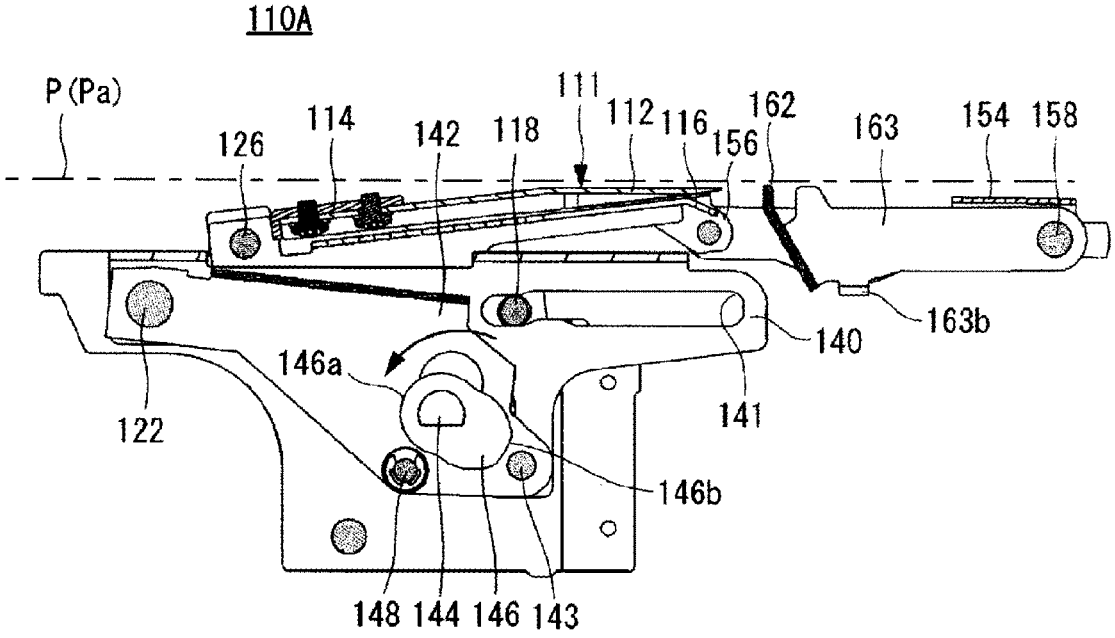
FIG. 11A is a side view of a pull-down link lever and the like according to the first embodiment.
Figure 11B:
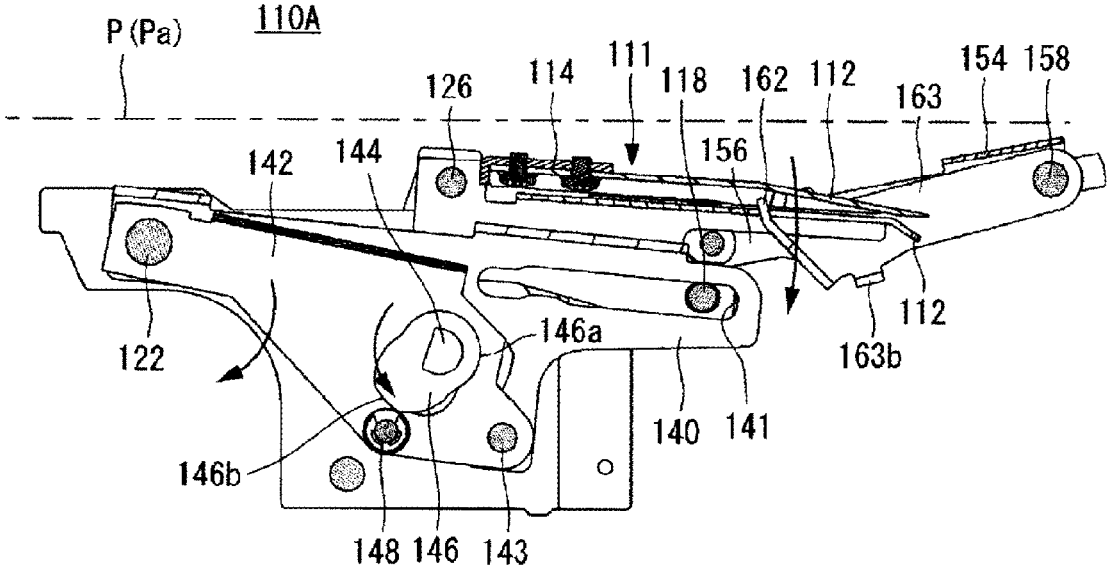
FIG. 11B is a side view of the pull-down link lever and the like according to the first embodiment.

FIGS. 11A and 11B are side views of a pull-down link lever 142 and the like.

The pull-down link lever 142 is formed of a pair of flat plate members, and is arranged between the pull-down link 140 and the drive lever 120 (not shown). The adjustment fulcrum shaft 122 is attached to a rear end portion of the pull-down link lever 142. The pull-down link lever 142 is configured to be rotatable about the adjustment fulcrum shaft 122 which serves as a fulcrum. The drive shaft 144 is inserted through a shaft hole formed in a substantially central portion of the pull-down link lever 142. The pull-down link lever 142 is connected to the pull-down link 140 via a pull-down link lever shaft 143 attached to a lower end of a rear portion of the pull-down link lever 142.

A pull-down cam 146 is attached to the drive shaft 144 on an outer side of the pull-down link lever 142. The pull-down cam 146 includes at least a first cam portion 146*a* at the first distance from a cam axis thereof and a second cam portion 146*b* at the second distance, which is longer than the first distance, from the cam axis. A pull-down cam roller 148 is attached to a lower end portion of a center of the pull-down link lever 142 so as to be capable of being abutted against the pull-down cam 146.

Figure 12A:
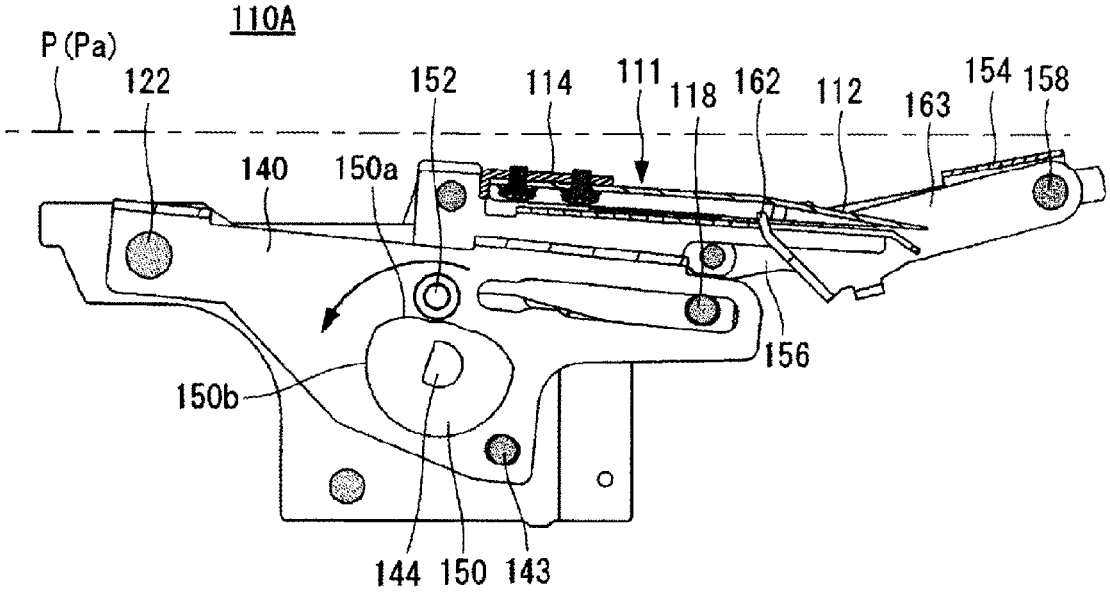
FIG. 12A is a side view of a pull-up return cam and a pull-down return cam roller according to the first embodiment.
Figure 12B:
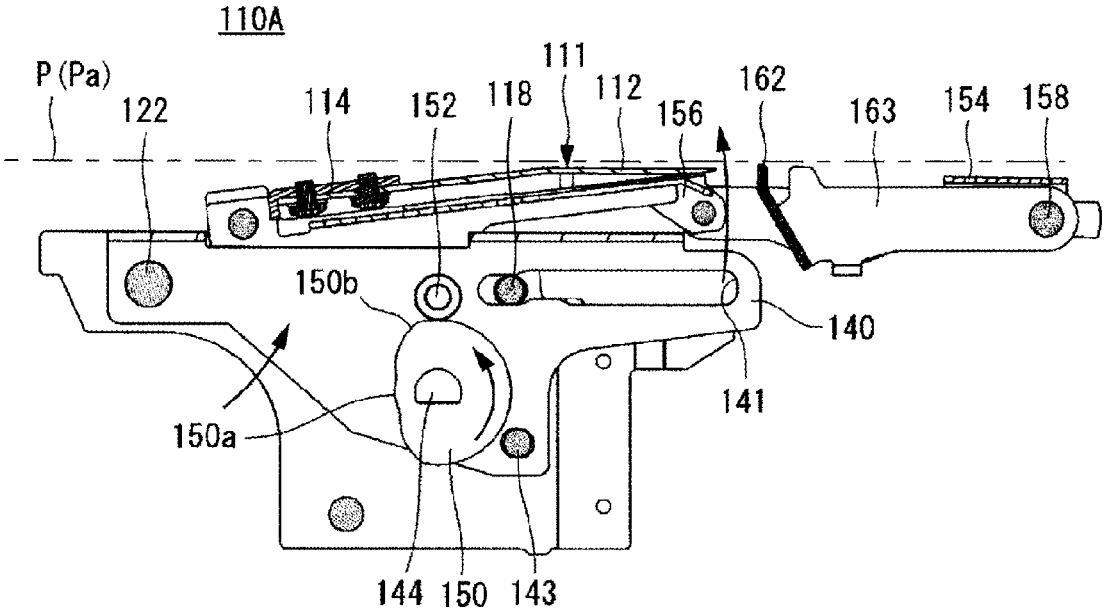
FIG. 12B is a side view of the pull-up return cam and the pull-down return cam roller according to the first embodiment.

FIGS. 12A and 12B are side views of a pull-up return cam 150 and a pull-down return cam roller 152.

The drive shaft 144 is inserted through a shaft hole (not shown) formed in a substantially central portion of the pull-down link 140. The pull-up return cam 150 is attached to the drive shaft 144 on an outer side of the pull-down link 140. The pull-up return cam 150 includes at least a first cam portion 150*a* at the first distance from a cam axis thereof and a second cam portion 150*b* at the second distance, which is longer than the first distance, from the cam axis. The pull-down return cam roller 152 is attached to an upper portion side of an outer side center of the pull-down link 140 so as to be capable of being abutted against the pull-down return cam 150.

[Configuration Example of Paper Pressing Mechanism Portion 170]

Figure 13A:
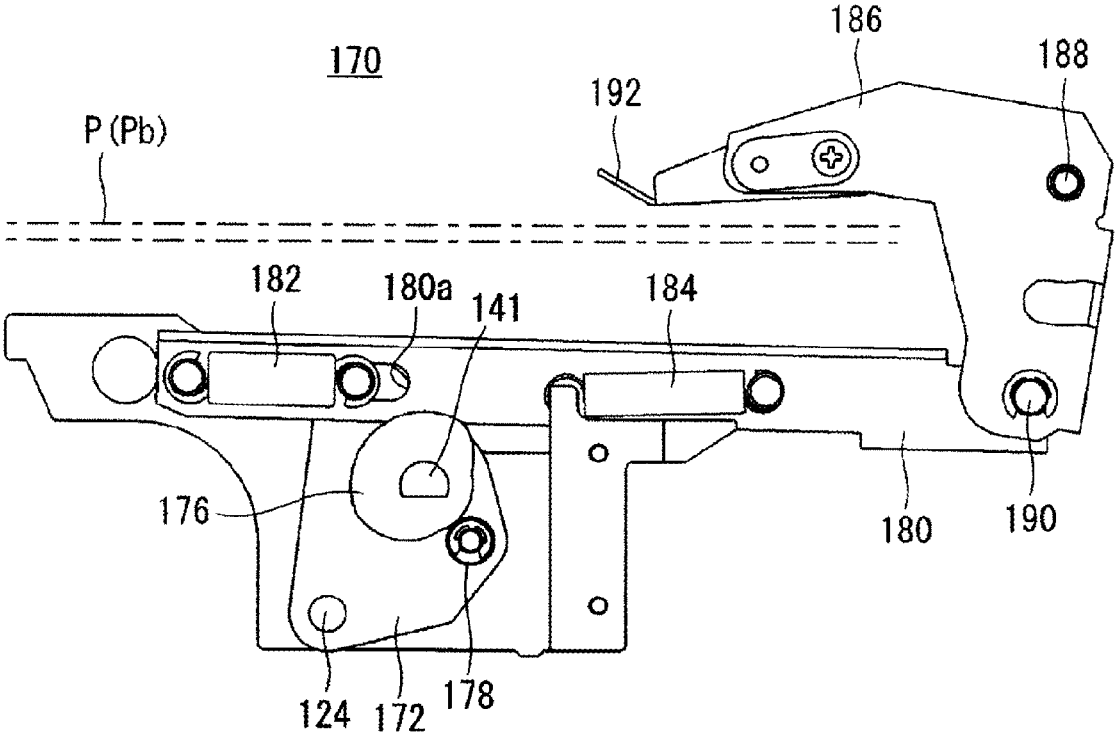
FIG. 13A is a side view of the paper pressing mechanism portion according to the first embodiment.
Figure 13B:
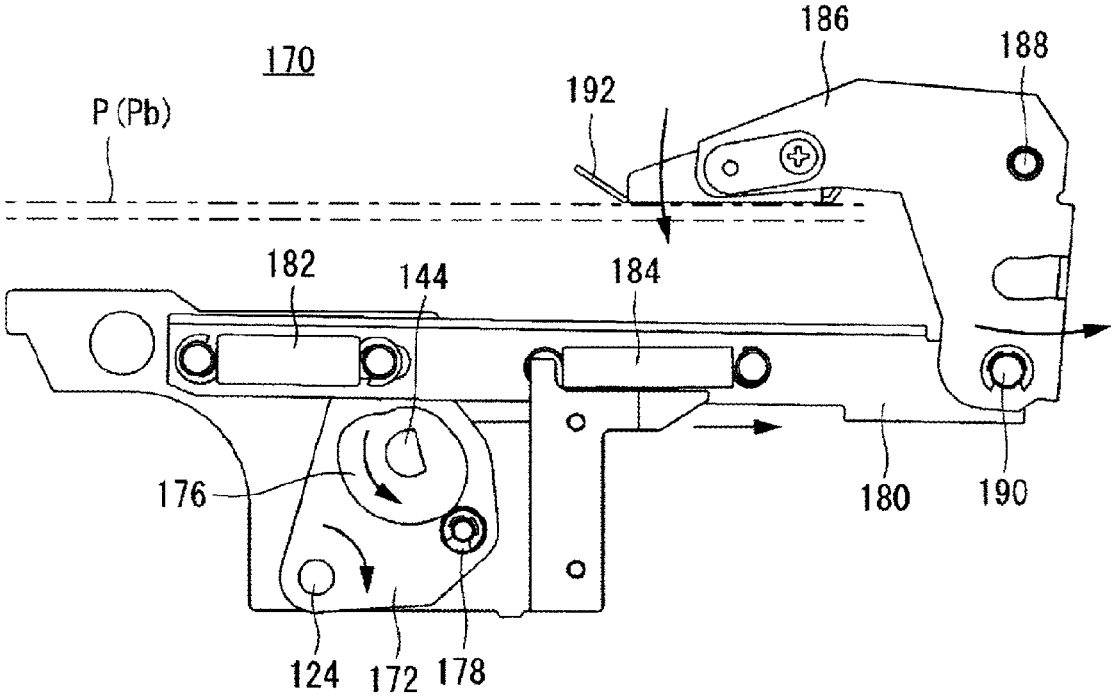
FIG. 13B is a side view of the paper pressing mechanism portion according to the first embodiment.

FIGS. 13A and 13B are side views of the paper pressing mechanism portion 170. Hereinafter, the paper pressing mechanism portion 170 will be described with reference to FIGS. 4A and 4C.

As shown in FIGS. 4A and 4C, the paper pressing mechanism portion 170 includes a paper pressing plate 192, a cover 194 that covers the paper pressing plate 192 and the like exposed to outside of the paper pressing mechanism portion 170, and an illumination portion 196 that irradiates a staple removal position PE provided on the placement table 104.

The illumination portion 196 includes an irradiation member 199 arranged at a position, which faces the staple removal position PE, on a board 197 arranged inside the cover 194, and a slit portion 198 which is arranged between the irradiation member 199 and the staple removal position PE and extends in the left-right direction in a slim and long shape. The staple removal position PE is a position where the staple removal is performed on the placement table 104. Irradiation light emitted from the irradiation member 199 is blocked by the slit portion 198 except for irradiation light passing through the slit, and thus the staple removal position PE is irradiated. Specifically, the placement table 104 is irradiated with irradiation light having the same slim and long shape as a bent shape of each of the leg portions Sb, Sb.

When the user places the paper bundle P on the placement table 104 with a position of the staple S aligned with the staple removal position PE, the user may place the paper bundle P on the placement table 104 with the pair of leg portions Sb, Sb of the staple S aligned with an irradiation range R of the irradiation light.

In related art, since the staple removal position PE is a region surrounded by the paper pressing plate 192, the cover 194, and the like, the staple removal position PE tends to be dark in some cases. By providing the illumination portion 196, the staple removal position PE can be easily seen. Further, by irradiating the staple removal position PE with the irradiation light emitted from the irradiation member 199 through the slit portion 198 in the same slim and long shape as the bent shape of the leg portions Sb, Sb, a range of the staple removal position PE can be more accurately indicated, and operation efficiency can be improved at the time of aligning the paper bundle P with the staple removal position PE.

As shown in FIGS. 13A and 13B, the paper pressing mechanism portion 170 includes a flat plate-shaped first paper hold lever 172, a second paper hold lever 180 which has an elongated shape extending in the front-rear direction of the housing 102, and an L-shaped third paper hold lever 186.

The first paper hold lever 172 is rotatably attached to the fulcrum shaft 124. The drive shaft 144 is inserted into a shaft hole (not shown) formed in the first paper hold lever 172. A base hold cam 176 is attached to the drive shaft 144 on an outer side of the first paper hold lever 172. A paper hold cam roller 178 is attached to the first paper hold lever 172. The paper hold cam roller 178 is provided to be capable of being abutted against the base hold cam 176.

One end portion of a paper thickness adjustment spring 182 is attached to a front portion of the second paper hold lever 180, while the other end portion of the paper thickness adjustment spring 182 is attached to the first paper hold lever 172 via a long hole 180*a* of the second paper hold lever 180. A return spring 184 is provided at a substantially central portion of the second paper hold lever 180. One end portion of the return spring 184 is attached to the housing 102, while the other end portion of the return spring 184 is attached to the second paper hold lever 180. For example, tension springs are used as the paper thickness adjustment spring 182 and the return spring 184.

One end portion of the third paper hold lever 186 is attached to a rear end portion of the second paper hold lever 180 via a shaft 190. The paper pressing plate 192 is attached to the other end portion of the third paper hold lever 186. A hold lever shaft 188 is attached to a bent portion of the third paper hold lever 186. The third paper hold lever 186 is configured to be rotatable about the hold lever shaft 188 which serves as a fulcrum.

[Insertion Operation of Wedge Plate 112]

Next, a forward movement operation of the wedge plate 112 of the staple pulling mechanism portion 110A will be described. As shown in FIGS. 9A and 9B, when the drive shaft 144 is rotated in a counterclockwise direction by driving of the motor 206, the drive cam 128 is also rotated in the counterclockwise direction in accordance with the rotation of the drive shaft 144. Due to the rotation of the drive cam 128, the second cam portion 128*b* of the drive cam 128 is abutted against the drive cam roller 130 so as to bias the drive cam roller 130 downward, and thus the drive lever 120 rotates rearward with the fulcrum shaft 124 serving as a fulcrum. As a result, the wedge plate drive shaft 126 attached to the drive lever 120 is moved in the insertion direction D, so that the wedge plate 112 and the crown holder 116 are also moved forward.

[Backward Movement Operation of Wedge Plate 112]

Next, a backward movement operation of the wedge plate 112 of the staple pulling mechanism portion 110A will be described. As shown in FIGS. 10A and 10B, when the drive shaft 144 is rotated in the counterclockwise direction by the driving of the motor 206, the drive return cam 132 is also rotated in the counterclockwise direction in accordance with the rotation of the drive shaft 144. Due to the rotation of the drive return cam 132, the second cam portion 132*b* of the drive return cam 132 is abutted against the drive return cam roller 134 so as to bias the drive return cam roller 134 forward, and thus the drive lever 120 is rotated forward (in a direction of an arrow) with the fulcrum shaft 124 serving as a fulcrum. As a result, the wedge plate drive shaft 126 attached to the drive lever 120 is moved in a direction opposite to the insertion direction D, so that the wedge plate 112 and the crown holder 116 are moved backward.

[Lowering Operation of Wedge Plate 112]

Next, a lowering operation of the wedge plate 112 of the staple pulling mechanism portion 110A will be described. As shown in FIGS. 11A and 11B, when the drive shaft 144 is rotated in the counterclockwise direction by the driving of the motor 206, the pull-down cam 146 is also rotated in the counterclockwise direction in accordance with the rotation of the drive shaft 144. Due to the rotation of the pull-down cam 146, the second cam portion 146*b* of the pull-down cam 146 is abutted against the pull-down cam roller 148 so as to bias the pull-down cam roller 148 downward, and thus the pull-down link lever 142 is rotated downward with the adjustment fulcrum shaft 122 serving as a fulcrum. As a result, the pull-down link 140 is lowered in conjunction with an operation of the pull-down link lever 142, and the wedge plate 112 and the crown holder 116 are also moved downward.

In the present embodiment, the ejector 156 and the ejector lever 154 are also moved downward in conjunction with the downward movement of the wedge plate 112 and the crown holder 116. As a result, the rib portion 163*b* of the staple pressing mechanism 160 is biased downward by the ejector lever 154, so that the staple pressing portion 162 is moved downward following an operation of the wedge plate 112 and the like.

[Lifting Operation of Wedge Plate 112]

Next, a lifting operation of the wedge plate 112 of the staple pulling mechanism portion 110A will be described. As shown in FIGS. 12A and 12B, the drive shaft 144 is rotated in the counterclockwise direction by the driving of the motor 206, and the pull-down return cam 150 is also rotated in the counterclockwise direction in accordance with the rotation of the drive shaft 144. Due to the rotation of the pull-down return cam 150, the second cam portion 150*b* of the pull-down return cam 150 is abutted against the pull-down return cam roller 152 so as to bias the pull-down return cam roller 152 upward, and thus the pull-down link 140 rotates upward with the adjustment fulcrum shaft 122 serving as a fulcrum. As a result, the pull-down link 140 is moved upward, and accordingly, the wedge plate 112 and the crown holder 116 are also moved upward to initial heights thereof.

In the present embodiment, the ejector 156 and the ejector lever 154 are moved upward in accordance with the upward movement of the wedge plate 112. Therefore, the staple pressing portion 162 which is connected to the ejector lever 154 via the tension spring 164 (see FIG. 7) is moved upward following the operation of the wedge plate 112 and the like.

[Pressing Operation of Paper Pressing Mechanism Portion 170]

Next, a pressing operation of the paper pressing mechanism portion 170 will be described. As shown in FIGS. 13A and 13B, the base hold cam 176 is rotated due to the rotation of the drive shaft 144, and the first paper hold lever 172 is rotated rearward with the fulcrum shaft 124 serving as a fulcrum. The other end portion of the paper thickness adjustment spring 182 is moved forward along the long hole, while the one end portion of the paper thickness adjustment spring 182 is pulled rearward, so that the second paper hold lever 180 is moved forward. As a result, the third paper hold lever 186 rotates forward about the hold lever shaft 188 which serves as a fulcrum, so that the paper pressing plate 192 is moved in a direction approaching the placement table 104 (paper bundle P) and presses the paper bundle P. A stroke of the first paper hold lever 172 driven by the base hold cam 176 has a sufficient pressing amount even when the paper bundle P is thin. When the paper pressing plate 192 is abutted against the second paper surface Pb, the second paper hold lever 180 and the third paper hold lever 186 are stopped while the first paper hold lever 172 is driven to a predetermined position by the base hold cam 176. At this time, the paper thickness adjustment spring 182 is stretched, and a spring force at this time becomes a paper pressing force.

On the other hand, when the pulling of the staple S from the paper bundle P is completed, the first paper hold lever 172 is rotated forward about the fulcrum shaft 124 which serves as the fulcrum due to rotation of the base hold cam 176, and thus the second paper hold lever 180 is moved backward by a spring force of the return spring 184 and returned to a home position. As a result, the third paper hold lever 186 is rotated rearward about the hold lever shaft 188 which serves as the fulcrum, and the paper pressing plate 192 is moved in a direction away from the placement table 104.

[Operation Example of Staple Removal Device 100]

FIGS. 14A to 14F show an example of an operation of the staple removal device 100 when the staple S is pulled out from the paper bundle P. FIGS. 15A to 15G are main part enlarged views of the wedge plate 112, the crown portion Sa, and the staple pressing mechanism 160 during the staple removal. FIGS. 16A to 16F show a state of the staple S to be pulled out from the paper bundle P.

Figure 14A:
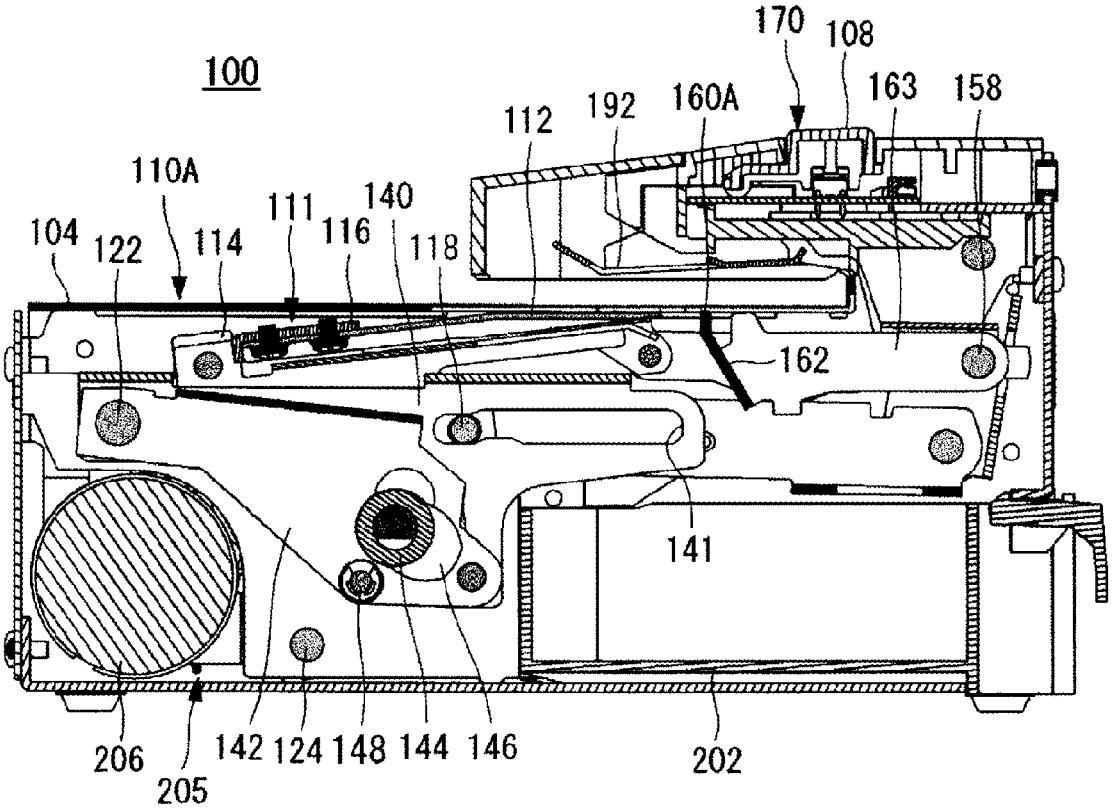
FIG. 14A shows an operation during staple removal of the staple removal device according to the first embodiment.

As shown in FIG. 14A, the staple pulling mechanism portion 110A including the wedge plate 112 stands by at the home position until the paper bundle P is placed on the placement table 104 and the start switch 108 is pressed by the user.

Figure 14B:
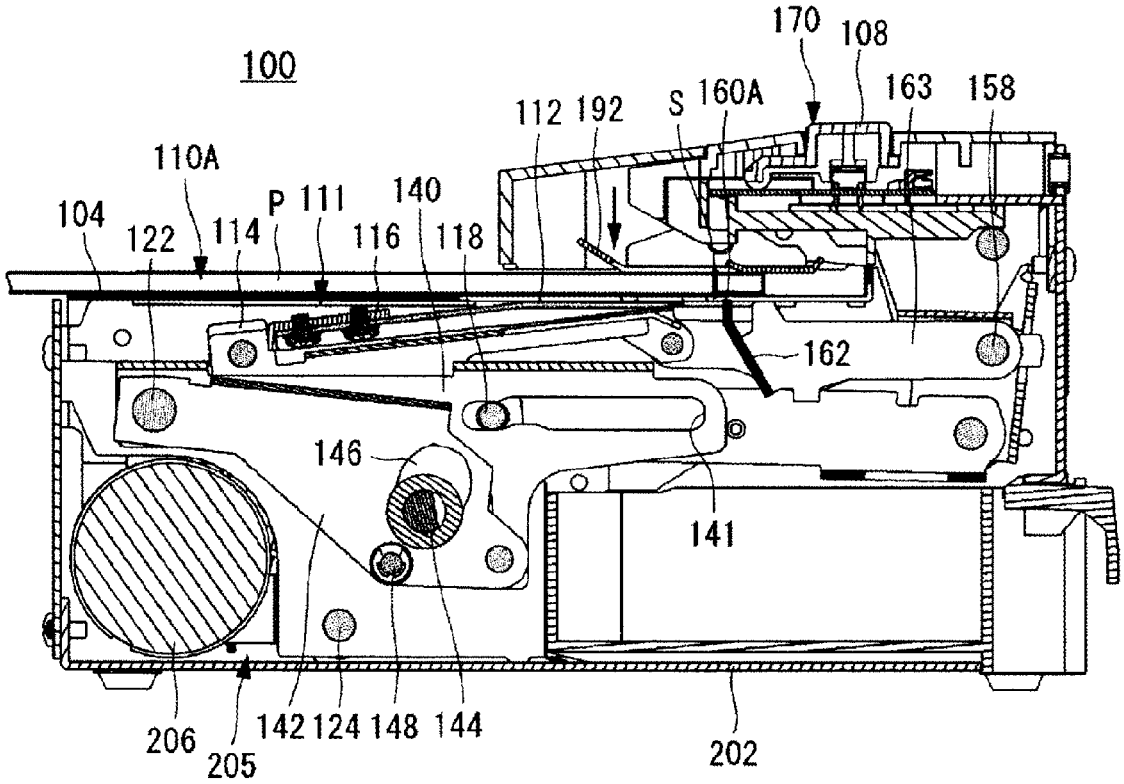
FIG. 14B shows an operation during the staple removal of the staple removal device according to the first embodiment.
Figure 15A:
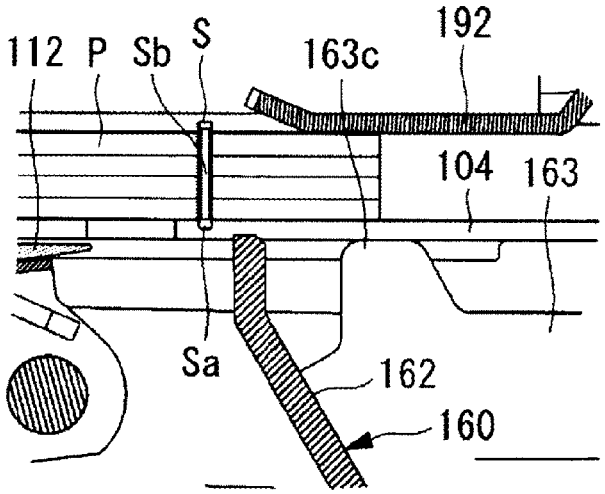
FIG. 15A is a main part enlarged view of a wedge plate, a crown portion, and a staple pressing mechanism during the staple removal according to the first embodiment.

Subsequently, as shown in FIGS. 14B and 15A, when the paper bundle P is placed on the placement base 104 and the user presses the start switch 108, the paper pressing plate 192 is lowered by driving of the paper pressing mechanism portion 170, and the paper bundle P is pressed by the paper pressing plate 192 (see FIGS. 13A and 13B).

Figure 16A:
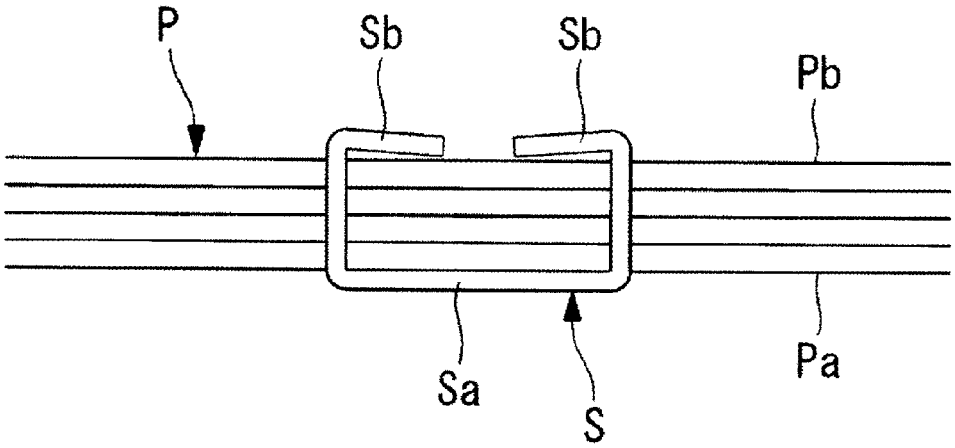
FIG. 16A shows a state of the staple pulled out from the paper bundle.

At this time, as shown in FIG. 16A, the staple S binding the paper bundle P is in a state where the leg portions Sb, Sb of the staple S penetrate from the first paper surface Pa to the second paper surface Pb of the paper bundle P, and each of the penetrated leg portions Sb, Sb is bent inward.

Figure 15B:
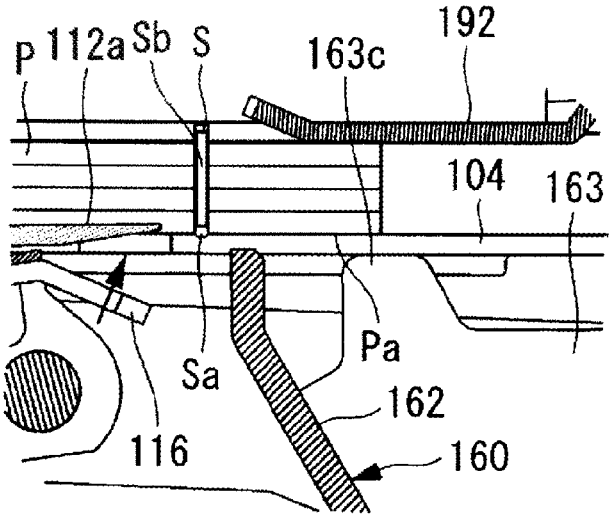
FIG. 15B is a main part enlarged view of the wedge plate, the crown portion, and the staple pressing mechanism during the staple removal according to the first embodiment.

Subsequently, as shown in FIGS. 9A and 9B, the drive cam 128 is rotated due to rotation of the drive shaft 144, and the drive lever 120 is rotated rearward about the fulcrum shaft 124 which serves as the fulcrum. Accordingly, the wedge plate drive shaft 126 is moved in the insertion direction D, and the wedge plate shaft 118 is moved along the long hole 141 of the pull-down link 140, so that the wedge plate 112 is moved forward. Due to the forward movement of the wedge plate shaft 118, the wedge plate shaft 118 is in a state of riding on the protruding portion 141*a* formed in the long hole 141. As a result, as shown in FIG. 15B, the wedge plate 112 is lifted upward by a height of the protruding portion 141*a*, so that the first surface 112*a* of the wedge plate 112 is pressed against the first paper surface Pa.

At this time, since the wedge plate 112 is not inserted between the paper bundle P and the crown portion Sa, the leg portions Sb, Sb of the staple S are bent inward as in FIG. 16A.

Figure 14C:
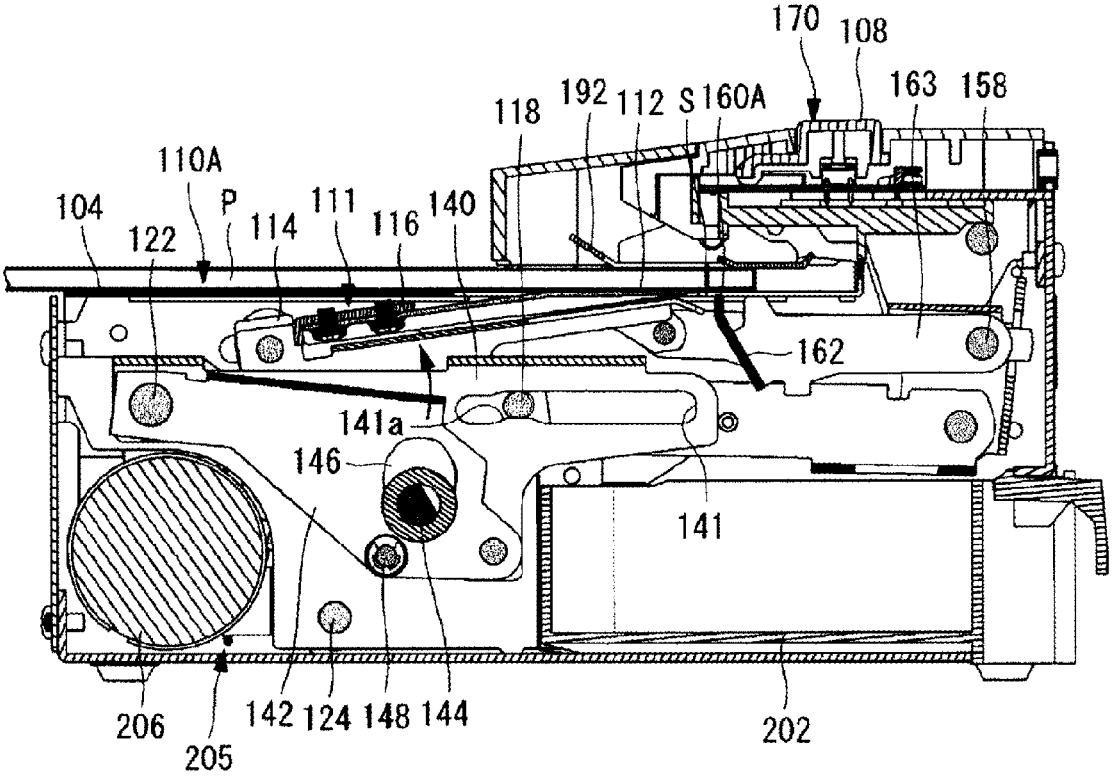
FIG. 14C shows an operation during the staple removal of the staple removal device according to the first embodiment.
Figure 15C:
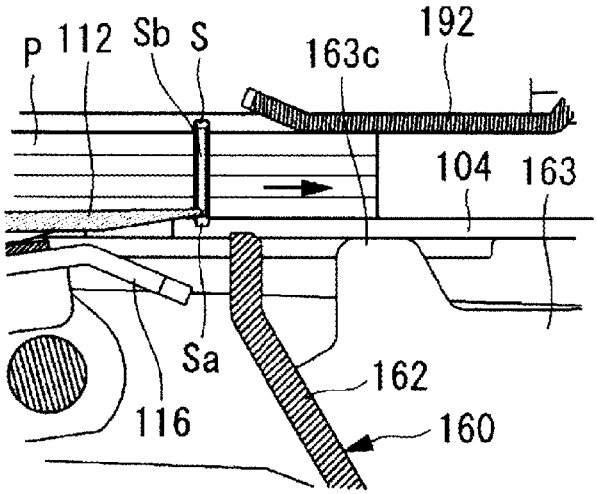
FIG. 15C is a main part enlarged view of the wedge plate, the crown portion, and the staple pressing mechanism during the staple removal according to the first embodiment.
Figure 15D:
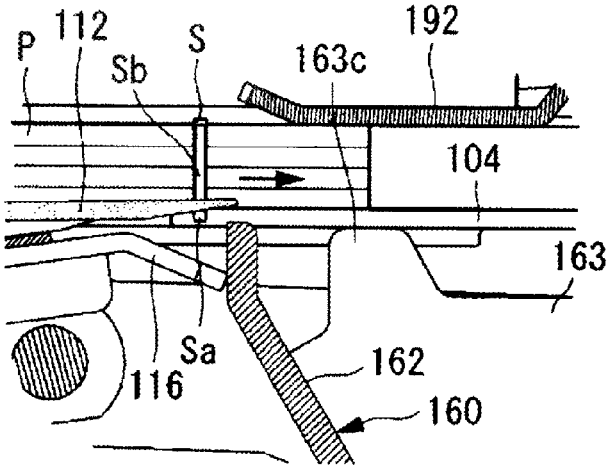
FIG. 15D is a main part enlarged view of the wedge plate, the crown portion, and the staple pressing mechanism during the staple removal according to the first embodiment.

When the drive lever 120 is rotated rearward, the wedge plate shaft 118 is moved forward in the state of riding on the protruding portion 141*a* of the long hole 141. As the wedge plate shaft 118 moves forward, as shown in FIGS. 14C, 15C, and 15D, the wedge plate 112 is inserted between the paper bundle P and the crown portion Sa in the state of being pressed against the paper bundle P, and is moved forward between the paper bundle P and the crown portion Sa.

Figure 16B:
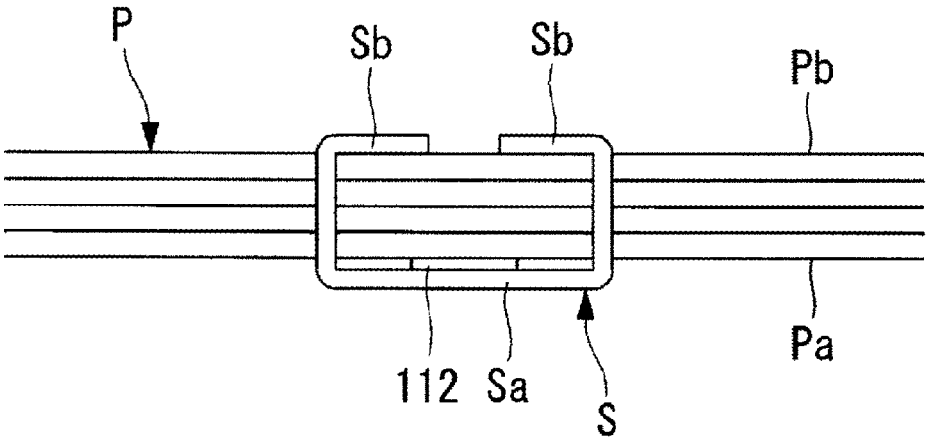
FIG. 16B shows the state of the staple pulled out from the paper bundle.

At this time, as shown in FIG. 16B, the staple S changes from a state where the leg portions Sb, Sb bite into a paper surface of the paper bundle P to a state where the leg portions Sb, Sb are substantially parallel to the paper surface of the paper bundle P.

Figure 15E:
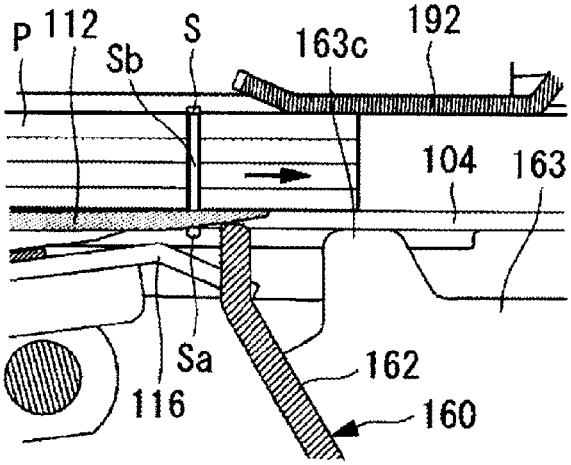
FIG. 15E is a main part enlarged view of the wedge plate, the crown portion, and the staple pressing mechanism during the staple removal according to the first embodiment.

When the wedge plate 112 is further moved forward, as shown in FIG. 15E, a thickness of the wedge plate 112 inserted between the paper bundle P and the crown portion Sa gradually increases. As a result, as shown in FIG. 16C, the crown portion Sa is biased downward by a pushing force of the wedge plate 112, and thus the leg portions Sb, Sb of the staple S binding the paper bundle P are slightly raised.

Figure 15F:
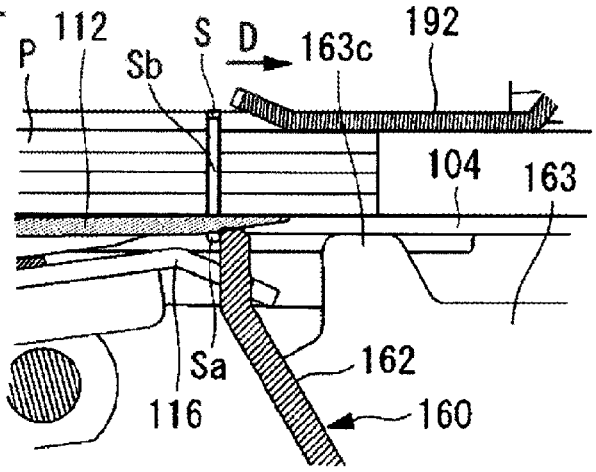
FIG. 15F is a main part enlarged view of the wedge plate, the crown portion, and the staple pressing mechanism during the staple removal according to the first embodiment.

Subsequently, as the wedge plate shaft 118 moves toward a terminal end side of the long hole 141 of the pull-down link 140, the thickness of the wedge plate 112 inserted between the paper bundle P and the crown portion Sa increases. As shown in FIG. 15F, the paper bundle P and the staple S binding the paper bundle P are slightly moved forward together with the wedge plate 112 against a pressing force of the paper pressing plate 192 caused by a pushing force of the wedge plate 112 in the insertion direction D. Accordingly, in the present embodiment, since the staple pressing mechanism 160 is arranged behind the crown portion Sa, the abutment portion 162*b* of the staple pressing portion 162 of the staple pressing mechanism 160 is abutted against the crown portion Sa of the staple S from the direction opposite to the insertion direction D of the wedge plate 112 to restrict movement of the crown portion Sa in the insertion direction D.

Figure 16C:
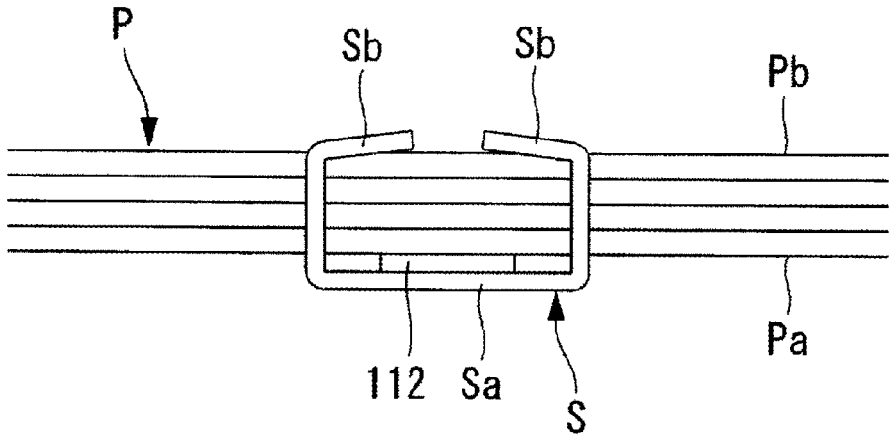
FIG. 16C shows the state of the staple pulled out from the paper bundle.
Figure 16D:
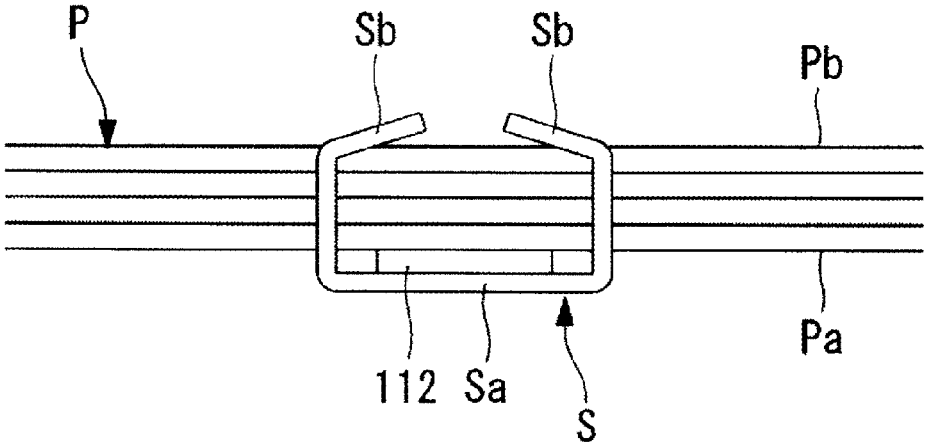
FIG. 16D shows the state of the staple pulled out from the paper bundle.

At this time, as shown in FIG. 16D, the crown portion Sa of the staple S is biased downward by the pushing force of the wedge plate 112, and the leg portions Sb, Sb of the staple S binding the paper bundle P are raised more than in the state shown in FIG. 16C.

Figure 15G:
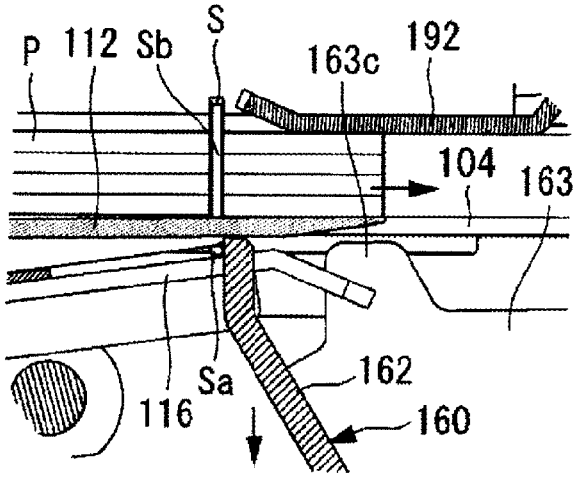
FIG. 15G is a main part enlarged view of the wedge plate, the crown portion, and the staple pressing mechanism during the staple removal according to the first embodiment.

As the wedge plate 112 moves forward, the thickness of the wedge plate 112 inserted between the paper bundle P and the crown portion Sa further increases, and the crown portion Sa is slightly lowered and displaced downward by the thickness of the wedge plate 112. As shown in FIG. 15G, the staple pressing portion 162 abutted against a lower surface of the wedge plate 112 is also moved following the displacement of the crown portion Sa. Therefore, even when the crown portion Sa is displaced, the crown portion Sa can always be pressed by the staple pressing portion 162.

Figure 16E:
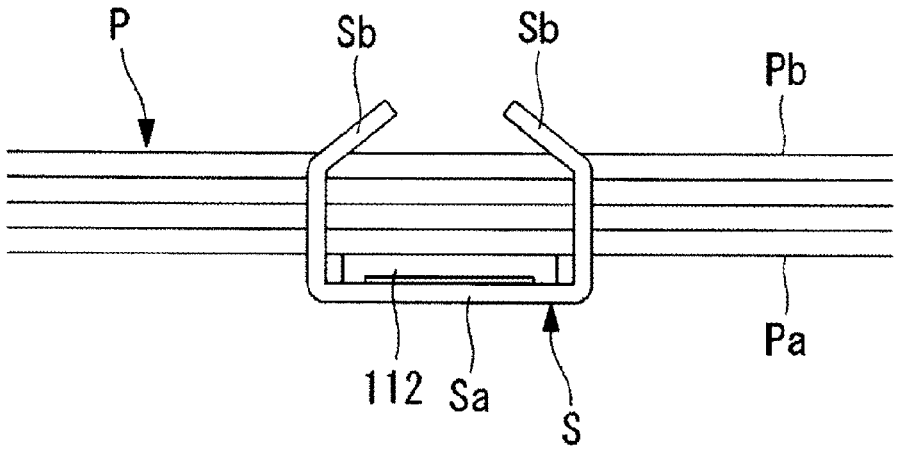
FIG. 16E shows the state of the staple pulled out from the paper bundle.

At this time, as shown in FIG. 16E, the crown portion Sa of the staple S is separated from a lower surface of the paper bundle P in accordance with the thickness of the inserted wedge plate 112, and the leg portions Sb, Sb of the staple S are raised as compared with the state of FIG. 16D.

Figure 14D:
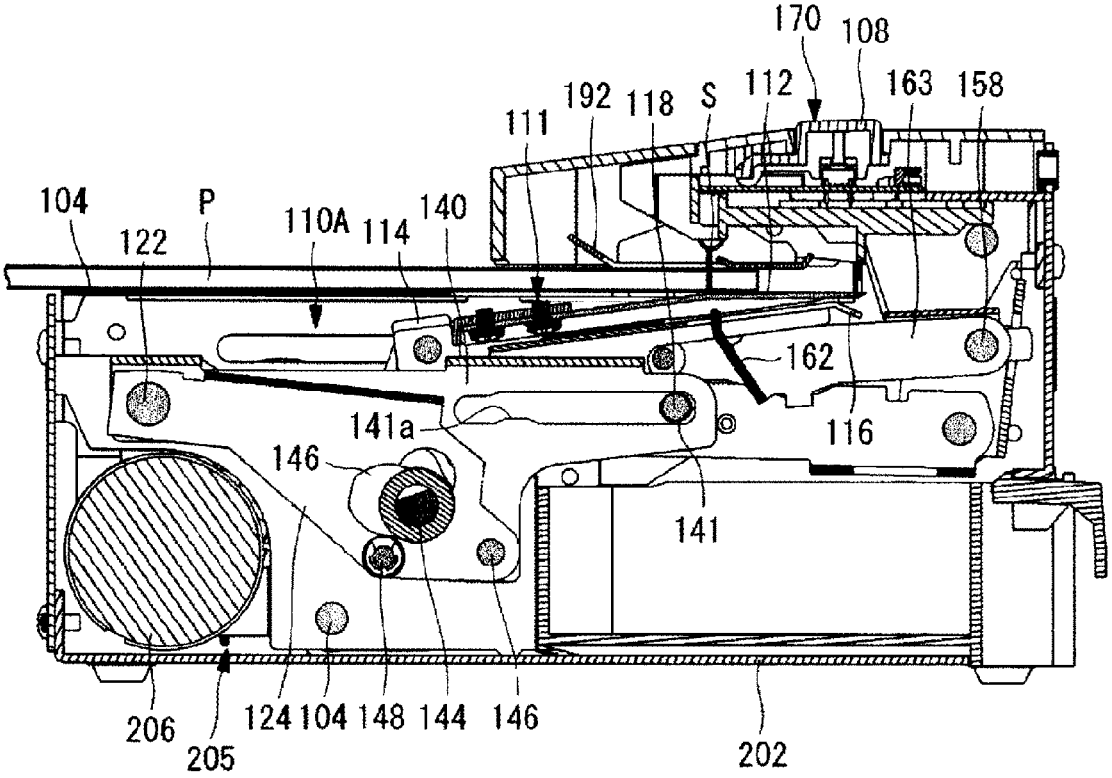
FIG. 14D shows an operation during the staple removal of the staple removal device according to the first embodiment.
Figure 16F:
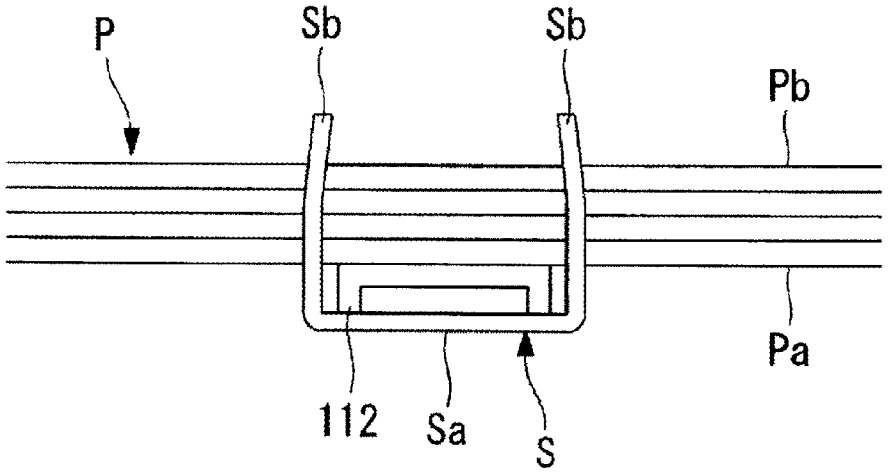
FIG. 16F shows the state of the staple pulled out from the paper bundle.

As shown in FIG. 14D, when the wedge plate shaft 118 is moved to a terminal end of the long hole 141 of the pull-down link 140, the pushing provided by the wedge plate 112 toward space between the paper bundle P and the crown portion Sa is completed. At this time, as shown in FIG. 16F, the staple S is in a state where the crown portion Sa of the staple S is further separated from the paper bundle P and the leg portions Sb, Sb are substantially raised. That is, in a state where the staple S can be pulled out from the paper bundle P.

Figure 14E:
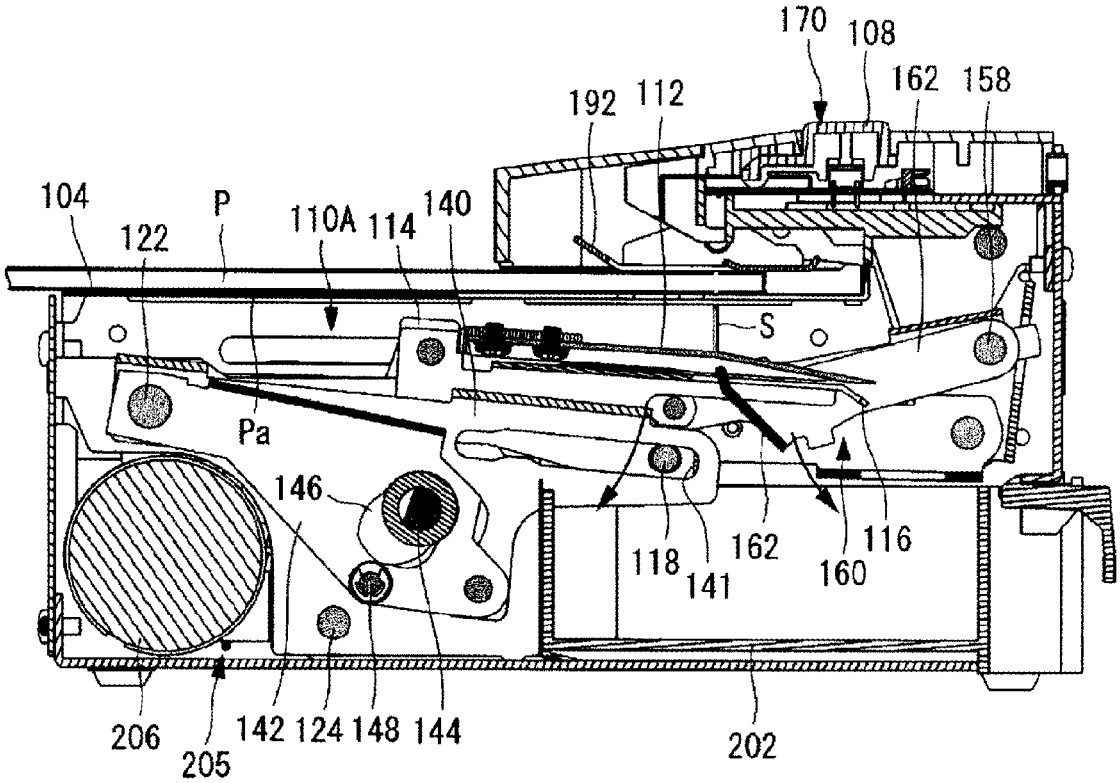
FIG. 14E shows an operation during the staple removal of the staple removal device according to the first embodiment.

Subsequently, as shown in FIGS. 11A, 11B, and 14E, the pull-down cam roller 148 is biased downward by the pull-down cam 146. Accordingly, the pull-down link lever 142 is rotated downward about the adjustment fulcrum shaft 122 which serves as the fulcrum, and the pull-down link 140 and the moving portion 111 are also moved downward. That is, the wedge plate 112 is moved in the direction away from the first paper surface Pa. As a result, the staple S in the state where the leg portions Sb, Sb are raised is pulled out from the paper bundle P. The staple S pulled out from the paper bundle P is held by the crown holder 116.

In the present embodiment, the staple pressing mechanism 160 is also moved downward following the downward movement of the wedge plate 112 and the crown holder 116. Therefore, even when the crown portion Sa is displaced, the state where the crown portion Sa is pressed by the staple pressing portion 162 can be maintained.

Figure 14F:
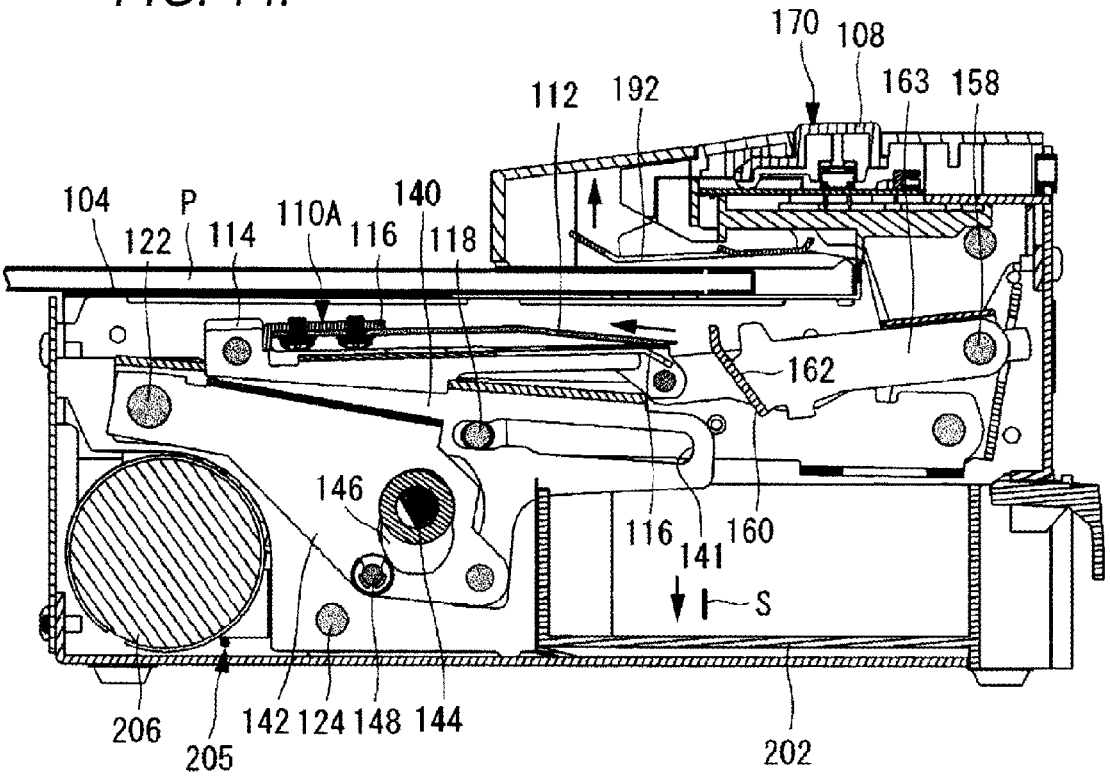
FIG. 14F shows an operation during the staple removal of the staple removal device according to the first embodiment.

Subsequently, as shown in FIGS. 12A and 12B, the moving portion 111 is moved upward. Further, as shown in FIGS. 10A, 10B, and 14F, the drive return cam roller 134 is biased forward due to rotation of the drive return cam 132. Accordingly, the drive lever 120 is rotated forward about the fulcrum shaft 124 which serves as the fulcrum, so that the moving portion 111 is moved backward.

When the moving portion 111 is moved backward, the crown portion Sa is abutted against a rear end portion of the ejector 156 on the front side, and the staple S falls into the dust box 202 at the time when support provided by the retreating crown holder 116 is stopped. The moving portion 111 is moved backward and returned to the home position.

As described above, according to the present embodiment, the abutment portion 162*b* of the staple pressing portion 162 is abutted against the paper bundle P and the staple S, which are moved in the insertion direction D by the pushing force of the wedge plate 112 in the insertion direction D, from the direction opposite to the insertion direction D of the crown portion Sa of the staple S, so that the movement of the paper bundle P and the staple S in the insertion direction D can be restricted. As a result, damage to the paper during the staple removal or a failure such as the staple S is not pulled out from the paper bundle P can be prevented.

Even when the staple is removed from the paper bundle P formed of a small number of pieces of paper or when a corner portion or an edge portion of the paper bundle P is bound, since the abutment portion 162*b* of the staple pressing portion 162 is abutted against the crown portion Sa to restrict the movement in the insertion direction D, paper around the staple S can be prevented from being applied with a large load. As a result, the paper can be prevented from being torn.

By providing the staple pressing portion 162, the wedge plate 112 can be reliably pushed into the space between the paper bundle P and the crown portion Sa to sufficiently raise the leg portions Sb, Sb of the staple S binding the paper bundle P, and then the pull-out operation can be started, so that the failure during the staple removal and the damage to the paper can be prevented.

Further, since the staple pressing portion 162 is operated following the crown portion Sa which is displaced when the wedge plate 112 is pushed in and pulled out, the crown portion Sa can be always supported during the staple removal, and thus the paper bundle P and the crown portion Sa can be prevented from being pushed and moved in the insertion direction D. As a result, the failure during the staple removal and the damage to the paper can be prevented.

<First Modification>

For example, as shown in FIG. 16C, when the wedge plate 112 is inserted between the first paper surface Pa of the paper bundle P and the crown portion Sa, the paper bundle P may be bent toward the second paper surface Pb due to pushing pressure of the wedge plate 112 depending on the type of the paper bundle P. For example, types of paper, the number of pieces of bound paper, types of staple and the like are known to be reasons why the paper bundle P is bent by the crown portion Sa.

In such a case, since a position of the crown portion Sa is inserted toward the paper bundle P based on an amount of bending of the paper bundle P and is located above a normal position, a standby position of the staple pressing portion 162 is located below the position of the crown portion Sa, and thus the staple pressing portion 162 may not be abutted against the crown portion Sa, that is, the staple pressing portion 162 may be idle.

In this regard, in consideration of the bending of the paper bundle P, the staple pressing portion 162 of the staple pressing mechanism 160 may be set at a standby position above the normal standby position. However, for example, in a case where a paper bundle P with little bending is bound, since the position of the crown portion Sa is not displaced, the tip end portion of the wedge plate 112 may collide with the staple pressing mechanism 160 when a position of the staple pressing portion 162 is excessively high.

As described above, the bending amount of the paper bundle P also changes depending on the type of the paper bundle P, and the amount by which the wedge plate 112 is inserted into the paper bundle P is thus changed, so that the position of the crown portion Sa is also changed. Therefore, an ideal standby position of the staple pressing portion 162 also changes depending on types of the paper bundle P and the staple S.

Therefore, in the first modification, a staple pulling mechanism portion 110B is adopted, which includes a mechanism that moves the staple pressing portion 162 toward the wedge plate 112 to abut against the crown portion Sa at timing when the tip end portion of the wedge plate 112 passes between the paper bundle P and the staple pressing portion 162 (above the staple pressing portion 162).

[Configuration Example of Staple Pulling Mechanism Portion 110B]

Figure 17A:
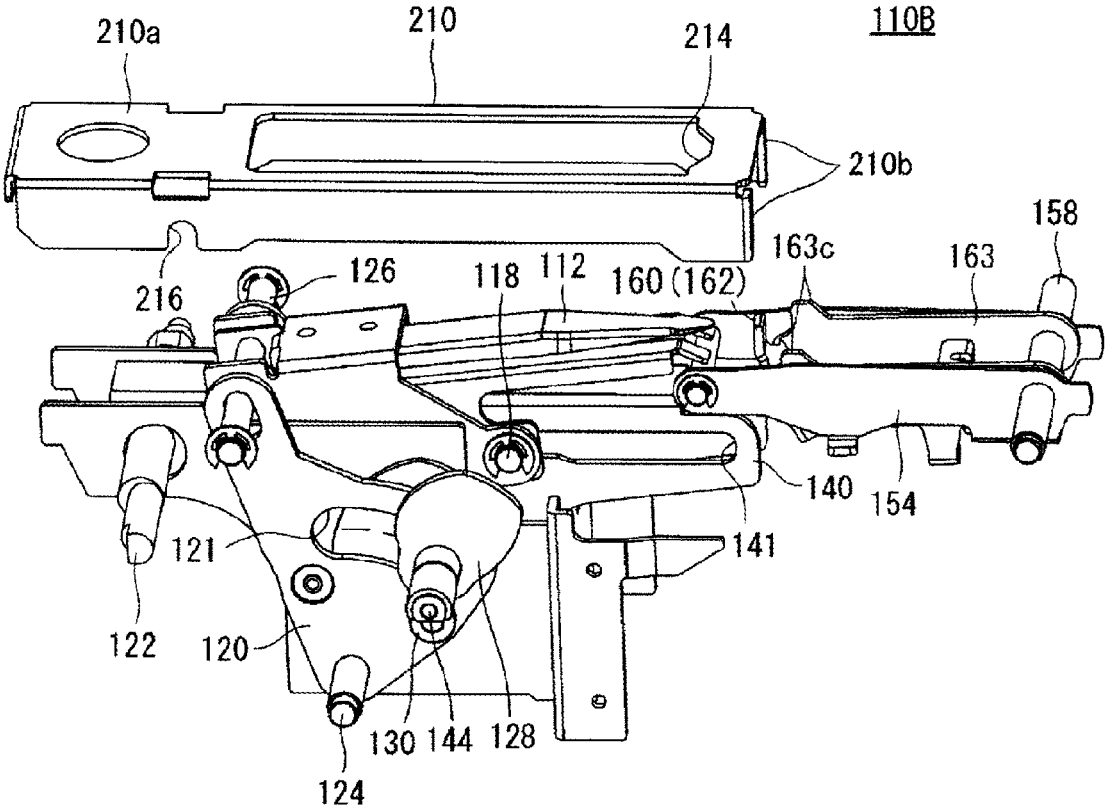
FIG. 17A shows a state of a staple pulling mechanism portion according to a first modification of the first embodiment before a staple stopper presser is mounted.
Figure 17B:
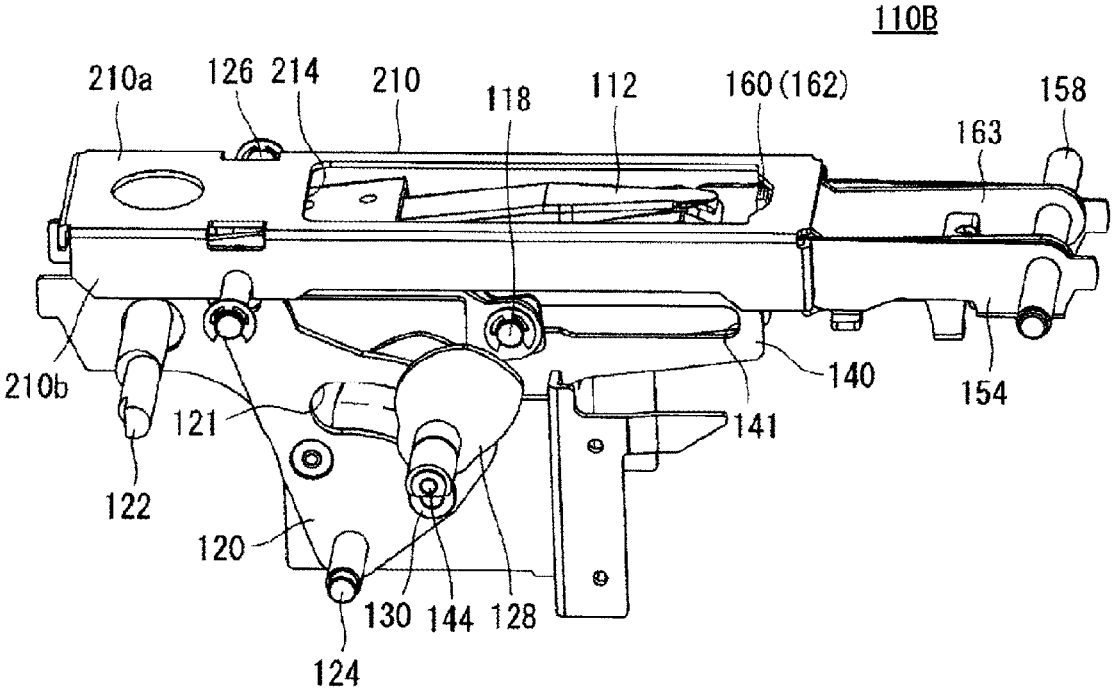
FIG. 17B shows a state of the staple pulling mechanism portion according to the first modification of the first embodiment after the staple stopper presser is mounted.

FIG. 17A shows a state before a staple stopper presser 210 of the staple pulling mechanism portion 110B according to the first modification is mounted. FIG. 17B shows a state after the staple stopper presser 210 of the staple pulling mechanism portion 110B according to the first modification is mounted.

The staple pulling mechanism portion 110B includes the staple stopper presser (restricting portion) 210 which is located between the first paper surface Pa and the abutment portion 162*b*, and moves in the insertion direction D in accordance with movement of the tip end portion of the wedge plate 112 in the insertion direction D. The staple stopper presser 210 restricts the abutment portion 162*b* from being abutted against the second surface 112*b* of the wedge plate 112 until the tip end portion of the wedge plate 112 passes through a first position Pp (see FIG. 18), and allows the abutment portion 162*b* to be abutted against the second surface 112*b* of the wedge plate 112 after the tip end portion of the wedge plate 112 passes through the first position Pp.

The staple stopper presser 210 is a member formed by, for example, bending a flat plate, and includes a ceiling surface portion 210*a* and left and right side surface portions 210*b*, 210*b*. An opening portion 214 from which the wedge plate 112 and the staple pressing mechanism 160 that move up and down are exposed is formed in the ceiling surface portion 210*a*. A part of the ceiling surface portion 210*a* blocks communication between the abutment portion 162*b* and the second surface 112*b* until the tip end portion of the wedge plate 112 passes through the first position Pp. After the tip end portion of the wedge plate 112 passes through the first position Pp, the opening portion 214 allows the abutment portion 162*b* and the second surface 112*b* to communicate with each other. An opening diameter of the opening portion 214 in the insertion direction D is configured such that the protruding portion 163*c* of the staple pressing mechanism 160 is abutted against a back surface of the ceiling surface portion 210*a* until the wedge plate 112 passes above the staple pressing portion 162, and the protruding portion 163*c* is not abutted against the back surface of the ceiling surface portion 210*a* when the wedge plate 112 passes above the staple pressing portion 162.

Bearing portions 216, 216 are formed at front lower end portions of the side surface portions 210*b*, 210*b*. The bearing portions 216, 216 are fitted to the wedge plate drive shaft 126 from outer sides of the drive lever 120. As a result, the staple stopper presser 216 operates in conjunction with the forward movement and the backward movement of the wedge plate 112. That is, the staple stopper presser 216 operates integrally with the wedge plate 112 and the like.

Here, the protruding portion 163*c* of the staple pressing mechanism 160 is abutted against the back surface of the ceiling surface portion 210*a* of the staple stopper presser 210 until the wedge plate 112 passes the staple pressing portion 162, and stands by at a position slightly lowered against an elastic force of the tension spring 164 (see FIG. 7). The standby position is a position at which the tip end portion of the wedge plate 112 which is moved forward does not collide with an upper portion (abutment portion 162*b*) of the staple pressing portion 162.

[Operation Example of Staple Pulling Mechanism Portion 110B]

FIGS. 18A to 18D are main part enlarged views showing an operation of the staple pulling mechanism portion 110B. Hereinafter, a position at which the staple pressing portion 162 stands by until the wedge plate 112 passes is referred to as a second position Po.

Figure 18A:
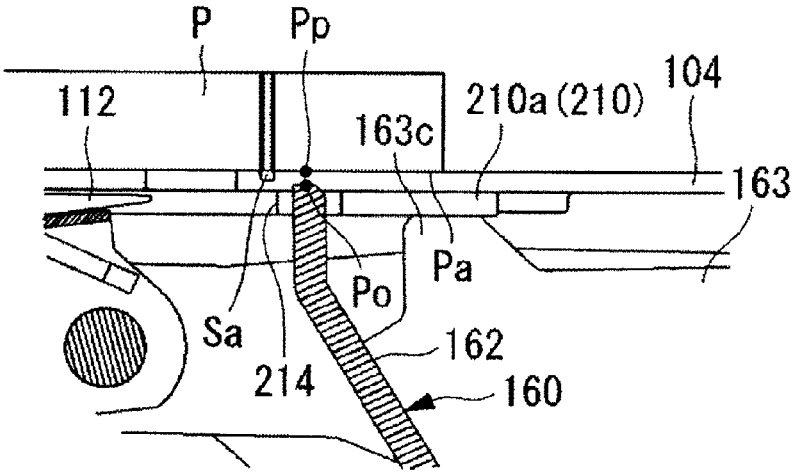
FIG. 18A is a main part enlarged view showing an operation of the staple pulling mechanism portion according to the first modification of the first embodiment.

As shown in FIG. 18A, when the paper bundle P is placed on the placement table 104 and the user presses the start switch 108 (see FIG. 1), the wedge plate 112 and the staple stopper presser 210 are moved forward. At this time, since the protruding portion 163*c* of the support member 163 is abutted against the back surface of the ceiling surface portion 210*a* of the staple stopper presser 210, the staple pressing portion 162 of the staple pressing mechanism 160 stands by at the second position Po.

Figure 18B:
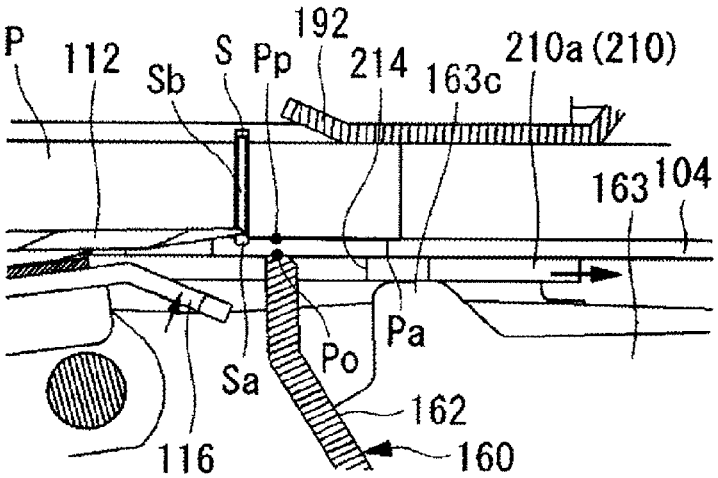
FIG. 18B is a main part enlarged view showing the operation of the staple pulling mechanism portion according to the first modification of the first embodiment.

As shown in FIG. 18B, as the wedge plate 112 moves forward, the wedge plate 112 is pressed against the first paper surface Pa, and the wedge plate 112 is inserted between the paper bundle P and the crown portion Sa of the staple S. At this time, the staple stopper presser 210 is also moved forward. The staple pressing portion 162 of the staple pressing mechanism 160 stands by at the second position Po since the staple pressing portion 162 is abutted against the back surface of the ceiling surface portion 210*a* of the staple stopper presser 210 as in FIG. 18A.

Figure 18C:
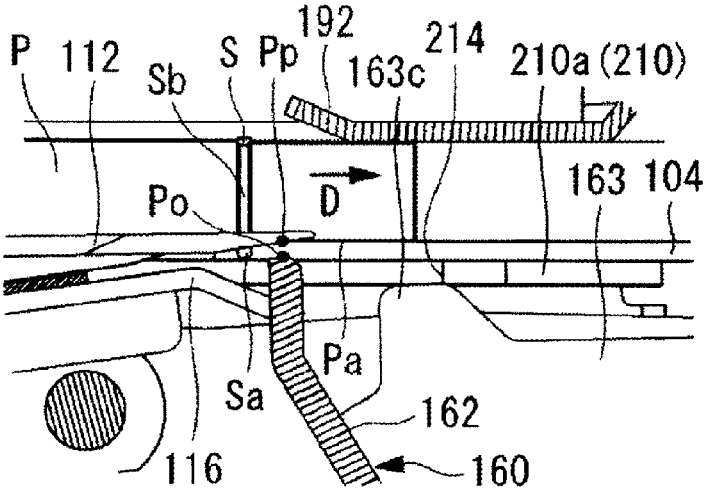
FIG. 18C is a main part enlarged view showing the operation of the staple pulling mechanism portion according to the first modification of the first embodiment.

As shown in FIG. 18C, the wedge plate 112 inserted between the paper bundle P and the crown portion Sa of the staple S reaches above the staple pressing portion 162. As the wedge plate 112 moves forward, the staple stopper presser 210 is also moved forward. At this time, only a part of the protruding portion 163*c* of the staple pulling mechanism portion 110B is abutted against the ceiling surface portion 210*a* of the staple stopper presser 210.

Figure 18D:
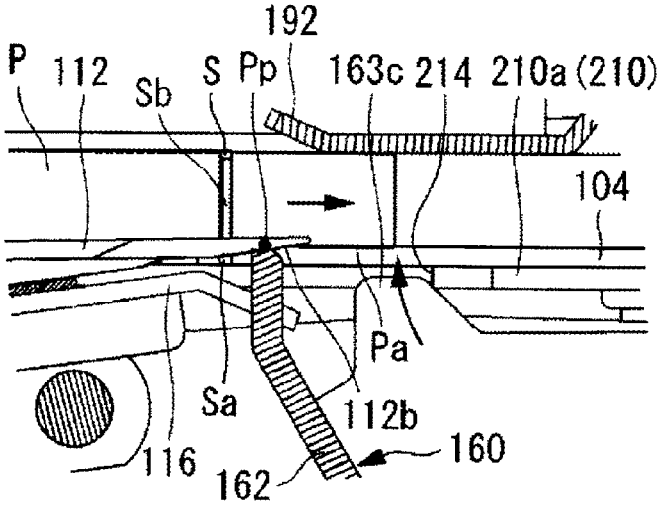
FIG. 18D is a main part enlarged view showing the operation of the staple pulling mechanism portion according to the first modification of the first embodiment.

As shown in FIG. 18D, when the wedge plate 112 passes above the staple pressing portion 162 and reaches the first position Pp, the protruding portion 163*c* of the support member 163 is completely detached from the back surface of the ceiling surface portion 210*a*. As a result, the protruding portion 163*c* of the support member 163 is exposed to inside of the opening portion 214, and support provided by the back surface of the ceiling surface portion 210*a* is stopped, so that the protruding portion 163*c* of the support member 163 is returned to an initial position thereof by the elastic force of the tension spring 164. Accordingly, the abutment portion 162*b* of the staple pressing portion 162 is abutted against the second surface 112*b* of the wedge plate 112.

As described above, according to the first modification, when the wedge plate 112 passes between the paper bundle P and the staple pressing portion 162 and reaches the first position Pp, the abutment portion 162*b* of the staple pressing portion 162 is abutted against the crown portion Sa and the second surface 112*b* of the wedge plate 112, so that the wedge plate 112 can be prevented from colliding with the staple pressing portion 162 while the abutment portion 162*b* of the staple pressing portion 162 can be reliably abutted against the crown portion Sa regardless of the type of the paper bundle P.

<Second Modification>

According to a staple pulling mechanism portion 110C according to a second modification, a staple stopper link cam 230 and the like are adopted instead of the staple stopper presser 210 of the first modification as a unit for moving the staple pressing portion 162 toward the wedge plate 112 at predetermined timing.

[Configuration Example of Staple Pulling Mechanism Portion 110C]

Figure 19A:
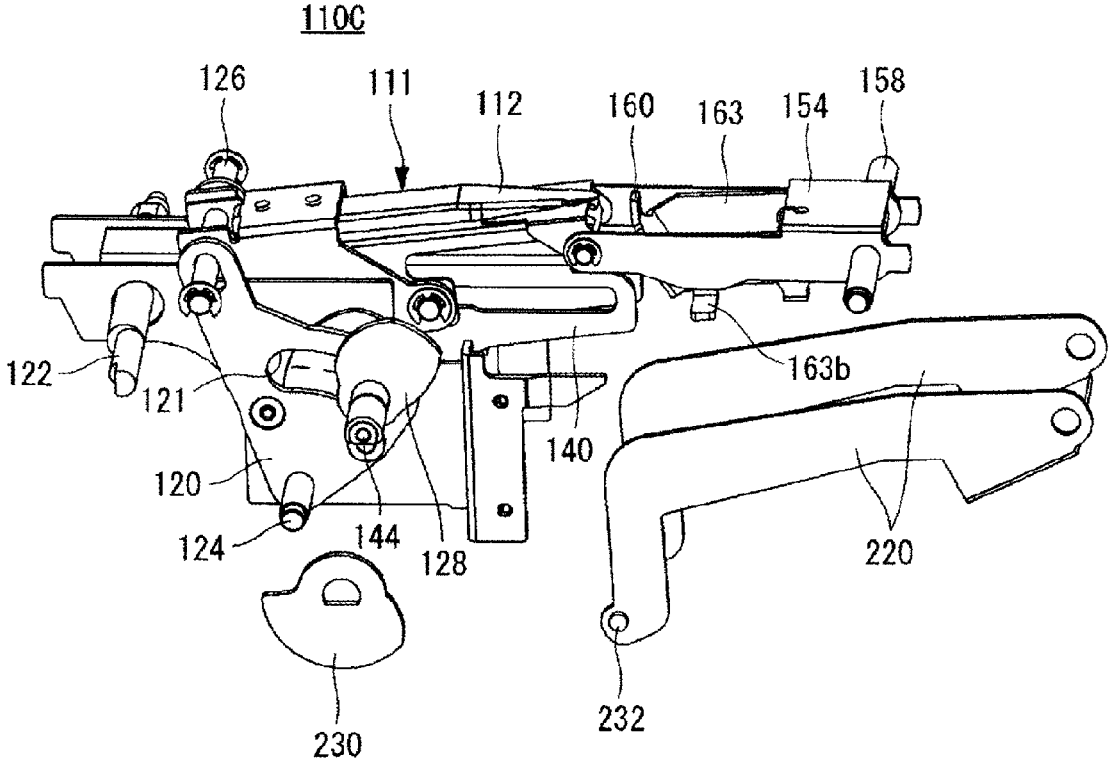
FIG. 19A shows a state of a staple pulling mechanism portion according to a second modification of the first embodiment before a staple stopper link cam and the like are mounted.
Figure 19B:
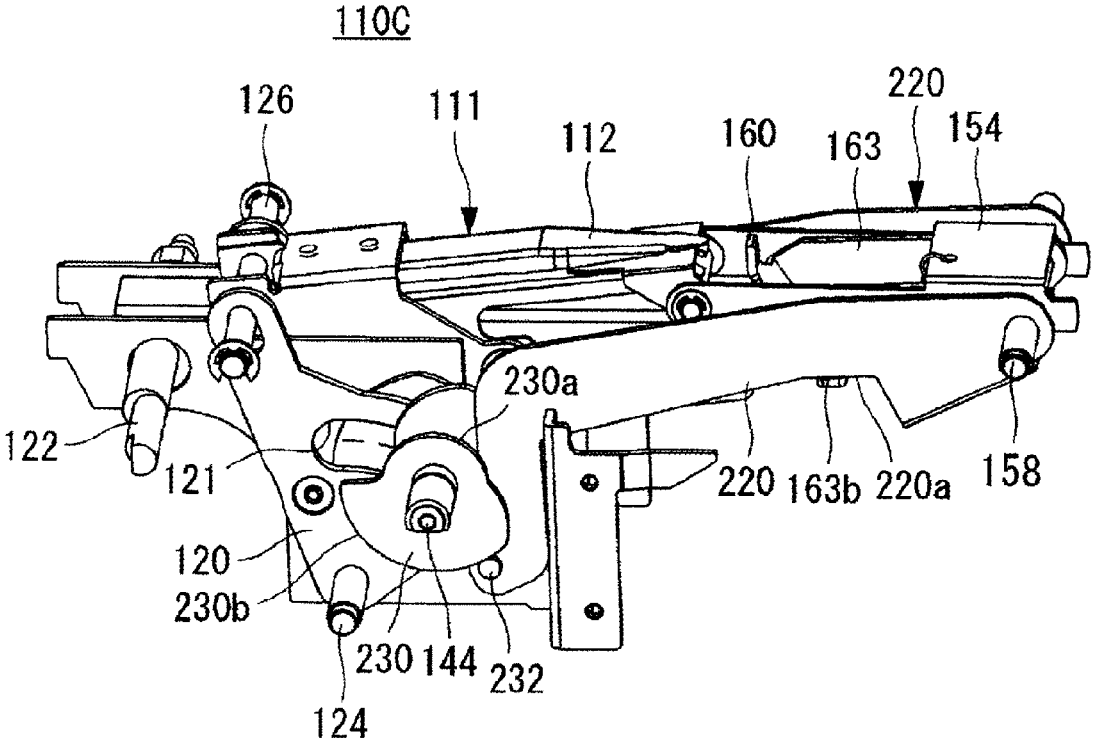
FIG. 19B shows a state of the staple pulling mechanism portion according to the second modification of the first embodiment after the staple stopper link cam and the like are mounted.

FIG. 19A shows a state of the staple pulling mechanism portion 110C according to the second modification before the staple stopper link cam 230 and the like are mounted. FIG. 19B shows a state of the staple pulling mechanism portion 110C according to the second modification after the staple stopper link cam 230 and the like are mounted.

The staple pulling mechanism portion 110C includes a staple stopper link 220, the staple stopper link cam 230, and a staple stopper link cam follower 232.

The staple stopper link 220 is formed of a pair of flat plate members each having a substantially L-shaped side surface, and is arranged outside the pull-down link 140 and the ejector lever 154, respectively. The shaft 158 is attached to a rear end portion of the staple stopper link 220. The staple stopper link 220 is configured to be rotatable about the shaft 158 which serves as a fulcrum. A lower end edge 220*a* of the staple stopper link 220 is provided to be capable of being abutted against the rib portion 163*b* protruding outward from the lower end portion of the support member 163 of the staple pressing mechanism 160.

The staple stopper link cam 230 is attached to the drive shaft 144 on an outer side of the staple stopper link 220. As shown in FIG. 19B, the staple stopper link cam 230 includes a first cam portion 230*a* whose distance from a cam axis thereof is the first distance, and a second cam portion 230*b* whose distance from the axis is the second distance longer than the first distance. The staple stopper link cam follower 232 is attached to an outer surface of a front end portion of the staple stopper link 220 and is provided to be capable of being abutted against the staple stopper link cam 230.

[Operation Example of Staple Pulling Mechanism Portion 110C]

Figure 20A:
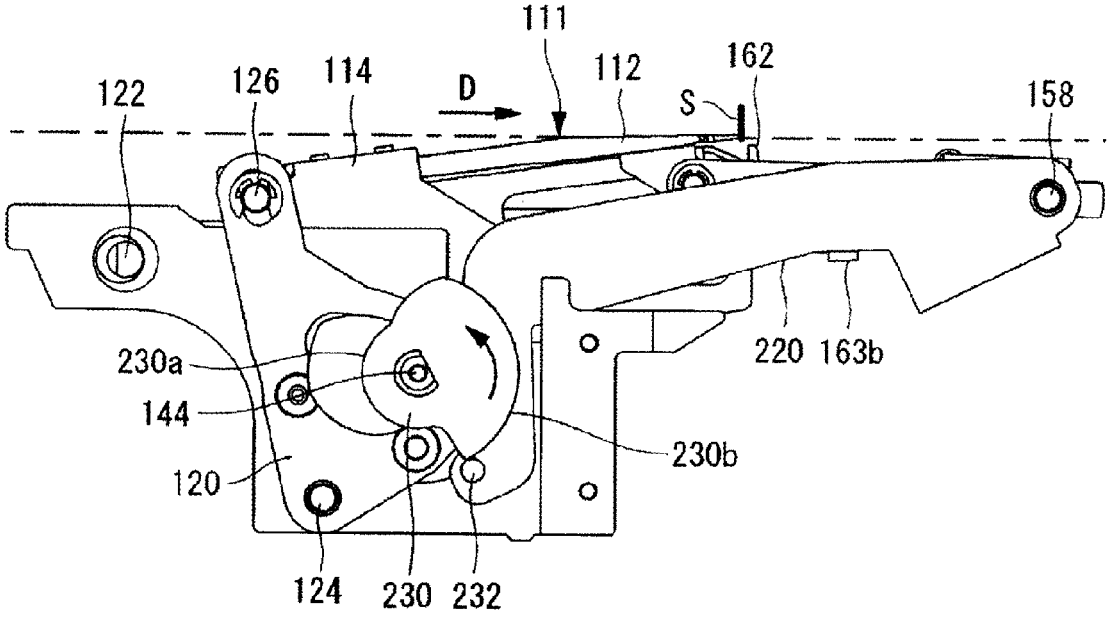
FIG. 20A shows an operation of the staple pulling mechanism portion according to the second modification of the first embodiment.
Figure 20B:
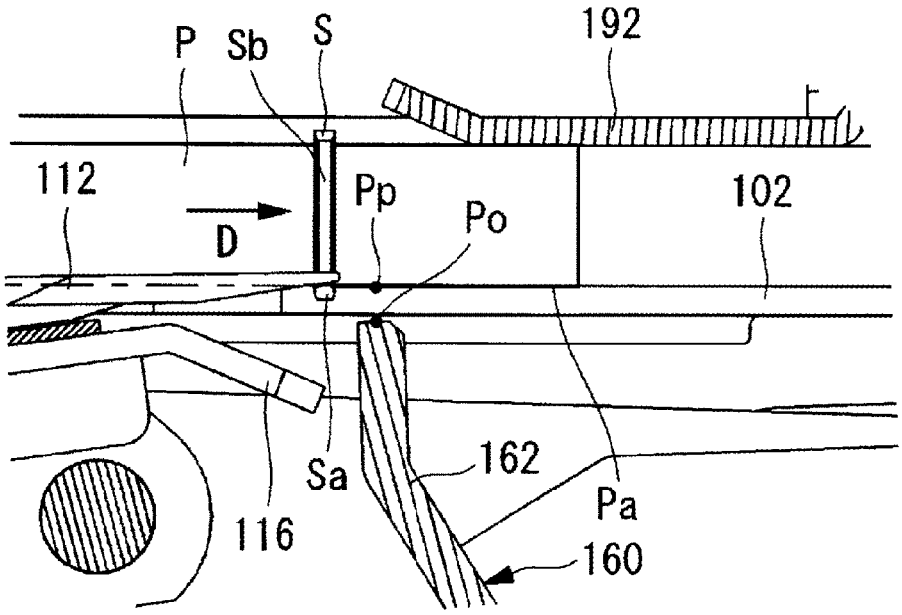
FIG. 20B is a main part enlarged view of a wedge plate, a crown portion, and a staple pressing portion during staple removal according to the second modification of the first embodiment.
Figure 21A:
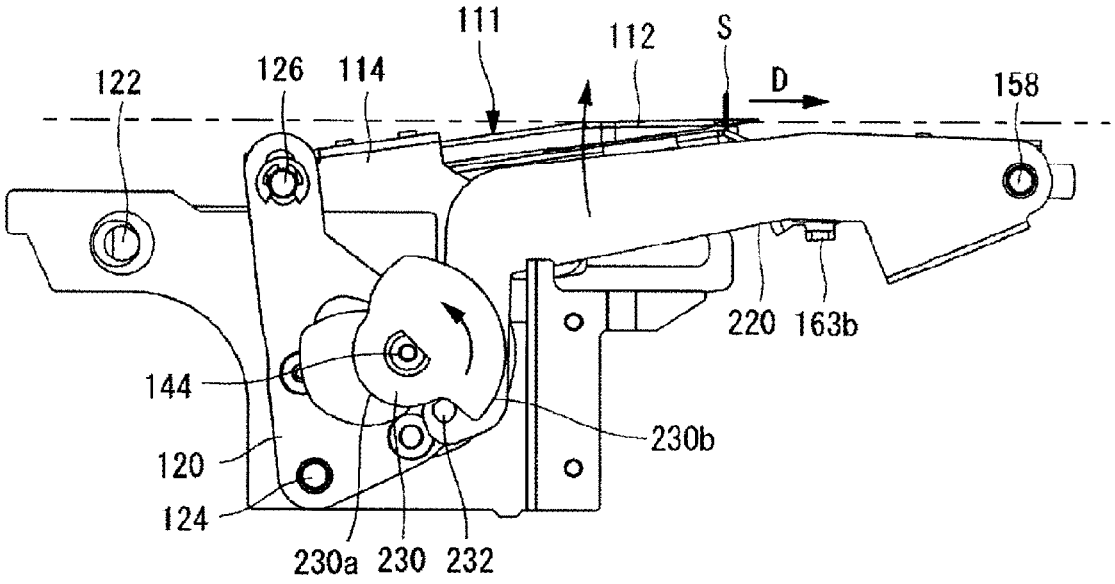
FIG. 21A shows an operation of the staple pulling mechanism portion according to the second modification of the first embodiment.
Figure 21B:
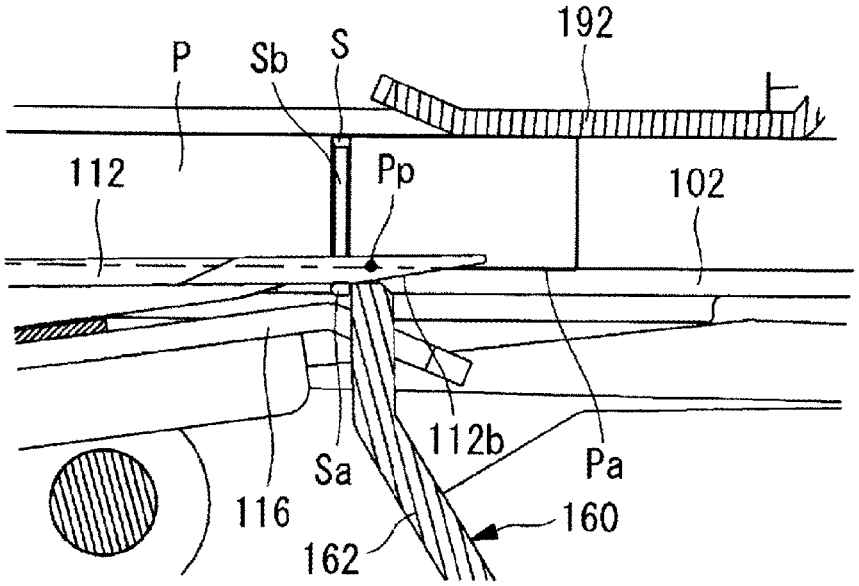
FIG. 21B is a main part enlarged view of the wedge plate, the crown portion, and the staple pressing portion during the staple removal according to the second modification of the first embodiment.

FIGS. 20A and 21A show an example of an operation of the staple pulling mechanism portion 110C according to the second modification. FIGS. 20B and 21B are main part enlarged views of the wedge plate 112, the crown portion Sa, and the staple pressing portion 162 during staple removal according to the second modification.

As shown in FIG. 20A, when the wedge plate 112 is moved forward, the staple stopper link cam 230 is also rotated counterclockwise due to rotation of the drive shaft 144. The second cam portion 230*b* of the staple stopper link cam 230 is abutted against the staple stopper link cam follower 232 until the wedge plate 112 passes the staple pressing portion 162 of the staple pressing mechanism 160. Therefore, the staple stopper link cam follower 232 and the staple stopper link 220 are biased downward by the staple stopper link cam 230, and the rib portion 163*b* of the support member 163 is also biased downward by the staple stopper link 220. As a result, as shown in FIG. 20B, a position of the staple pressing portion 162 is also lowered, and the staple pressing portion 162 stands by at the second position Po at which the staple pressing portion 162 does not collide with the wedge plate 112.

Subsequently, as shown in FIGS. 21A and 21B, when the wedge plate 112 is inserted between the first paper surface Pa of the paper bundle P and the crown portion Sa and then the wedge plate 112 passes above the staple pressing portion 162 and reaches the first position Pp, the first cam portion 230*a* of the staple stopper link cam 230 is abutted against the staple stopper link cam follower 232 due to rotation of the staple stopper link cam 230. Accordingly, the staple stopper link 220 is lifted upward, and holding of the rib portion 163*b* provided by the staple stopper link 220 is released. Therefore, as shown in FIG. 21B, when the staple pressing portion 162 is returned an initial position thereof (moved upward) by an elastic force of the tension spring 164, the abutment portion 162*b* of the staple pressing portion 162 is abutted against the second surface 112*b* of the wedge plate 112 and the crown portion Sa.

As described above, according to the second modification, at timing when the wedge plate 112 passes between the paper bundle P and the staple pressing portion 162, the staple pressing portion 162 is abutted against the crown portion Sa and the second surface 112*b* of the wedge plate 112, so that the wedge plate 112 can be prevented from colliding with the staple pressing portion 162 while the staple pressing portion 162 can be reliably abutted against the crown portion Sa regardless of the type of the paper bundle P.

<Third Modification>

In related art, for example, in order to reliably hold the crown portion Sa of the staple S displaced by insertion of the wedge plate 112, the staple pressing portion 162 may be provided at a position higher than a normal position. However, depending on the type of the paper bundle P from which the staple is removed, the tip end portion of the wedge plate 112 may collide with the staple pressing portion 162. Therefore, a staple pressing mechanism 260 adopts a mechanism that prevents the tip end portion of the wedge plate 112, which is moved forward, from colliding with the staple pressing portion 162. Description of parts common to the paper pressing mechanism 160 will be omitted or simplified.

[Configuration Example of Paper Pressing Mechanism 260]

Figure 22:
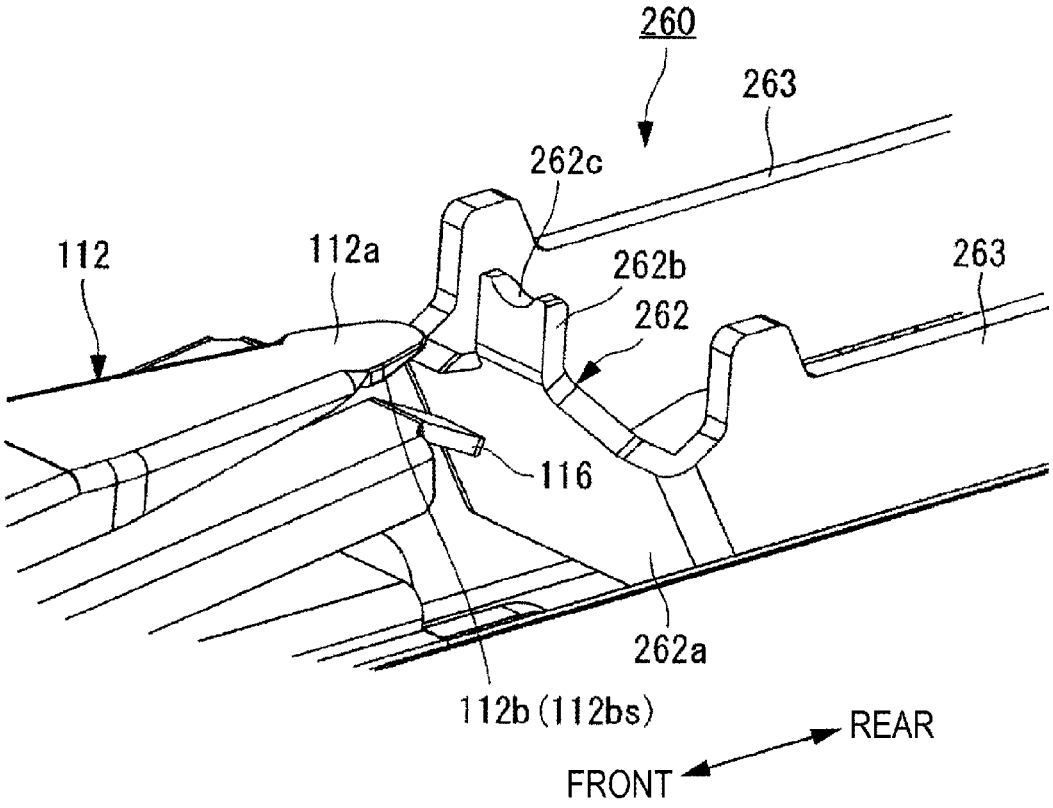
FIG. 22 is a perspective view of a staple pressing mechanism according to a third modification of the first embodiment.

FIG. 22 is a perspective view of the staple pressing mechanism 260. A staple pressing portion 262 constituting the staple pressing mechanism 260 includes a body 262*a* and an abutment portion 262*b* which is continuous with the body 262*a* and protrudes upward from an upper end central portion of the body 262*a*. An upper end portion of the abutment portion 262*b* is formed with a recessed portion 262*c* which is cut out downward from an upper surface portion thereof. The recessed portion 262*c* functions as a relief portion configured to avoiding collision with the wedge plate 112 which is moved forward. The recessed portion 262*c* may have any shape as long as collision of the wedge plate 112 is avoided. For example, it is preferable that the shape of the recessed portion is formed along an outer edge of the wedge plate 112. As described above, according to the staple pressing mechanism 260, the wedge plate 112 can be moved forward without colliding with the staple pressing portion 262 due to the recessed portion 262*c*.

<Fourth Modification>

In related art, during staple removal, the staple S may be detached from the staple pressing portion 162 when the crown portion Sa of the staple S, which is once abutted against the staple pressing portion 162, slides. Therefore, a staple pressing mechanism 360 adopts a mechanism that prevents the crown portion Sa from detaching from the staple pressing portion 162. Description of parts common to the staple pressing mechanism 160 will be omitted or simplified.

[Configuration Example of Paper Pressing Mechanism 360]

Figure 23:
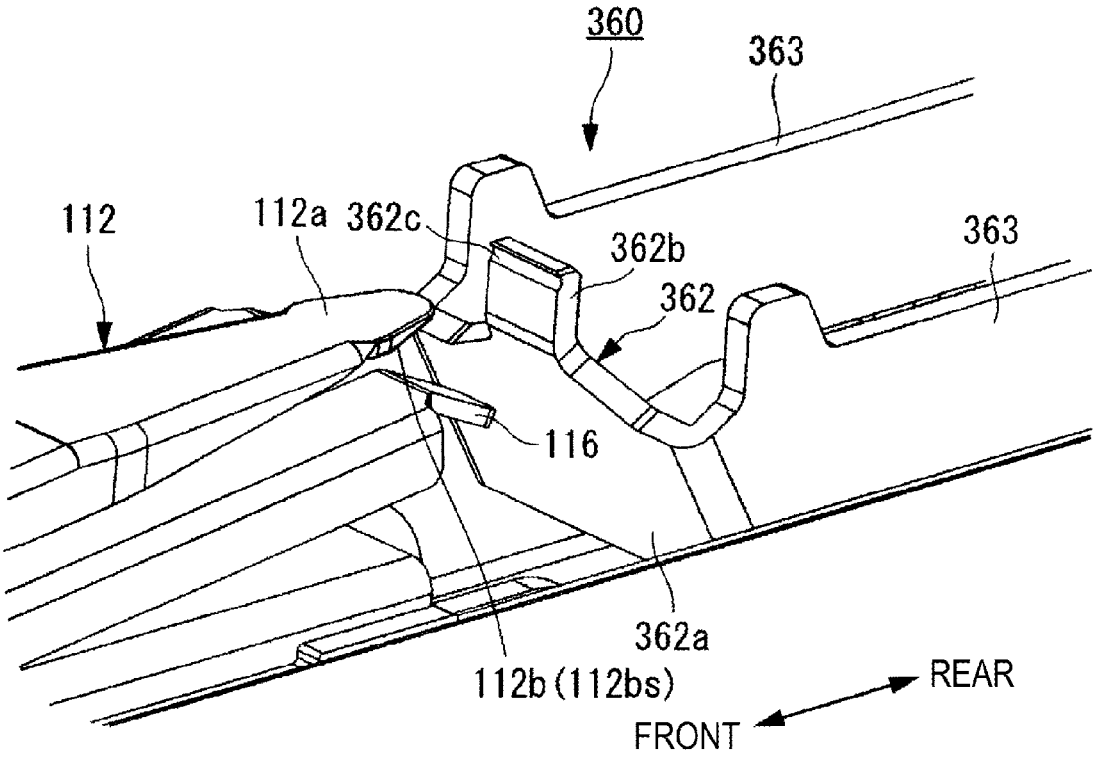
FIG. 23 is a perspective view of a staple pressing mechanism according to a fourth modification of the first embodiment.

FIG. 23 is a perspective view of the staple pressing mechanism 360. A staple pressing portion 362 constituting the staple pressing mechanism 360 includes a body 362*a* and an abutment portion 362*b* which is continuous with the body 362*a* and protrudes upward from an upper end central portion of the body 362*a*. A groove portion 362*c* which extends in the left-right direction is formed in a surface which faces the wedge plate 112 (front surface) of an upper end portion of the abutment portion 362*b*. A shape of the groove portion 362*c* may be any shape as long as the crown portion Sa can enter and be held therein. As described above, according to the staple pressing mechanism 360, since the crown portion Sa can be held by the groove portion 362*c* during staple removal, the staple S can be prevented from escaping and detaching from the staple pressing portion 362.

<Fifth Modification>

In related art, for example, the crown portion Sa of the staple S may be deformed by the pushing force of the wedge plate 112 so as to warp in the insertion direction D during staple removal. In this case, the crown portion Sa may not be reliably held by a flat surface of the staple pressing portion 162 due to the deformation of the crown portion Sa. Therefore, a staple pressing mechanism 460 adopts a mechanism that reliably holds the deformed crown portion Sa. Description of parts common to the paper pressing mechanism 160 will be omitted or simplified.

[Configuration Example of Paper Pressing Mechanism 460]

Figure 24:
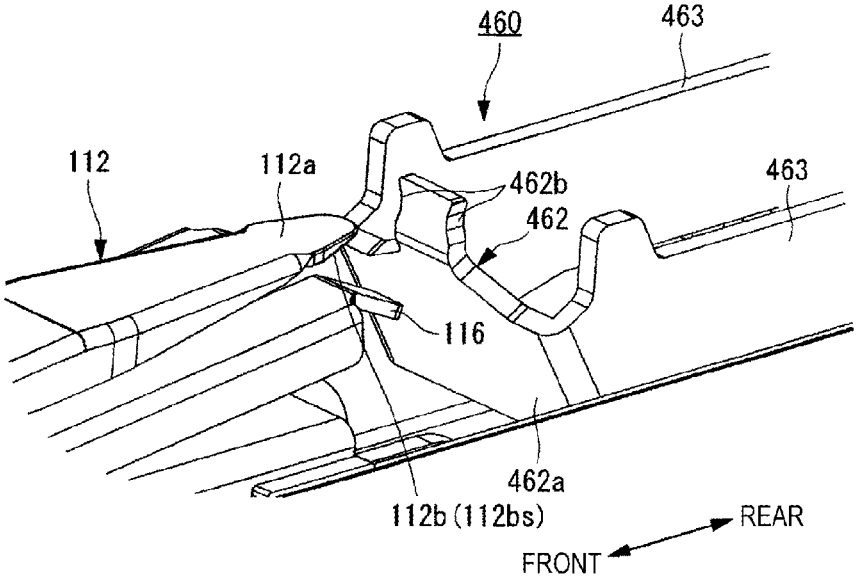
FIG. 24 is a perspective view of a staple pressing mechanism according to a fifth modification of the first embodiment.

FIG. 24 is a perspective view of the staple pressing mechanism 460. A staple pressing portion 462 constituting the staple pressing mechanism 460 includes a body 462*a* and an abutment portion 462*b* which is continuous with the body 462*a* and protrudes upward from an upper end central portion of the body 462*a*. The abutment portion 462*b* is configured such that a width thereof increases toward a tip end portion thereof. As described above, according to the staple pressing mechanism 460, the deformed crown portion Sa can be caught and held by an inclined side surface portion of the abutment portion 462*b*, and thus the staple S can be prevented from escaping and detaching from the staple pressing portion 462.

<Sixth Modification>

In related art, for example, there are cases where one of the leg portions Sb, Sb of the staple S is not removed from the paper bundle P due to a side slip of the staple S caused by deviation of the pushing force of the wedge plate 112 during staple removal, the type of the paper bundle P, or the like. Therefore, a staple pressing mechanism 560 adopts a mechanism capable of reliably pulling out the leg portions Sb, Sb of the staple S from the paper bundle P. Description of parts common to the paper pressing mechanism 160 will be omitted or simplified.

[Configuration Example of Paper Pressing Mechanism 560]

Figure 25:
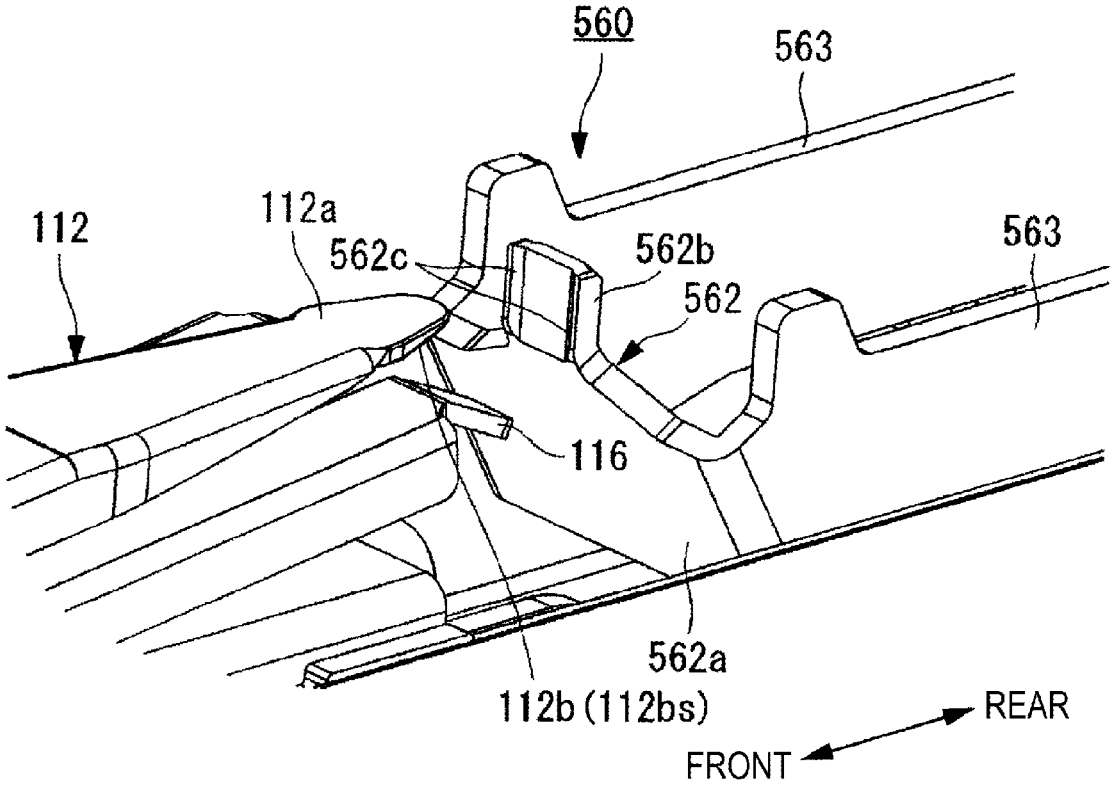
FIG. 25 is a perspective view of a staple pressing mechanism according to a sixth modification of the first embodiment.

FIG. 25 is a perspective view of the staple pressing mechanism 560. A staple pressing portion 562 constituting the staple pressing mechanism 560 includes a body 562*a* and an abutment portion 562*b* which is continuous with the body 562*a* and protrudes upward from an upper end central portion of the body 562*a*. Protruding portions 562*c*, 562*c* which protrudes at an acute angle toward the wedge plate 112 are formed on two left-right direction edge portions of a front surface side of the abutment portion 562*b*. Each of the protruding portions 562*c*, 562*c* is linearly formed in a direction in which each of the protruding portions 562*c*, 562*c* is abutted against and separated from the first paper surface Pa of the paper bundle P. The protruding portions 562*c*, 562*c* are not limited to be formed along the two edge portions of the abutment portion 562*b*. Each of the protruding portions 562*c* may be formed in, for example, a conical shape or a prismatic shape, and one or a plurality of the protruding portions 562*c* may be arranged on each of the two edge portions of the abutment portion 562*b*. As described above, according to the staple pressing mechanism 560, since the crown portion Sa of the staple S is abutted against the protruding portions 562*c*, 562*c* during staple removal, the side slip of the crown portion Sa can be prevented, and both of the leg portions Sb, Sb can be reliably pulled out from the paper bundle P.

<Seventh Modification>

Figure 26:
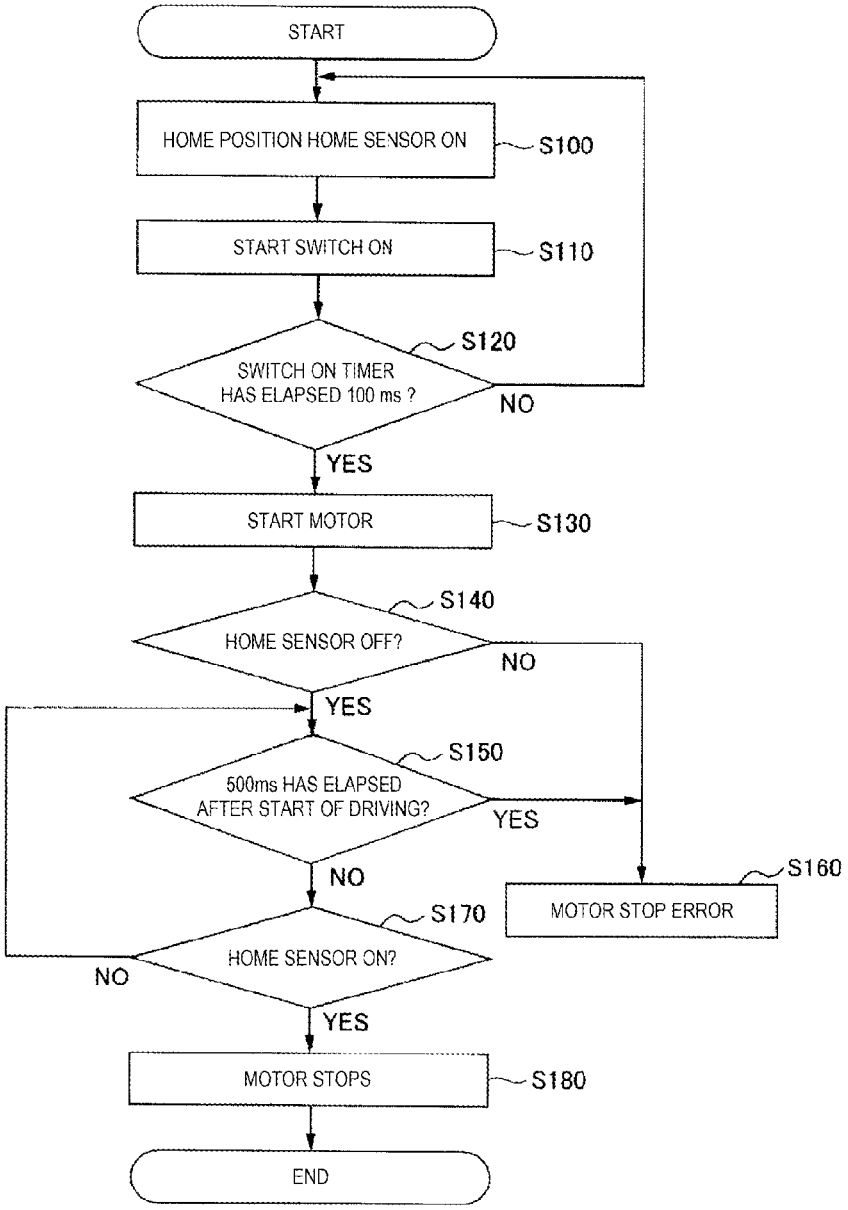
FIG. 26 is a flowchart showing a first operation during staple removal of a staple removal device according to a seventh modification of the first embodiment.

FIG. 26 is a flowchart showing a first operation during staple removal of the staple removal device 100 according to a seventh modification. An algorithm shown in FIG. 26 is implemented by executing a program stored in a storage unit including a memory by a control unit including a central processing portion (CPU) provided in the staple removal device 100.

In step S100, when the moving portion 111 is located at the home position while a home sensor is on, the process proceeds to step S110. The home sensor detects, for example, whether the moving portion 111 is on standby at the home position.

In step S110, when the start switch 108 is turned on by the user, the process proceeds to step S120.

In step S120, a switch-on timer determines whether 100 ms has elapsed. When 100 ms has not elapsed in the state where the switch is on, the process returns to step S100, and the counting of the timer is continued. On the other hand, when 100 ms has elapsed in the state where the switch is on, the process proceeds to step S130.

In step S130, when the start switch 108 is on for a certain period of time, the motor 206 is driven to rotate in a forward direction, and the process proceeds to step S140.

In step S140, it is determined whether the home sensor is off. When the home sensor is on, the process proceeds to step S160. In step S160, since there is possibility that the moving portion 111 is not operating due to a failure of the motor 206 or the like, motor stop error processing is performed. On the other hand, when the home sensor is off, the process proceeds to step S150.

In step S150, it is determined whether 500 ms has elapsed after the driving of the motor 206 is started. For example, in a case where 500 ms has elapsed after the driving of the motor 206 is started in a state where the home sensor is off, the process proceeds to step S160, and the motor stop error processing is performed. On the other hand, if 500 ms has not elapsed, the process proceeds to step S170.

In step S170, it is determined whether the home sensor is on. When the home sensor is off, the process returns to step S150. On the other hand, when the home sensor is on, the process proceeds to step S180.

In step S180, the motor 206 is stopped to stop a staple removal operation. According to the staple removal device 100 according to the present embodiment, the above-described operation is repeatedly executed.

According to such control, since the staple removal device 100 is not operated unless the start switch 108 is continuously on for a certain period of time, the staple removal device 100 can be prevented from being unintentionally started even when the user erroneously touches the start switch 108 or an object is erroneously abutted against the start switch 108. Even when chattering occurs in the start switch 108, the staple removal device 100 can be prevented from being started.

<Eighth Modification>

Figure 27:
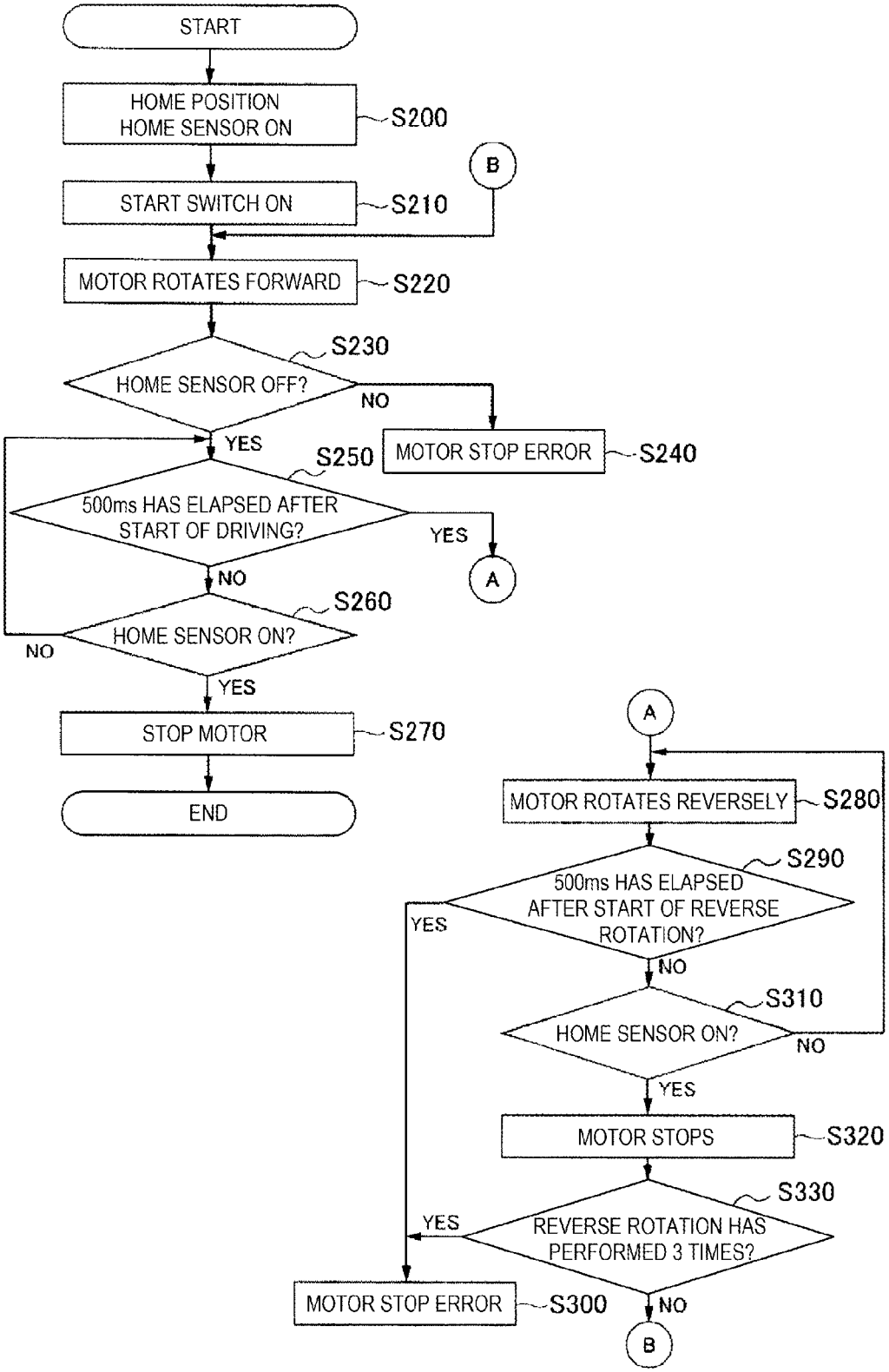
FIG. 27 is a flowchart showing a second operation during staple removal of a staple removal device according to an eighth modification of the first embodiment.

FIG. 27 is a flowchart showing a second operation during the staple removal of the staple removal device 100 according to an eighth modification. An algorithm shown in FIG. 27 is implemented by executing a program stored in a storage unit including a memory by a control unit including a CPU provided in the staple removal device 100. Since processes of steps S200 to S270 are substantially the same as the steps S100 to S180 shown in FIG. 26, detailed description thereof will be omitted.

In step S200, when the wedge plate 112 and the like are at the home position while the home sensor is on, the process proceeds to step S210.

In step S210, when the start switch 108 is turned on by the user, the process proceeds to step S220.

In step S220, the motor 206 is driven to rotate in the forward direction, and the process proceeds to step S230.

In step S230, it is determined whether the home sensor is off. When the home sensor is on, the process proceeds to step S240, and the motor stop error processing is performed. On the other hand, when the home sensor is off, the process proceeds to step S250.

In step S250, it is determined whether 500 ms has elapsed after the driving of the motor 206 is started. When 500 ms has not elapsed after the driving of the motor 206 is started, the process proceeds to step S260.

In step S260, it is determined whether the home sensor is on. When the home sensor is off, the process returns to step S250. On the other hand, when the home sensor is on, the process proceeds to step S270.

In step S270, the motor 206 is stopped to stop the staple removing operation.

On the other hand, in step S250, when 500 ms has elapsed after the driving of the motor 206 is started in the state where the home sensor is off, the process proceeds to step S280 in which retry control is performed. For example, there is a case where the wedge plate 112 is stopped at a position where the wedge plate 112 has moved forward.

In step S280, the motor 206 is driven to rotate in a reverse direction.

In step S290, it is determined whether 500 ms has elapsed after the reverse rotation of the motor 206 is started. For example, in a case where 500 ms has elapsed after the reverse rotation of the motor 206 is started in the state where the home sensor is off, the process proceeds to step S300, and the motor stop error processing is performed. On the other hand, when 500 ms has not elapsed after the reverse rotation of the motor 206 is started, the process proceeds to step S310.

In step S310, it is determined whether the home sensor is on. When the home sensor is off, the process returns to step S280. On the other hand, when the home sensor is on, the process proceeds to step S320.

In step S320, it is determined that the moving portion 111 has returned to the home position by the retry control, the driving of the motor 206 is stopped, and the process proceeds to step S330.

In step S330, it is determined whether the reverse rotation driving of the motor 206 has been performed three times. The process proceeds to step S300 to perform the motor stop error processing if the reverse rotation driving has been performed three times. On the other hand, when the reverse rotation driving of the motor 206 is not performed three times, the process returns to step S220, and the staple removing operation is performed again by rotating the motor 206 forward. An upper limit of the number of times of execution of the retry control can be set as desired by the user.

According to the staple removal device 100 according to the present embodiment, the above-described operation is repeatedly executed. According to such control, when a problem occurs in the moving portion 111, the retry control is performed a plurality of times and the staple removing operation is restarted. As a result, for example, the staple S can be reliably removed from the paper bundle P even when the paper bundle P is bound by a hard staple S.

<Ninth Modification>

Figure 28:
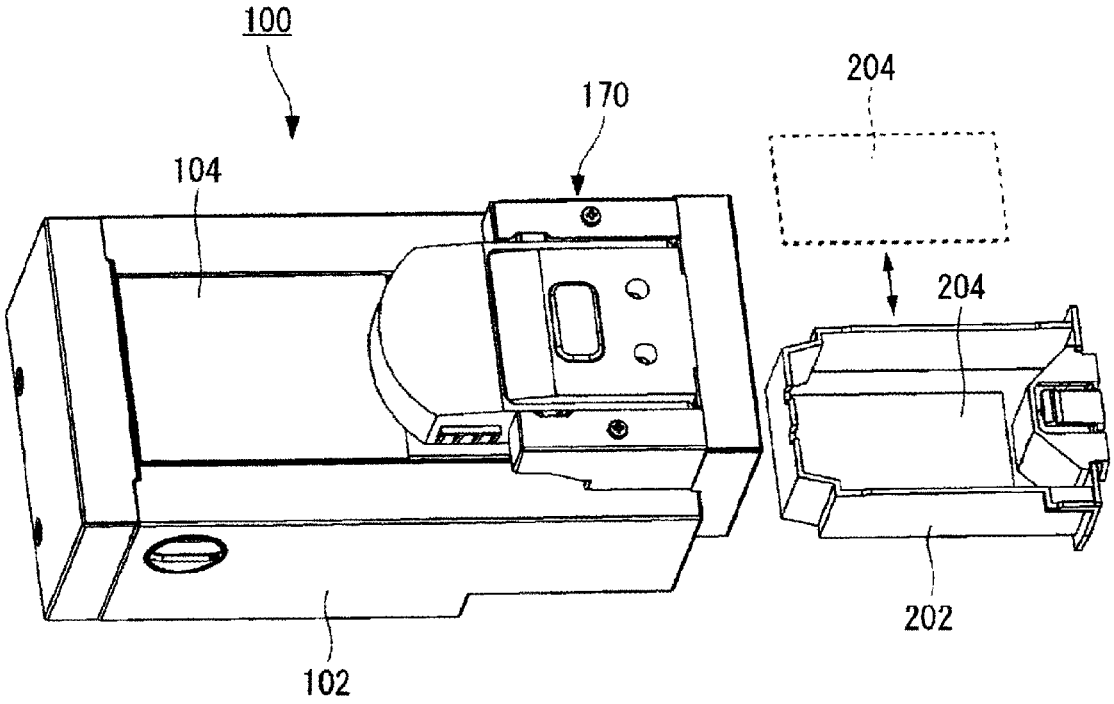
FIG. 28 is a perspective view of a staple removal device and a dust box attachable to and detachable from the staple removal device according to a ninth modification of the first embodiment.

FIG. 28 is a perspective view of the staple removal device 100 and the dust box 202 attachable to and detachable from the staple removal device 100 according to a ninth modification.

A magnet 204 is attached to a bottom surface in the dust box 202 to prevent staple dust dropped into the dust box 202 from scattering. The magnet 204 has a size that covers substantially the entire bottom surface of the dust box 202, for example, and is configured to be replaceable.

As a result, even when the dust box 202 is inclined during transportation or installation of the staple removal device 100, since the staple S can be attracted by a magnetic force of the magnet 204, the staple dust can be prevented from being scattered around.

<Tenth Modification>

Figure 29:
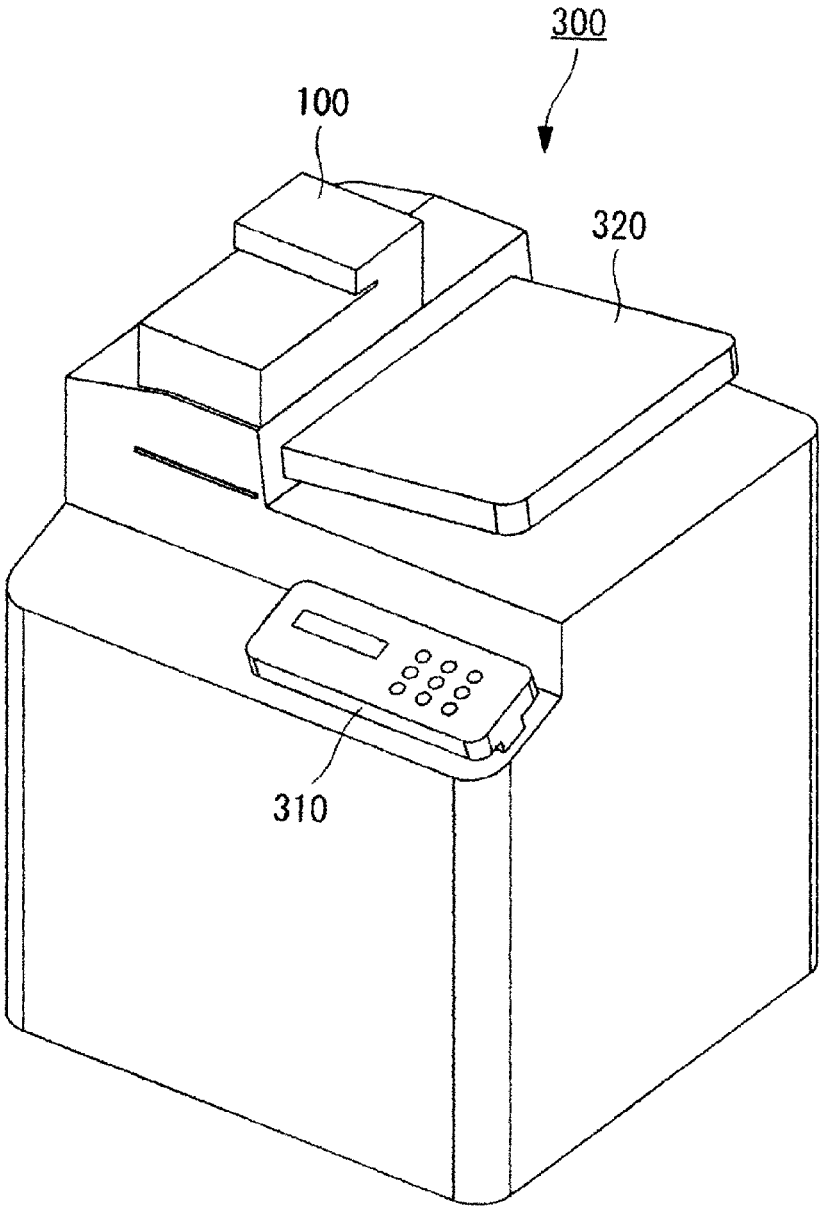
FIG. 29 is a perspective view of an image forming device in which a staple removal device according to a tenth modification of the first embodiment is mounted on an auto document feeder.

FIG. 29 is a perspective view of an image forming device 300 in which the staple removal device 100 according to a tenth modification is mounted on an auto document feeder (ADF) 320.

The image forming device 300 is an electrophotography type image forming device, which includes the auto document feeder 320 configured to feed pieces of paper set on a tray one by one to a reading unit. The auto document feeder 320 is attached to an upper portion of the image forming device 300. In the present embodiment, the auto document feeder 320 is equipped with the staple removal device 100. The image forming device 300 also includes an operation panel 310 on a front surface of a body thereof. The operation panel 310 includes a plurality of operation buttons and a display that displays a menu screen and the like.

As described above, according to the image forming device 300 shown in FIG. 29, since the staple removal device 100 is mounted on the auto document feeder 320, for example, even when the staple S is pulled out from the paper bundle P bound by the staple S and each piece of paper is copied or scanned, operations such as staple removal, copying, and scanning can be performed in a series of flows.

<Eleventh Modification>

Figure 30:
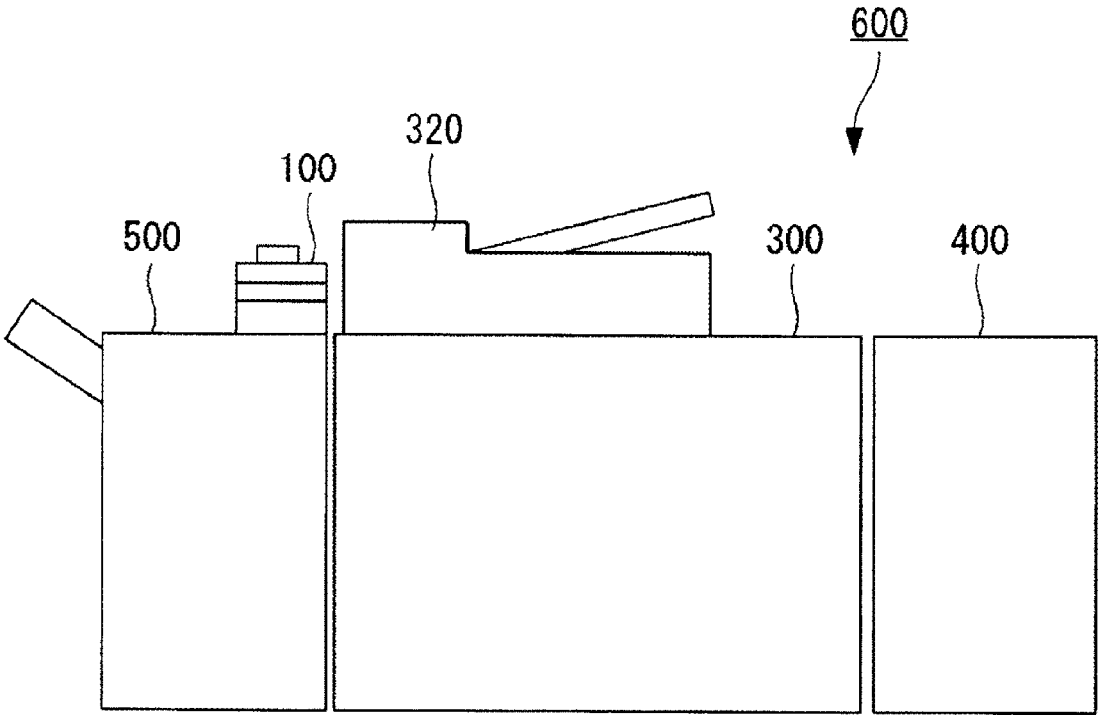
FIG. 30 is a configuration diagram of an image forming system in which a staple removal device according to an eleventh modification of the first embodiment is mounted on a post-processing device.

FIG. 30 is a configuration diagram of an image forming system 600 in which the staple removal device 100 according to an eleventh modification is mounted on a post-processing device 500.

The image forming system 600 includes a large-capacity paper feeding device 400 which includes a plurality of paper feeding trays, the image forming device 300 which is arranged downstream of the large-capacity paper feeding device 400 and configured to form an image on paper, and the post-processing device 500 which is arranged downstream of the image forming device 300 and configured to perform post-processing such as binding processing. In the present embodiment, the staple removal device 100 is mounted on an upper surface portion of the post-processing device 500 at a position adjacent to the auto document feeder 320 of the image forming device 300. The staple removal device 100 may also be incorporated in the post-processing device 500.

As described above, according to the image forming system 600 shown in FIG. 30, since the staple removal device 100 is mounted on the post-processing device 500, for example, even when the staple S is pulled out from the paper bundle P bound by the staple S and each piece of paper is copied or scanned, operations such as staple removal, copying, and scanning can be performed in a series of flows.

<Twelfth Modification>

Figure 31:
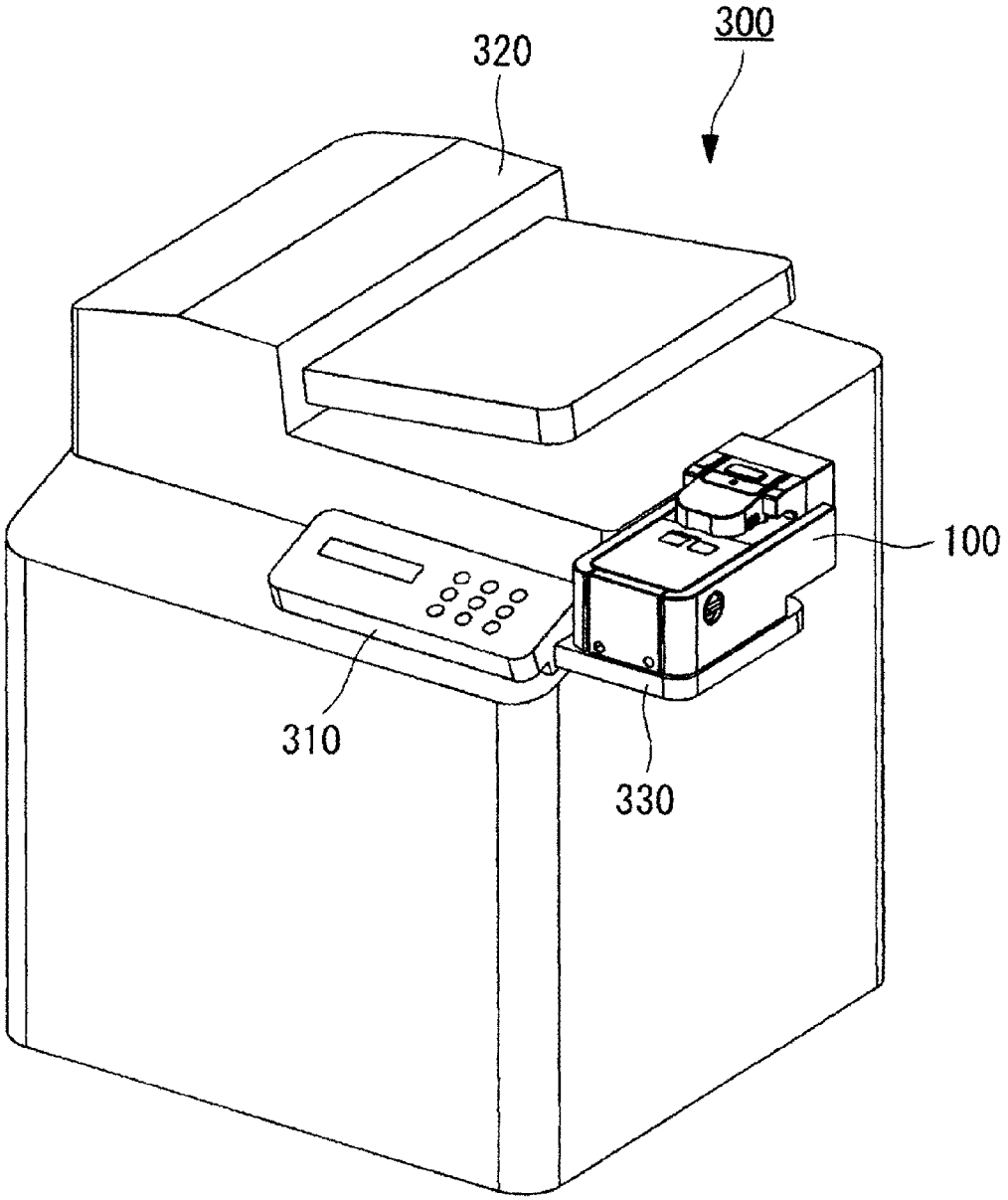
FIG. 31 is a perspective view of an image forming device equipped with a detachable staple removal device according to a twelfth modification of the first embodiment.

FIG. 31 is a perspective view of the image forming device 300 on which the detachable staple removal device 100 according to a twelfth modification is mounted.

The image forming device 300 is provided with a mounting table 330 on which the staple removal device 100 is mounted. The mounting table 330 is formed of, for example, a plate-shaped member protruding outward from an upper portion of a side surface of a device body, and is provided in the vicinity of the auto document feeder 320. The staple removal device 100 is configured to be attachable to and detachable from the mounting table 330. The staple removal device 100 can be removed from the mounting table 330 and placed on, for example, a desk and used. The staple removal device 100 may be driven by a battery or may be driven by an AC power supply.

<Thirteenth Modification>

Figure 32:
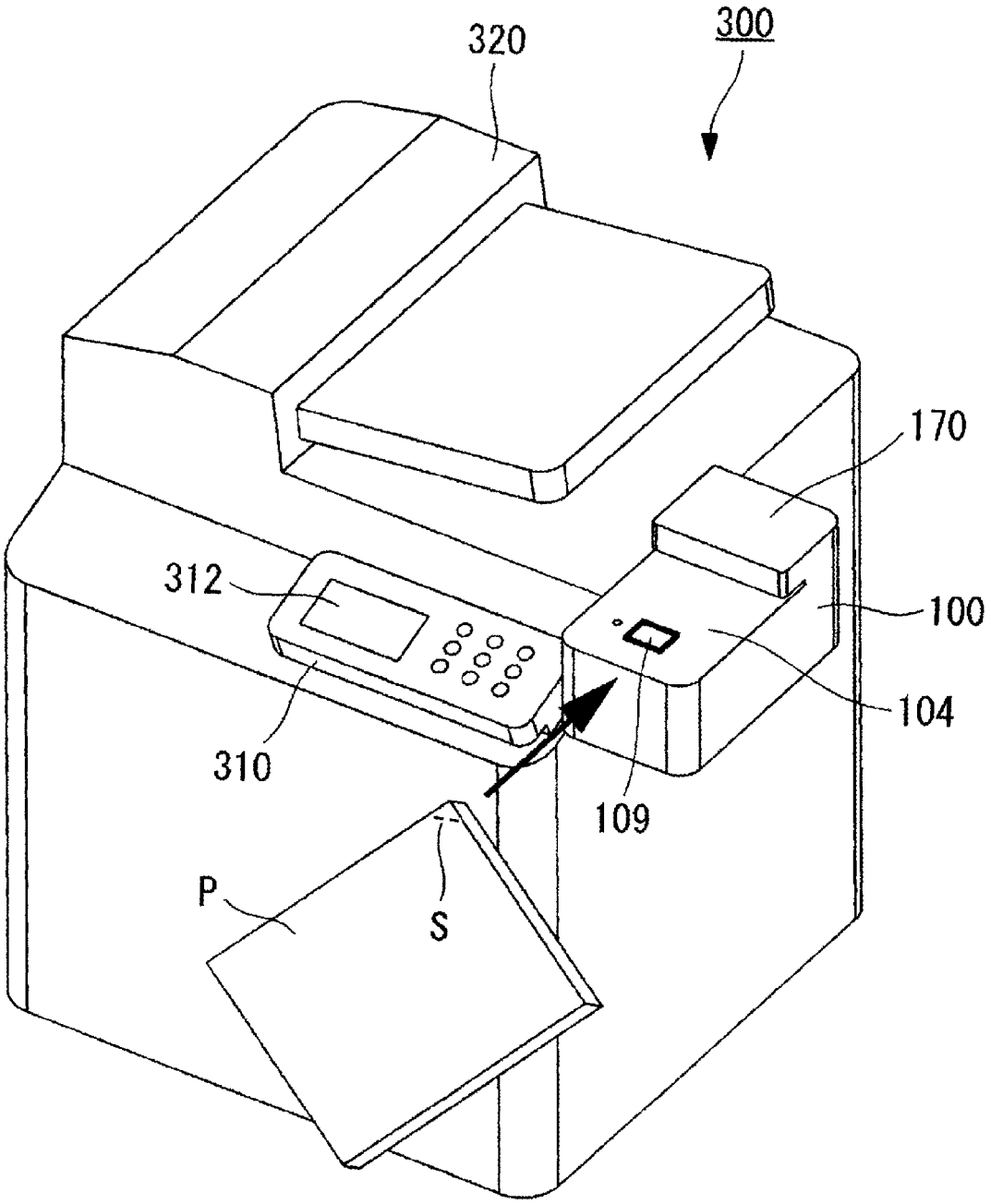
FIG. 32 is a perspective view of an image forming device equipped with a staple removal device having a function of detecting a paper bundle according to a thirteenth modification of the first embodiment.

FIG. 32 is a perspective view of the image forming device 300 on which the staple removal device 100 having a function of detecting the paper bundle P according to a thirteenth modification is mounted.

The staple removal device 100 includes a sensor 109 that detects the paper bundle P approaching or placed on the placement table 104. The staple removal device 100 is set to a power saving mode until the paper bundle P is detected by the sensor 109, that is, set to a power saving mode in a standby state, and starts (wakes up) the staple removal device 100 or the image forming device 300 when the paper bundle P is detected by the sensor 109.

In the staple removal device 100 shown in FIG. 32 and the like, a light emitting portion such as an LED may be provided. The light emitting portion is preferably provided on an upper surface portion of the paper pressing mechanism portion 170, for example, such that the user can easily see the light emitting portion. By turning on or blinking the light emitting portion, the user can be notified that the staple removal device 100 is mounted on the image forming device 300. Means of the notification may also be a voice.

Figure 33:
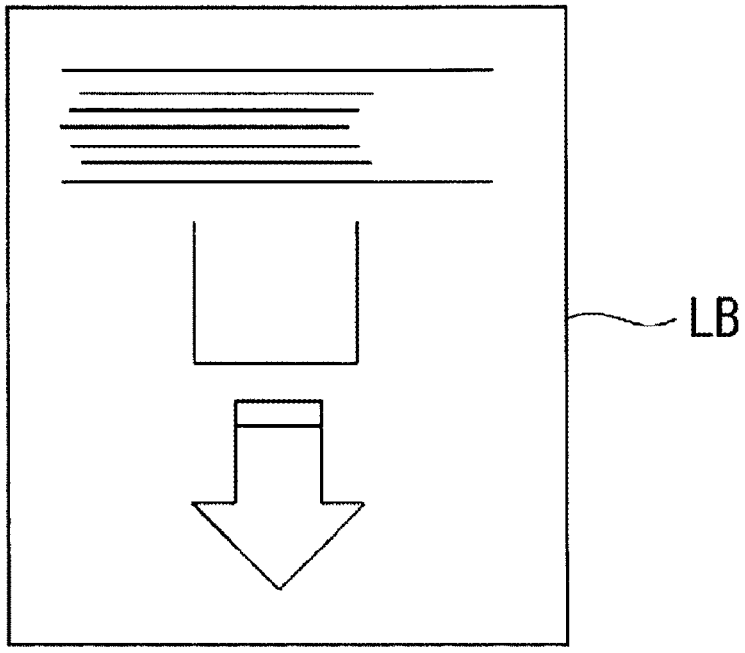
FIG. 33 is a configuration diagram of a label showing a staple removal position according to the first embodiment.

Further, as shown in FIG. 33, a label LB indicating the staple removal position may be attached to the placement table 104 of the staple removal device 100.

In the image forming system 600 shown in FIG. 30 or the image forming device 300 shown in FIG. 32, when the dust box 202 is full of staple dust, a message such as "full of staple dust, please discard staple dust" or "please take out and confirm dust box" may be displayed on a screen of a display portion 312 of the operation panel 310. The following method can be adopted for detection of a full state of the staple dust. For example, a sensor may be provided in the dust box 202, and it may be determined whether the staple dust is full based on a detection result of the sensor. The number of times of staple removing operations may be counted by a control unit, and whether the staple dust is full may be determined based on whether a count value thereof exceeds a threshold value.

When a failure (lock) occurs in the staple removal device 100, a message such as "remover error * has occurred" or "please confirm remover" may be displayed on the screen of the display portion 312 of the operation panel 310**.

Further, an operation button configured to turn on/off the staple removal device 100 may be provided on the operation panel 310 of the image forming device 300 shown in FIG. 32 or the like. The operation button may be a touch button displayed on the screen of the display portion 312 instead of an actual button. As a result, the staple removal device 100 can be started from either the side of the staple removal device 100 or the side of the image forming device 300.

Here, in a staple removal device in related art, when a point of a staple pressing portion that receives a pushing load of a wedge plate is defined as a load acting point, if an axial center of a shaft of a support member that supports the staple pressing portion is arranged above a horizontal line (a virtual line extending in an insertion direction) including the load acting point, a component force of the pushing load of the wedge plate is generated in a direction away from the wedge plate. In this case, the staple pressing portion slips off from a staple and thus the staple cannot always be supported by the staple pressing portion.

In this regard, according to the present embodiment, as shown in FIG. 4A, an axial center O1 of the shaft 158 of the support member 163 supporting the staple pressing portion 162 is arranged below a horizontal line L including a load acting point O2. As a result, a component force of a pushing load of the wedge plate 112 can be generated in a direction in which the staple S is pressed against the wedge plate 112, so that the staple S can be stably supported by the staple pressing portion 162.

Although the present invention has been described with reference to the embodiment, the technical scope of the present invention is not limited to the scope described in the above-described embodiment. Various modifications or improvements can be made to the above-described embodiment without departing from the spirit of the present invention.

Second Embodiment

Hereinafter, examples of staple removal devices 1100A, 1100B, and 1100C according to a second embodiment will be described with reference to the drawings.

Second Embodiment 1

[Overall Configuration Example of Staple Removal Device 1100A]

Figure 34:
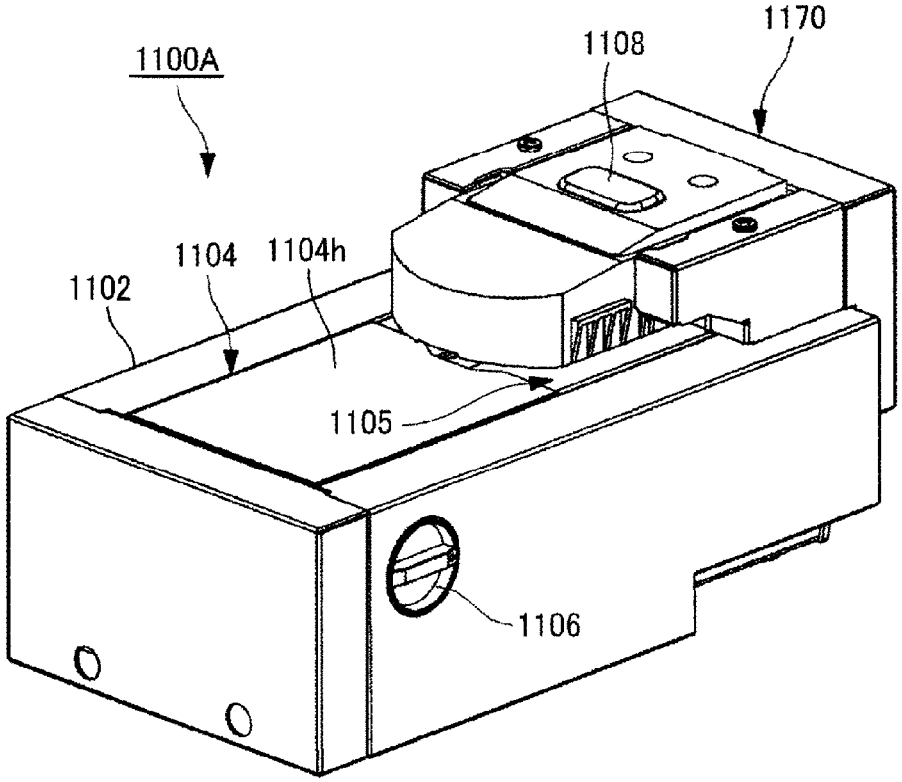
FIG. 34 is a perspective view of a staple removal device according to a second embodiment 1 as viewed obliquely from a front side.
Figure 35:
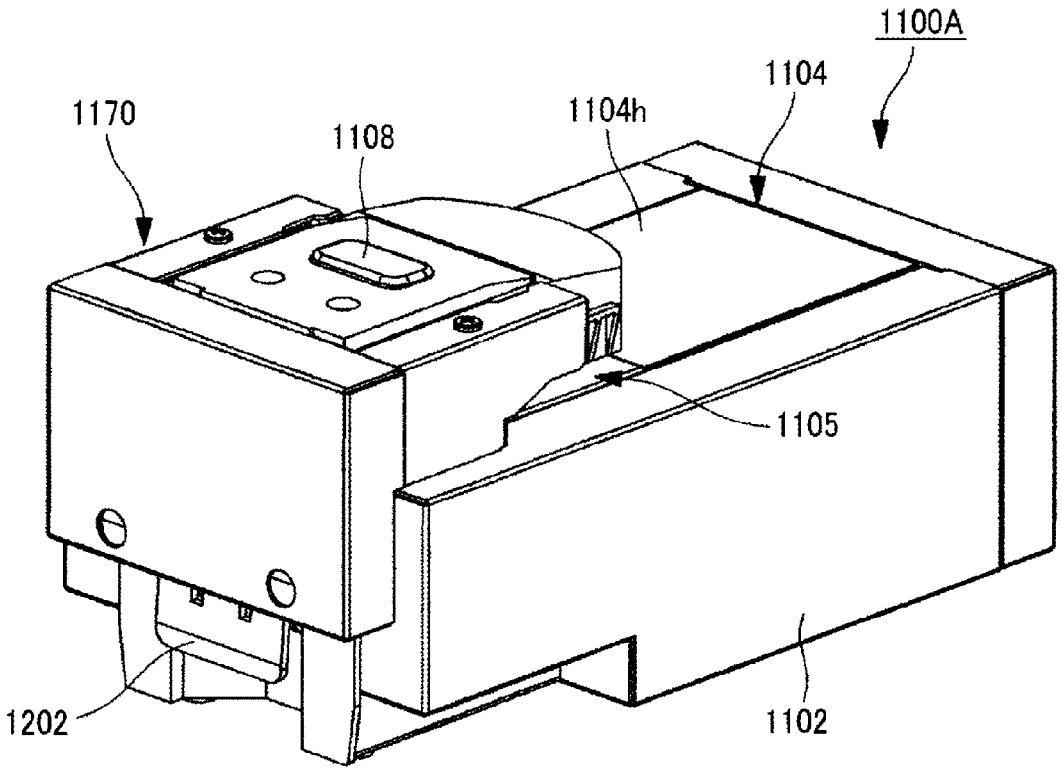
FIG. 35 is a perspective view of the staple removal device according to the second embodiment 1 as viewed obliquely from a rear side.

FIG. 34 is a perspective view of the staple removal device 1100A according to the second embodiment 1 as viewed obliquely from a front side. FIG. 35 is a perspective view of the staple removal device 1100A according to the first embodiment for a second purpose as viewed obliquely from a rear side.

The staple removal device 1100A is a staple stapling device that automatically removes a staple S10 from a paper bundle P10 bound by the staple S10. The staple removal device 1100A includes a housing 1102 which has a substantially rectangular parallelepiped shape, a placement table 1104 which is provided on an upper surface portion of the housing 1102 and includes a placement surface 1104*h* on which the paper bundle P10 can be placed, and a paper pressing mechanism portion 1170 configured to press the paper bundle P10 placed on the placement table 1104. A paper bundle insertion opening 1105 through which the paper bundle P10 is inserted is provided between the placement table 1104 and the paper pressing mechanism portion 1170.

In the present embodiment, a side where the paper pressing mechanism 1170 (a portion exposed from the housing 1102) is provided is referred to as the rear side of the staple removal device 1100A, while an opposite side thereof is referred to as the front side of the staple removal device 1100A. A side where an adjustment knob 1106 to be described later below is provided is referred to as a left side of the staple removal device 1100A, while an opposite side thereof is referred to as a right side of the staple removal device 1100A. A side where the placement table 1104 is provided is referred to as an upper side of the staple removal device 1100A, while an opposite side thereof is referred to as a lower side of the staple removal device 1100A.

A start switch 1108 configured to start an operation of the staple removal device 1100A is provided on an upper surface portion of the paper pressing mechanism portion 1170. The adjustment knob (operation portion) 1106 which is configured to adjust a height of the placement table 1104, is provided at a front portion of a left side surface of the housing 1102. A dust box 1202 that accommodates the staple removed from the paper bundle P10 is provided at a rear portion of the housing 1102. The dust box 1202 is attachable to and detachable from the rear portion of the housing 1102.

[Internal Configuration Example of Staple Removal Device 1100A]

Figure 36:
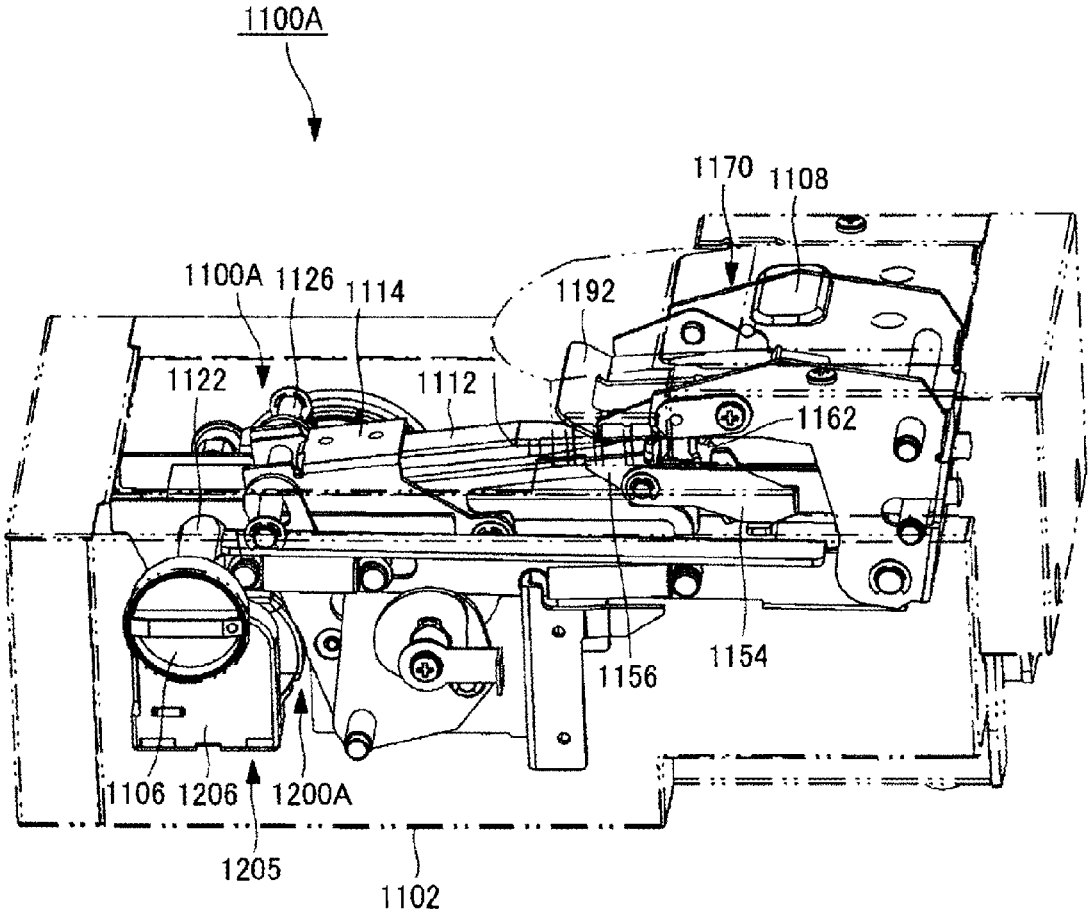
FIG. 36 is a perspective view showing an internal configuration of the staple removal device according to the second embodiment 1.
Figure 37A:
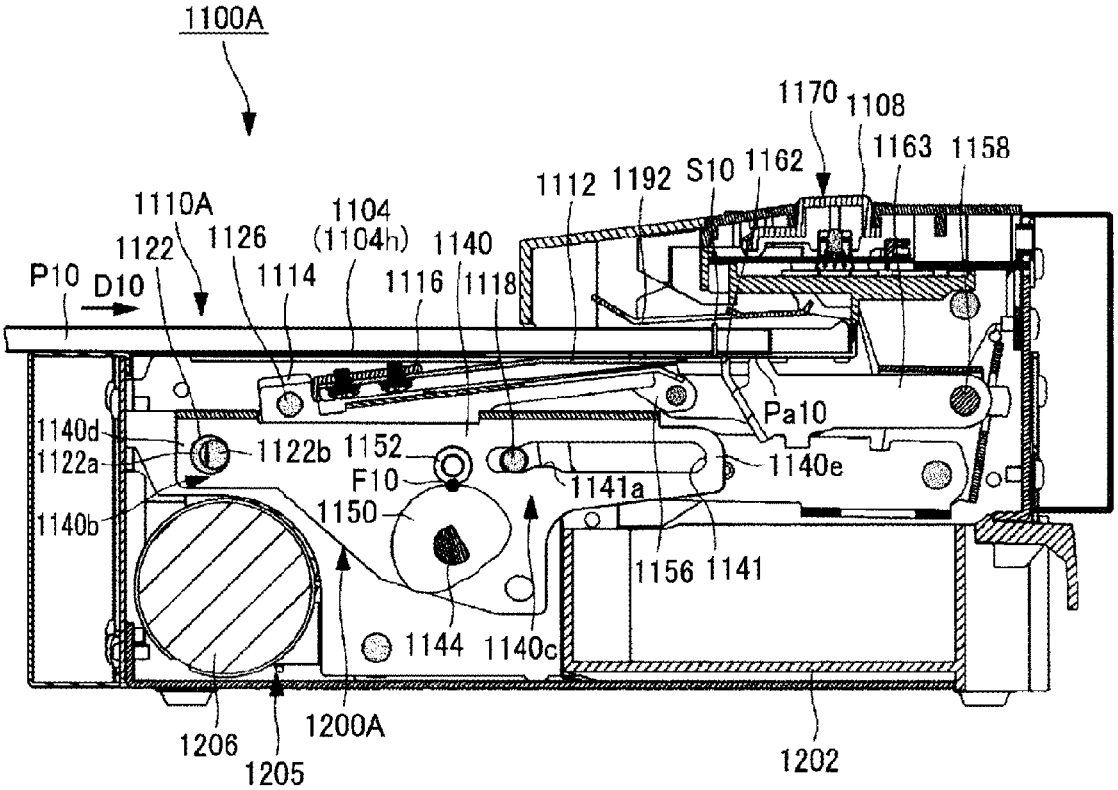
FIG. 37A is a cross-sectional view of the staple removal device according to the second embodiment 1.
Figure 37B:
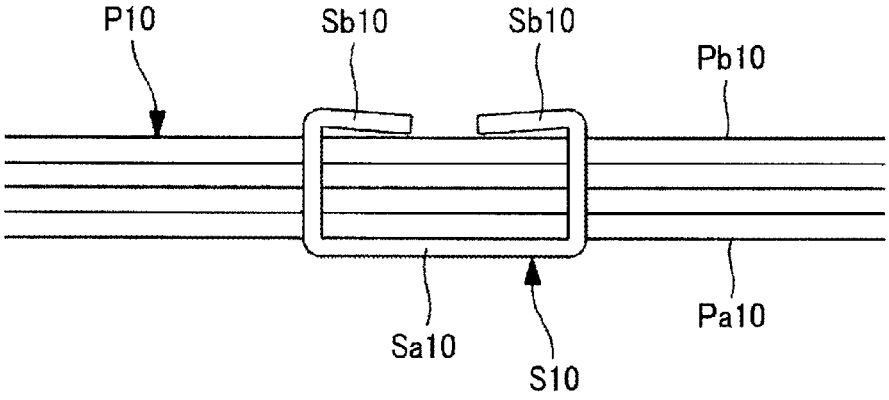
FIG. 37B is an enlarged view of a paper bundle bound by a staple.
Figure 38:
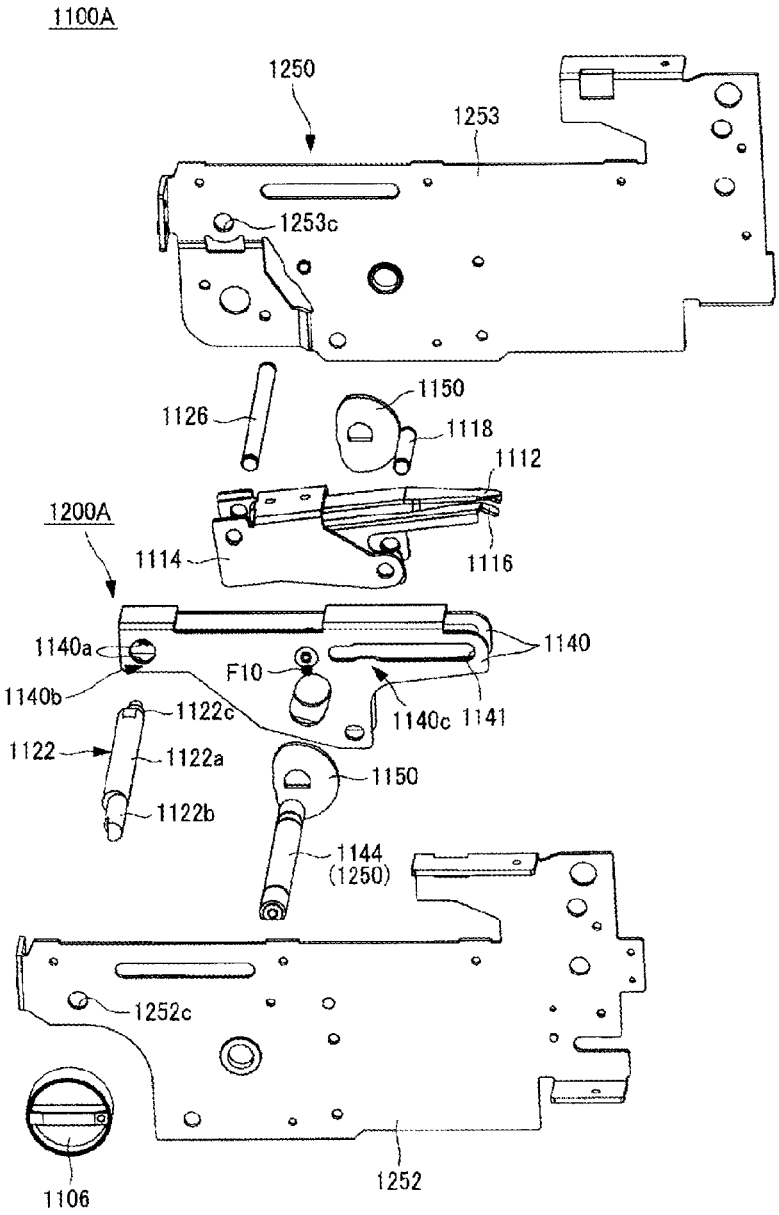
FIG. 38 is an exploded perspective view of the staple removal device according to the second embodiment 1.

FIG. 36 is a perspective view showing an internal configuration of the staple removal device 1100A according to the second embodiment 1. FIG. 37A is a cross-sectional view of the staple removal device 1100A according to the second embodiment 1. FIG. 37B is an enlarged view of the paper bundle P10 bound by the staple S10. FIG. 38 is an exploded perspective view of the staple removal device 1100A according to the second embodiment 1.

First, the paper bundle P10 bound by the staple S10 will be described with reference to FIGS. 37A and 37B. The staple S10 includes a crown portion Salt) and a pair of leg portions Sb10, Sb10 formed by bending two longitudinal direction end portions of the crown portion Sa10. The paper bundle P10 is formed by penetrating the pair of leg portions Sb10, Sb10 of the staple S10 from a first paper surface Pa10 of a lowermost piece of paper toward a second paper surface Pb10 of an uppermost piece of paper among a plurality of stacked pieces of paper, and bending the penetrated leg portions Sb10, Sb10 inward to bind the stacked pieces of paper. The binding position of the staple S10 is located, for example, at a corner portion or an edge portion of a piece of paper. In the present embodiment, the staple S10 is removed from such a paper bundle P10.

The staple removal device 1100A includes the staple pulling mechanism portion 1110A that includes a wedge plate (insertion portion) 1112 capable of being inserted between the crown portion Sa10 and the first paper surface Pa10 to remove the staple S10 from the paper bundle P10, a paper pressing mechanism portion 1170 that presses the paper bundle P10 placed on the placement table 1104, a driving portion 1205 that drives the staple pulling mechanism portion 1110A and the paper pressing mechanism 1170, and a case 1250 that defines a space for accommodating the respective portions described above. As shown in FIG. 38, the case 1250 includes a first side wall 1252 and a second side wall 1253 that are arranged to face each other in a left-right direction of the motor 1206, the staple pulling mechanism portion 1110A, and the paper pressing mechanism portion 1170.

The driving portion 1205 is an example of an insertion portion moving portion, and is configured with a motor 1206 configured by, for example, a DC motor, and a plurality of gears (not shown). The driving portion 1205 is connected to a drive shaft 1144 via the plurality of gears. The motor 1206 is driven, for example, by turning on the start switch 1108. The motor 1206 drives the staple pulling mechanism portion 1110A and the paper pressing mechanism portion 1170 by rotating the drive shaft 1144. Specifically, the motor 1206 is connected to the wedge plate 1112 via the drive shaft 1144 and the like, and moves the wedge plate 1112 along the first paper surface Pa10.

The staple pulling mechanism portion 1110A includes: the wedge plate 1112 that is arranged to face the first paper surface Pa10 on a side of the paper bundle P10 where the crown portion Sa10 is exposed in a state where the paper bundle P10 is placed on the placement surface 1104*h*, and is moved forward in the housing 1102 so as to be capable of being inserted between the crown portion Sa10 and the first paper surface Pa10; and an adjustment mechanism (insertion portion adjustment portion) 1200A that is connected to the wedge plate 1112 and can adjust a position of the wedge plate 1112 relative to the placement surface 1104*h* in a thickness direction of the paper bundle P10. In the present embodiment, movement of the wedge plate 1112 from the front side to the rear side in the housing 1102 is referred to as forward movement, and movement of the wedge plate 1112 from the rear side to the front side in the housing 1102 is referred to as backward movement. A direction in which the wedge plate 1112 moves forward is referred to as an insertion direction D10.

The wedge plate 1112 is configured to be movable in the front-rear direction of the housing 1102, and is a member that is inserted between the paper bundle P10 and the staple S10 so as to pull out the staple S10 from the paper bundle P10. The wedge plate 1112 is a slim and long plate-shaped member whose tip end side has a tapered shape such that the wedge plate 1112 can be easily inserted between the paper bundle and the staple S10. More specifically, the tip end side of the wedge plate 1112 is configured such that a plate thickness thereof gradually decreases toward a tip end portion thereof. A base end portion of the wedge plate 1112 is attached to a wedge plate holder 1114.

The wedge plate holder 1114 is made of a member formed by bending a flat plate. A wedge plate shaft 1118 is attached to a lower portion of the wedge plate holder 1114 via a shaft hole. The wedge plate shaft 1118 is a shaft configured to move the wedge plate 1112 in parallel along the first paper surface Pa10 (placement table 1104). A wedge plate drive shaft 1126 is attached to a front portion side of the wedge plate holder 1114 via a shaft hole. The wedge plate drive shaft 1126 is a shaft that moves the wedge plate 1112 forward and backward.

A crown holder 1116 is provided on an inner side of the wedge plate holder 1114 so as to face the wedge plate 1112. The crown holder 1116 is a member configured to support the staple S10 pulled out from the paper bundle P10. The wedge plate shaft 1118 is attached to a lower portion of a side wall of the crown holder 1116 via a shaft hole. The wedge plate drive shaft 1126 is attached to a rear portion of the side wall of the crown holder 1116 via a shaft hole. With such a configuration, the crown holder 1116 can move forward and backward integrally with the wedge plate 1112.

A staple pressing portion 1162 is provided downstream of (behind) the staple S10 of the paper bundle P10 placed on the placement table 1104 in the insertion direction D10 of the wedge plate 1112. The staple pressing portion 1162 is abutted against the crown portion of the staple S10 from a direction opposite to the insertion direction D10 of the wedge plate 1112 to restrict movement of the crown portion in the insertion direction D10. The staple pressing portion 1162 is supported by a support member 1163.

As shown in FIG. 37A, the support member 1163 is formed by a pair of flat plate members which are bent rearward from two side surface portions of the staple pressing portion 1162. The staple pressing portion 1162 is attached to one end portion of the support member 1163, while the other end portion of the support member 1163 is rotatably supported by a shaft 1158.

As shown in FIG. 37A, an ejector 1156 is inserted and held between the wedge plate 1112 and the crown holder 1116. When the staple S10 is pulled out while the wedge plate 1112 and the crown holder 1116 are moved backward, the ejector 1156 is abutted against the staple S10 held by the crown holder 1116 and thus causes the staple S10 to fall into the dust box 1202 below. The ejector 1156 is supported by an ejector lever 1154.

The ejector lever 1154 is formed of a pair of flat plate members, and is arranged so as to overlap an outer side of the support member 1163. The shaft 1158 is attached to a rear portion of the ejector lever 1154 via a shaft hole. The ejector lever 1154 is configured to be rotatable about the shaft 1158 which serves as a fulcrum. The ejector lever 1154 is attached to the support member 1163 via a tension spring (not shown).

[Configuration Example of Adjustment Mechanism 1200A]

As shown in FIGS. 37A and 38, the adjustment mechanism 1200A is an example of an insertion portion adjustment portion, which includes a pull-down link 1140 including a base end portion 1140*d* (front end) and a tip end portion 1140*e* (rear end), a rotation fulcrum portion (rotation shaft) F10 provided between the base end portion 1140*d* and the tip end portion 1140*e*, a first portion 1140*b* which is located between the base end portion 1140*d* and the rotation fulcrum portion F10 and moves in a direction away from the placement surface 1104*h* when the rotation fulcrum portion F10 rotates in a counterclockwise direction, a second portion 1140*c* which is located between the tip end portion 1140*e* and the rotation fulcrum portion F10 and moves in a direction approaching the placement surface 1104*h* when the rotation fulcrum portion F10 rotates in the counterclockwise direction, and an adjustment fulcrum shaft (first portion moving portion) 1122 which moves the first portion 1140*b* in the direction away from the placement surface 1104*h*. The adjustment fulcrum shaft 1122 is rotatably supported by the first portion 1140*b* of the pull-down link 1140. The second portion 1140*c* of the pull-down link 1140 is provided with a long hole 1141 extending from the rotation fulcrum portion F10 toward the tip end portion 1140*e* of the second portion 1140*c*. The wedge plate 1112 is connected (engaged) to the long hole 1141 via engagement portions such as the wedge plate holder 1114 and the wedge plate shaft 1118.

Figure 40:
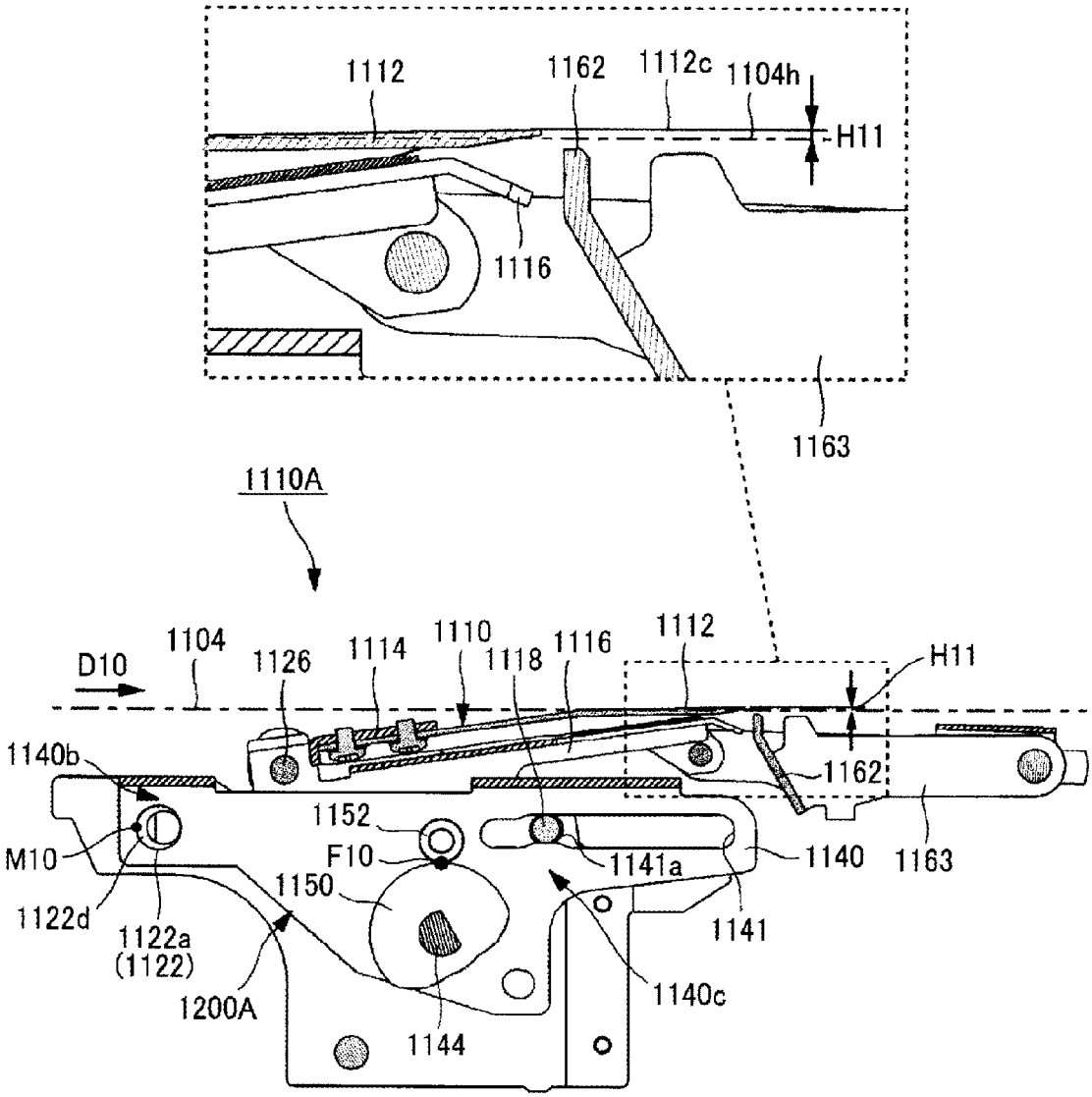
FIG. 40 shows an operation of the staple removal device in a case where a protrusion amount of a wedge plate according to the second embodiment 1 is set to a first protrusion amount.

As shown in FIGS. 36, 38, and 40, the pull-down link 1140 is formed of, for example, a pair of flat plate members formed by bending a metal plate, and is arranged below and on an inner side of the crown holder 1116. A long hole 1141 which extends along the front-rear direction is formed in the pull-down link 1140. A long diameter of the long hole 1141 is determined based on a front-rear direction movement range of the wedge plate 1112. The wedge plate shaft (connecting portion) 1118 is slidably inserted into the long hole 1141. As a result, the wedge plate 1112 and the crown holder 1116 attached to the wedge plate shaft 1118 can be moved forward and backward by moving along a long diameter direction of the long hole 1141 of the pull-down link 1140. The adjustment fulcrum shaft 1122 is attached to the first portion 1140*b* of the pull-down link 1140. The pull-down link 1140 is configured to be rotatable about the rotation fulcrum portion F10 which serves as the fulcrum when the adjustment fulcrum shaft 1122 is rotated.

A protruding portion 1141*a* which protrudes upward is formed on a lower end edge of the long hole 1141. A long diameter direction length (section) of the protruding portion 1141*a* is set to a length that allows the wedge plate 1112 to be lifted and kept pressed against the first paper surface Pa10 until the wedge plate 1112 is inserted between the first paper surface Pa10 of the paper bundle P10 and the crown portion Sa10. This is because, once the wedge plate 1112 is inserted between the paper bundle P10 and the crown portion of the staple S10, the wedge plate 1112 is held in this state, and thus it is not necessary to lift the wedge plate 1112 thereafter. As a result, a force that presses the wedge plate 1112 against the paper bundle P10 can be prevented from constantly acting on the paper bundle P10, and thus the paper bundle P10 can be prevented from being damaged.

The drive shaft 1144 is inserted through a shaft hole formed in a substantially central portion of the pull-down link 1140. A pull-up return cam 1150 is attached to the drive shaft 1144 on an outer side of the pull-up link 1140. A pull-down return cam roller 1152 is attached to an upper portion side of an outer side center of the pull-down link 1140 so as to be capable of being abutted against the pull-down return cam 1150. The pull-down link 1140, the pull-up return cam 1150, and the pull-down return cam roller 1152 are an example of a mechanism configured to pull down the wedge plate 1112 in a direction away from the placement table 1104 when the staple S10 is pulled out from the paper bundle P10. In the present embodiment, the rotation fulcrum portion F10 is a center of a contact position between the pull-down return cam 1150 and the pull-down return cam roller 1152.

[Configuration Example of Adjustment Fulcrum Shaft 1122]

Figure 39A:
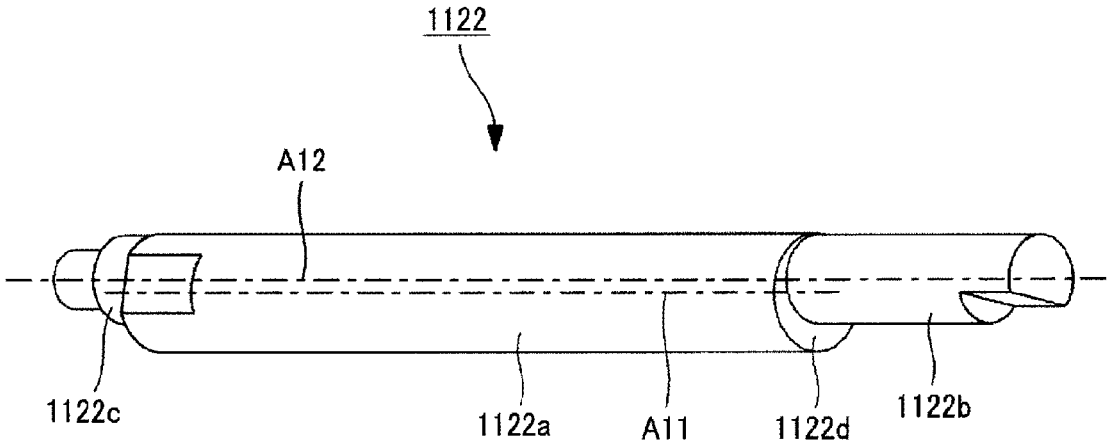
FIG. 39A is a perspective view of an adjustment fulcrum shaft according to the second embodiment 1.
Figure 39B:
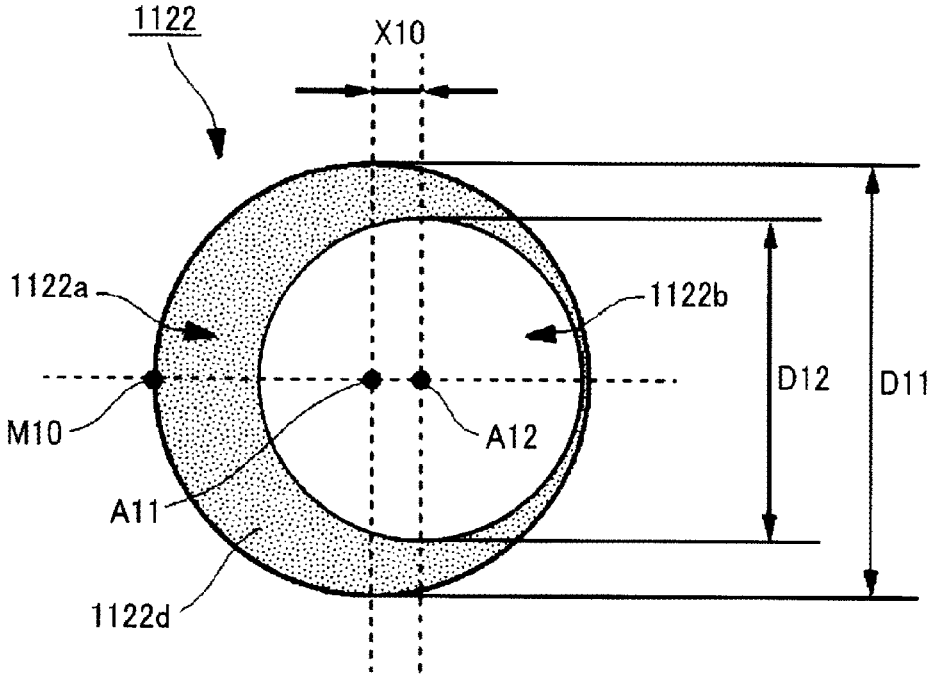
FIG. 39B is a side view of the adjustment fulcrum shaft according to the second embodiment 1.

FIG. 39A is a perspective view of the adjustment fulcrum shaft 1122 according to the second embodiment 1. FIG. 39B is a side view of the adjustment fulcrum shaft 1122 according to the second embodiment 1.

The adjustment fulcrum shaft 1122 includes an eccentric shaft A11 and is configured to be rotatable about the eccentric shaft A11. An outer peripheral surface of the eccentric shaft A11 is abutted against the first portion 1140*b* provided on the pull-down link 1140.

The adjustment fulcrum shaft 1122 includes a first shaft portion 1122*a* having a first shaft diameter D11, and second shaft portions 1122*b* and 1122*c* which are continuously provided at two axial direction end portions of the first shaft portion 1122*a* and have a second shaft diameter D12 which is smaller than the first shaft diameter D11.

As shown in FIG. 38, the first shaft portion 1122*a* is inserted into shaft holes 1140*a*, 1140*a* of the pull-down link 1140, and is rotatably supported by the pull-down link 1140. The second shaft portion 1122*b* is inserted into a shaft hole 1252*c* of the first side wall 1252, and is rotatably supported by the first side wall 1252. The second shaft portion 1122*c* is inserted into a shaft hole 1253*c* of the second side wall 1253, and is rotatably supported by the second side wall 1253.

The eccentric shaft A11 of the first shaft portion 1122*a* is provided at a position shifted by a distance X10 in a radial direction from a shaft A12 of the second shaft portions 1122*b* and 1122*c*. The second shaft portions 1122*b* and 1122*c* are provided inside an outer periphery of the first shaft portion 1122*a* such that a part of an outer periphery of the second shaft portion 1122*b* is in contact with a part of an outer periphery of the first shaft portion 1122*a*.

Portions of the first shaft portion 1122*a* that protrudes outward from the second shaft portions 1122*b* and 1122*c* serve as an adjustment portion 1122*d* (see colored portions in FIG. 39B) configured to adjust a protrusion amount by which the wedge plate 1112 protrudes from the placement table 1104. Among portions of the adjustment portion 1122*d* protruding from the second shaft portions 1122*b* and 1122*c*, a portion having a maximum diameter is referred to as a maximum portion M10. With such a configuration, when the second shaft portions 1122*b* and 1122*c* of the adjustment fulcrum shaft 1122 are rotated around the shaft A12, the first shaft portion 1122*a* is also rotated around the eccentric shaft A11, and the pull-down link 1140 can be rotated in an up-down direction in accordance with a rotation position of the first shaft portion 1122*a*.

As shown in FIG. 38, the adjustment knob 1106 is attached to the second shaft portion 1122*b* of the adjustment fulcrum shaft 1122. An operator rotates the adjustment knob 1106 to rotate the adjustment fulcrum shaft 1122 clockwise or counterclockwise, thereby adjusting a height of the placement table 1104.

[Configuration Example of Paper Pressing Mechanism Portion 1170]

As shown in FIGS. 36 and 37A, the paper pressing mechanism portion 1170 is arranged to extend from inside to outside of the housing 1102 via the first side wall 1252. A paper pressing plate 1192 is provided at a position facing the placement table 1104 on an outer side of the paper pressing mechanism portion 1170. When a staple removing operation is started, the paper pressing plate 1192 is lowered toward the placement table 1104 to press the paper bundle P10 on the placement table 1104.

[Operation Example of Wedge Plate 1112 of Staple Removal Device 1100A During Protrusion Amount Adjustment]

Next, an operation of the staple removal device 1100A in a case where the protrusion amount of the wedge plate 1112 relative to the placement table 1104 is changed will be described. In the following description, as shown in FIG. 40, the protrusion amount by which the wedge plate 1112 protrudes from the placement table 1104 when the wedge plate shaft 1118 is located on the protruding portion 1141*a* of the long hole 1141 of the pull-down link 1140 while the wedge plate 1112 is protruded from the placement table 1104 is used as a reference. A state where the maximum portion M10 of the first shaft portion 1122*a* is located on the front side in this case is referred to as an intermediate position, which is a standard protrusion amount of the wedge plate 1112, and is referred to as an intermediate position of the adjustment knob 1106. Further, hereinafter, an operation of a left side of the staple removal device 1100A will be described. An operation of a right side of the staple removal device 1100A is the same, and detailed description thereof will thus be omitted.

FIG. 40 shows an operation of the staple removal device 1100A in a case where the protrusion amount of the wedge plate 1112 according to the second embodiment 1 is set to a first protrusion amount H11. The first protrusion amount H11 of the wedge plate 1112 is a protrusion amount when the adjustment knob 1106 is set to the intermediate position.

When the user sets the adjustment knob 1106 to the intermediate position, the maximum portion M10 of the adjustment portion 1122*d* of the adjustment fulcrum shaft 1122 is oriented in a horizontal direction opposite to the insertion direction D10. In this case, since the eccentric shaft A11 and the shaft A12 of the adjustment portion 1122*c*1 of the adjustment fulcrum shaft 1122 are horizontal and substantially do not affect the protrusion amount of the wedge plate 1112, the pull-down link 1140 does not move up and down, and the protrusion amount of an upper surface 1112*c* of the wedge plate 1112 relative to the placement surface 1104*h* becomes the standard first protrusion amount H11.

Figure 41:
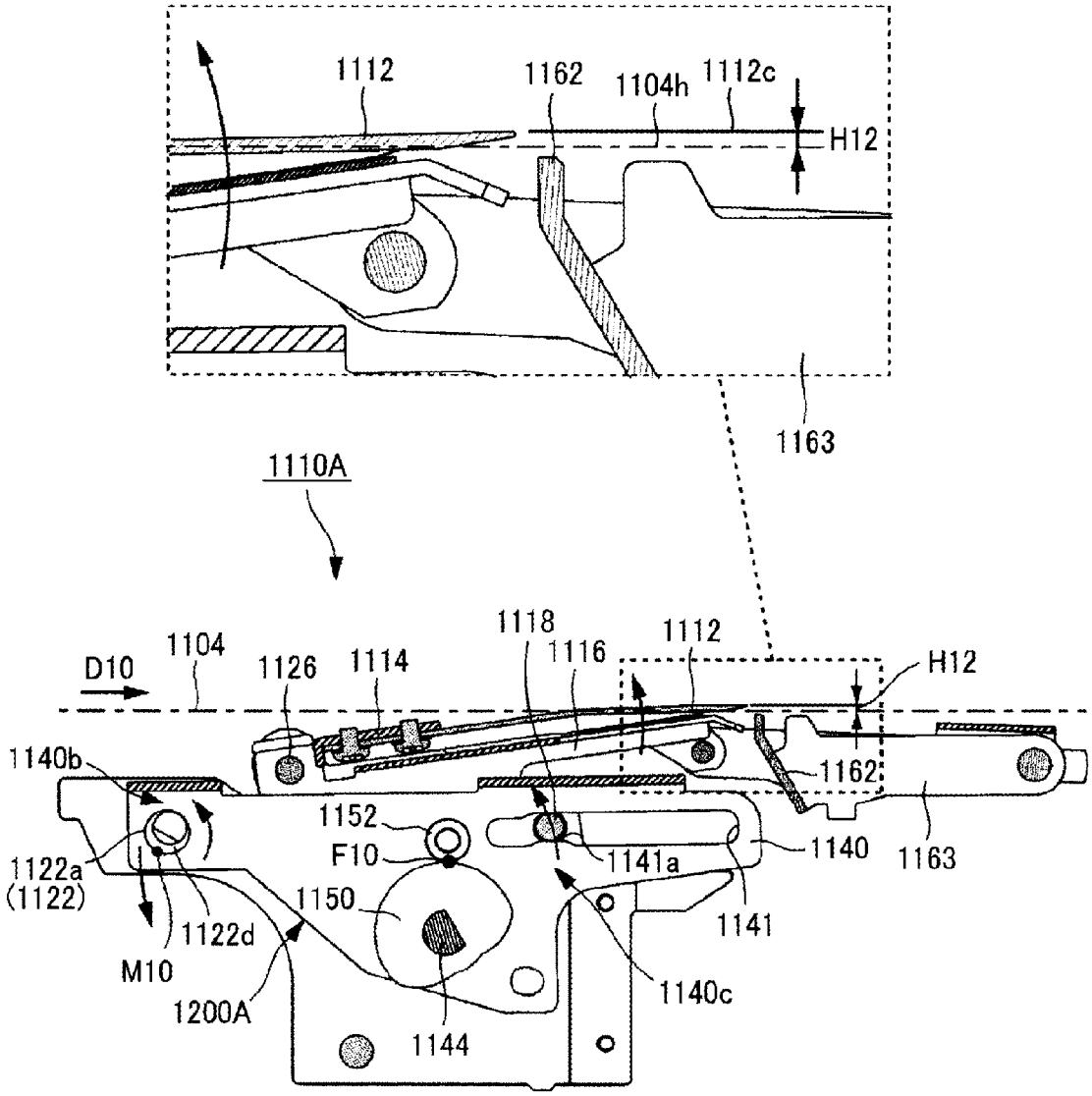
FIG. 41 shows an operation of the staple removal device in a case where the protrusion amount of the wedge plate according to the second embodiment 1 is set to a second protrusion amount.

FIG. 41 shows an operation of the staple removal device 1100A in a case where the protrusion amount of the wedge plate 1112 according to the second embodiment 1 is set to a second protrusion amount H12.

When the user rotates a wedge plate adjustment knob 1107 counterclockwise from the intermediate position, the adjustment fulcrum shaft 1122 is also rotated counterclockwise. Accordingly, when the maximum portion M10 of the adjustment portion 1122*d* of the adjustment fulcrum shaft 1122 is moved downward, the first portion 1140*b* of the pull-down link 1140 moves in a direction away from the wedge plate 1112 in accordance with a protrusion amount of the maximum portion M10 of the adjustment portion 1122*d*. As a result, the pull-down link 1140 is rotated counterclockwise about the rotation fulcrum portion F10 between the pull-down return cam 1150 and the pull-down return cam roller 1152, and the wedge plate shaft 1118 provided on the second portion 1140*c* is pushed up.

When the wedge plate shaft 1118 is pushed up, the wedge plate 1112 is rotated upward about the wedge plate drive shaft 1126 which serves as a fulcrum, and the tip end side of the wedge plate 1112 is lifted. In this case, the protrusion amount of the upper surface 1112*c* of the wedge plate 1112 relative to the placement surface 1104*h* is the second protrusion amount H12 which is larger than the first protrusion amount H11 shown in FIG. 40. In this way, by rotating the wedge plate adjustment knob 1106 counterclockwise from the intermediate position, the protrusion amount of the wedge plate 1112 can be increased from the reference protrusion amount.

Figure 42:
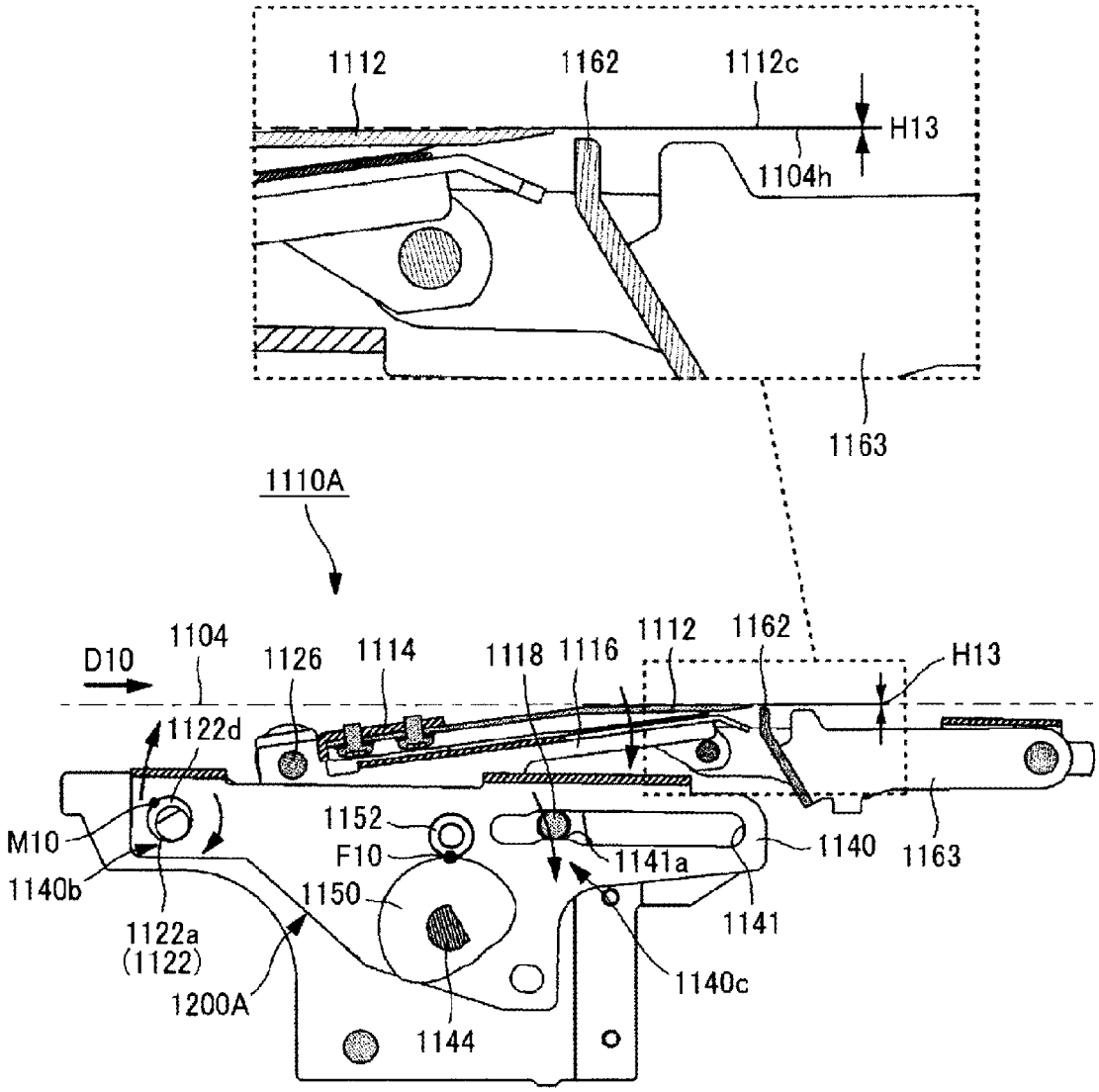
FIG. 42 shows an operation of the staple removal device in a case where the protrusion amount of the wedge plate according to the second embodiment 1 is set to a third protrusion amount.

FIG. 42 shows an operation of the staple removal device 1100A in a case where the protrusion amount of the wedge plate 1112 according to the second embodiment 1 is set to a third protrusion amount H13.

When the user rotates the wedge plate adjustment knob 1106 clockwise from the intermediate position, the adjustment fulcrum shaft 1122 is also rotated clockwise. Accordingly, the maximum portion M10 of the adjustment portion 1122*d* of the adjustment fulcrum shaft 1122 is moved upward, and thus the first portion 1140*b* of the pull-down link 1140 is moved in a direction approaching the wedge plate 1112 in accordance with the protrusion amount of the maximum portion M10 of the adjustment portion 1122*d*. As a result, the pull-down link 1140 is rotated clockwise about the rotation fulcrum portion F10 between the pull-down return cam 1150 and the pull-down return cam roller 1152, and the wedge plate shaft 1118 provided on the second portion 1140*c* is pushed down.

When the wedge plate shaft 1118 is pushed down, the wedge plate 1112 is rotated downward about the wedge plate drive shaft 1126 which serves as the fulcrum, and thus the tip end side of the wedge plate 1112 is lowered. In this case, the protrusion amount of the upper surface 1112*c* of the wedge plate 1112 relative to the placement surface 1104*h* is the third protrusion amount H13 which is smaller than the first protrusion amount H11 shown in FIG. 42. In this way, by rotating the wedge plate adjustment knob 1107 clockwise from the intermediate position, the protrusion amount of the wedge plate 1112 can be reduced from the reference protrusion amount.

[Operation Example During Needle Removal of Staple Removal Device 1100]

Next, an operation of the staple removal device 1100A in a case where the staple S10 is pulled out from the paper bundle P10 will be described with reference to FIG. 37 and the like.

When the user places the paper bundle P10 on the placement table 1104 and presses the start switch 1108, the motor 1206 is driven to lower the paper pressing plate 1192 of the paper pressing mechanism portion 1170, and the paper bundle P10 is pressed by the paper pressing plate 1192. Subsequently, when the paper bundle P10 is pressed by the paper pressing plate 1192, the wedge plate 1112 is moved forward along the insertion direction D10 and is inserted between the paper bundle P10 and the crown portion of the staple S10. When the wedge plate 1112 is moved forward, the leg portions Sb10, Sb10 of the staple S10 are gradually raised in accordance with an increase in a thickness of the wedge plate 1112. When the pushing provided by the wedge plate 1112 is completed, the leg portions Sb10, Sb10 of the staple S10 are raised.

Subsequently, the wedge plate 1112 and the crown holder 1116 are moved in the direction away from the placement table 1104, that is, moved downward by operations of the pull-down link 1140, the pull-up return cam 1150, and the pull-down return cam roller 1152 shown in FIG. 37A and the like. As a result, the staple S10 in the state where the leg portions Sb10, Sb10 are raised is pulled out from the paper bundle P10. When the staple S10 is pulled out from the paper bundle P10, the wedge plate 1112 and the crown holder 1116 are moved backward and moved again in the direction approaching the placement table 1104, that is, moved upward again. That is, the wedge plate 1112 and the like are returned to the home position. As a result, the staple S10 falls from the crown holder 1116, and the staple S10 is accommodated in the dust box 1202. Such an operation is repeatedly performed during staple removal.

As described above, according to the second embodiment 1, by operating the adjustment knob 1106, the pull-down link 1140 can be rotated in the up-down direction via the adjustment fulcrum shaft 1122, and the protrusion amount of the wedge plate 1112 relative to the placement table 1104 can be changed. As a result, since the protrusion amount of the wedge plate 1112 relative to the placement table 1104 can be changed in accordance with types of the paper bundle P10 and the staple S10, even when the types of paper of the paper bundle P10 and the staple S10 subjected to the staple removal or a binding position varies, an optimum protrusion amount (height) of the wedge plate 1112 relative to the placement table 1104 can be set in accordance with various situations such as the types of the paper and the staple S10. As a result, damage to the paper during the staple removal and a failure of the staple removal can be prevented.

Even when the staple removal is performed on a different type of the paper bundle P10 that requires a different optimum protrusion amount of the wedge plate 1112 as compared with a general paper bundle P10, such as a paper bundle P10 formed of a type of paper that is not used by another user, the protrusion amount of the wedge plate 1112 can be appropriately adjusted. The user can adjust the protrusion amount of the wedge plate 1112 to an optimum protrusion amount with respect to the paper bundle P10 that is frequently used by each user, such as a user who often binds a corner portion of a thin paper bundle P10 and a user who often side-stitches a thick paper bundle P10.

Further, even when an error occurs in the protrusion amount of the wedge plate 1112 due to a difference in accuracy of components of the staple removal device 1100A or when a component is worn or deformed due to long-term use of the staple removal device 1100A, the protrusion amount of the wedge plate 1112 can be set as desired by the user to solve such problems, and thus the staple removal device 1100A can be continuously used without any problem.

Second Embodiment 2

According to the staple removal device 1100B according to a second embodiment 2, the protrusion amount of the wedge plate 1112 relative to the placement table 1104 is changed by changing a position of the placement table 1104 relative to the wedge plate 1112. Configurations, operations, and the like common to those of the staple removal device 1100A according to the first embodiment related to the second purpose are denoted by the same reference numerals, and detailed description thereof will be omitted.

[Configuration Example of Staple Removal Device 1100B]

Figure 43:
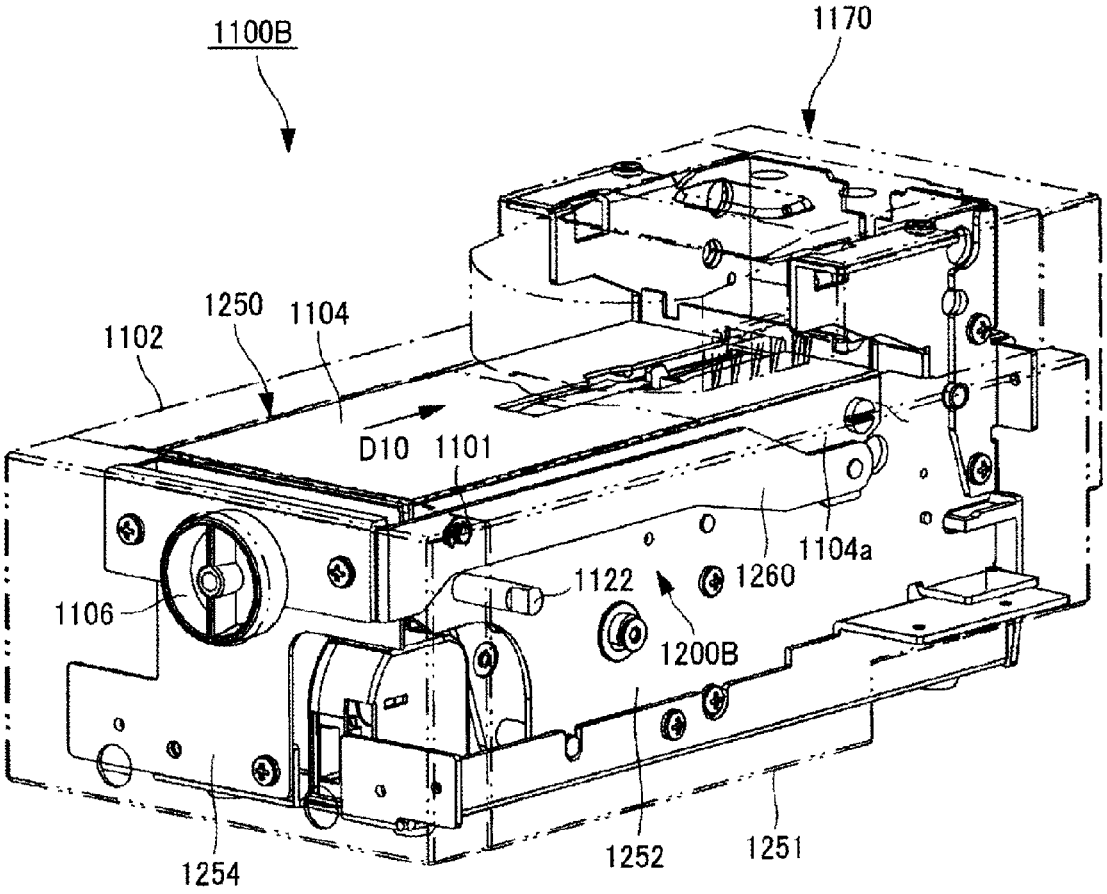
FIG. 43 is a perspective view of a staple removal device according to a second embodiment 2.
Figure 44:
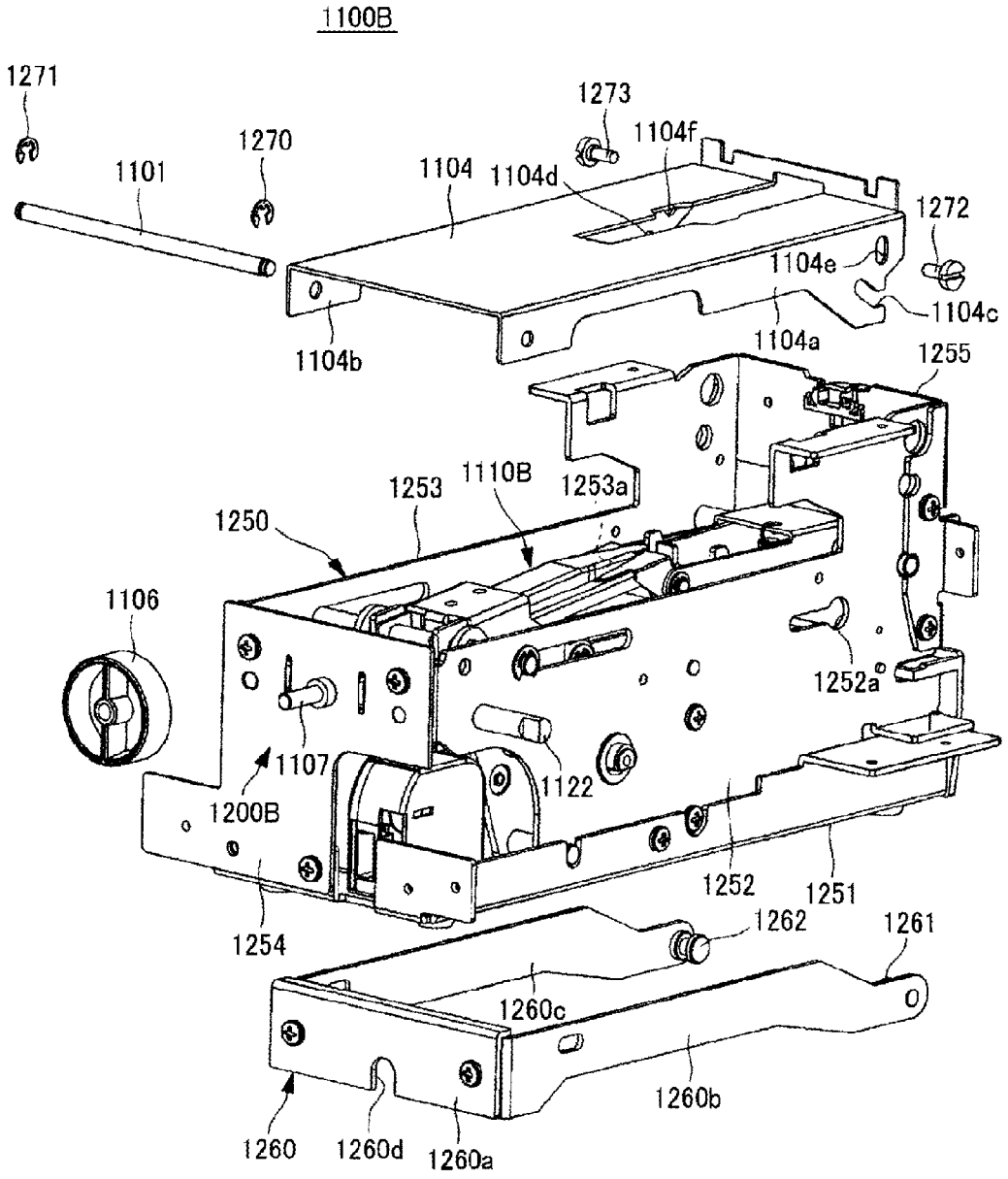
FIG. 44 is an exploded perspective view of the staple removal device according to the second embodiment 2.
Figure 45:
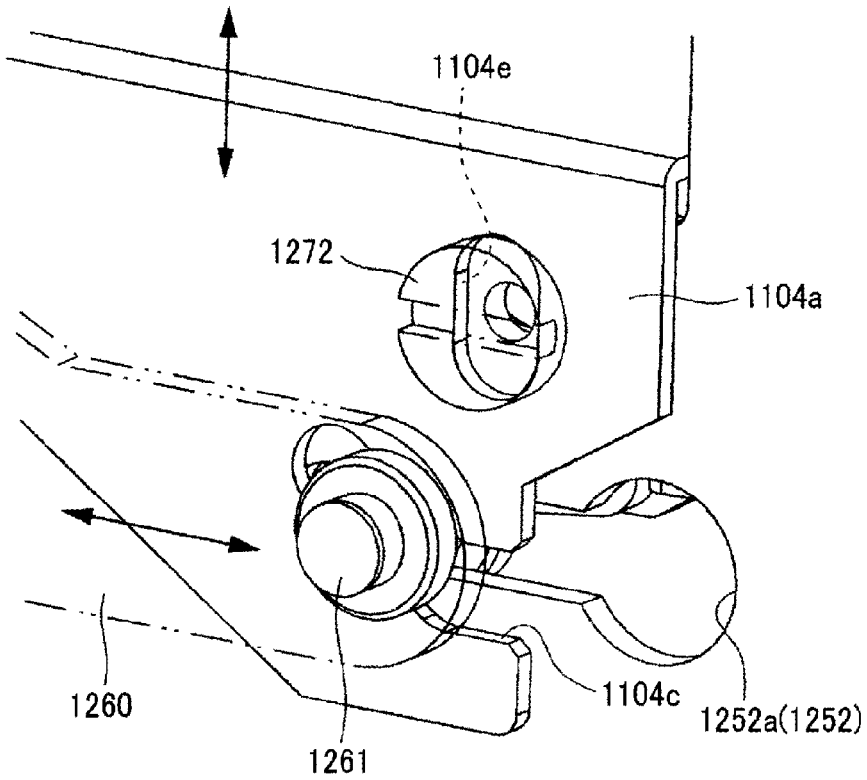
FIG. 45 is a main part enlarged perspective view of a slide shaft and a first attachment portion according to the second embodiment 2.
Figure 46:
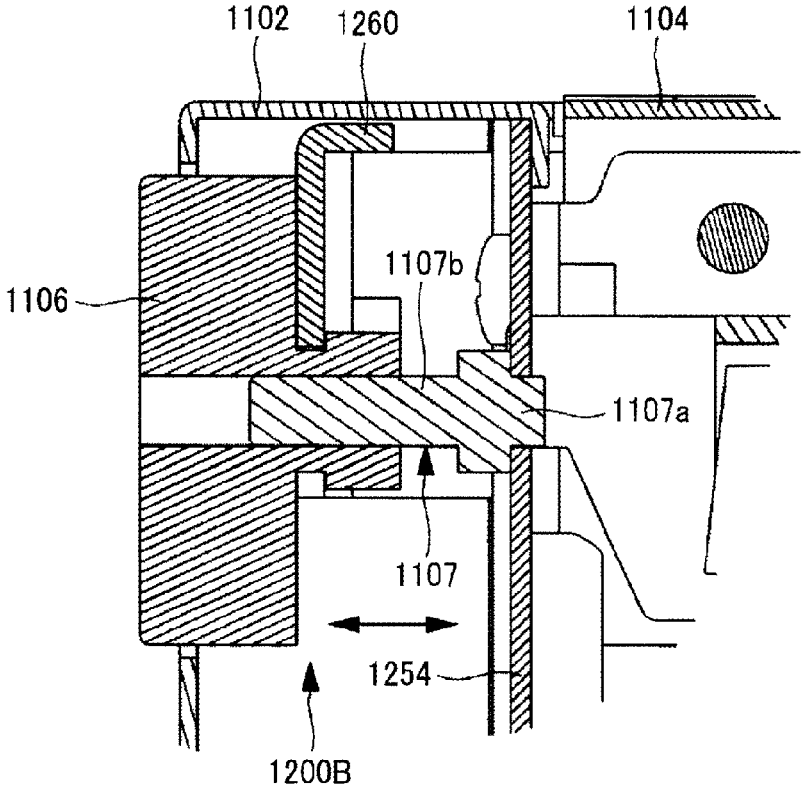
FIG. 46 is a main part enlarged cross-sectional view of an adjustment knob and an adjustment screw according to the second embodiment 2.

FIG. 43 is a perspective view of the staple removal device 1100B according to the second embodiment 2. FIG. 44 is an exploded perspective view of the staple removal device 1100B according to the second embodiment 2. FIG. 45 is a main part enlarged perspective view of a slide shaft 1261 and a first attachment portion 1104*a* according to the second embodiment 2. FIG. 46 is a main part enlarged cross-sectional view of the adjustment knob 1106 and the adjustment screw 1107 according to the second embodiment 2.

The staple removal device 1100B at least includes a case 1250 that accommodates a staple removal mechanism portion 1110B and the like, and an adjustment mechanism 1200B that is connected to the placement table 1104 and is an example of a placement portion adjustment portion that can adjust a position of the placement surface 1104*h* relative to the wedge plate 1112 in a thickness direction of the paper bundle P10.

The case 1250 includes: a bottom wall 1251 which has a rectangular shape in a plan view and includes a left side, a right side, a front side, and a rear side; a first side wall 1252 standing from the left side of the bottom wall 1251; a second side wall 1253 standing from the right side of the bottom wall 1251 and facing the first side wall 1252; a front wall 1254 standing from the front side of the bottom wall 1251 and connecting the first side wall 1252 and the second side wall 1253; and a rear wall 1255 standing from the rear side of the bottom wall 1251 and facing the front wall 1254.

As shown in FIGS. 44 and 45, the first side wall 1252 is formed with a guide groove 1252*a* configured to be slidably engaged with the slide shaft (guide shaft) 1261 of an adjustment link 1260 which is an example of a placement portion adjustment portion. The guide groove 1252*a* is an opening extending in a front-rear direction of the first side wall 1252. An insertion opening into which an enlarged diameter portion of the slide shaft 1261 can be inserted is provided on a rear end side of the opening.

A guide groove 1253*a* configured to be slidably engaged with a slide shaft 1262 of the adjustment link 1260 is formed in the second side wall 1253. The guide groove 1253*a* is an opening extending in a front-rear direction of the second side wall 1253. An insertion opening into which an enlarged diameter portion of the slide shaft 1262 can be inserted is provided on a rear end side of the opening.

As shown in FIGS. 43 and 44, the placement table 1104 is provided with the first attachment portion 1104*a* and a second attachment portion 1104*b* which are side walls extending downward from left-right direction side surface portions, respectively. Each of the placement table 1104, the first attachment portion 1104*a*, and the second attachment portion 1104*b* may be formed by bending a metal plate.

The mounting table 1104 is arranged to close an upper side of the staple pulling mechanism portion 1110B and the like. The first attachment portion 1104*a* is attached to an outer upper end of the first side wall 1252, while the second attachment portion 1104*b* is attached to an outer upper end of the second side wall 1253.

A fulcrum shaft 1101 is inserted through shaft holes formed in front end portions of the first attachment portion 1104*a*, the second attachment portion 1104*b*, the first side wall 1252, and the second side wall 1253. Stoppers 1270 and 1271 are attached to two end portions of the fulcrum shaft 1101, respectively, such that the fulcrum shaft 1101 is not detached from the case 1250.

As shown in FIGS. 44 and 45, a long hole 1104*e* extending in the up-down direction is formed in a rear end portion of the first attachment portion 1104*a*. A rear end side of the first attachment portion 1104*a* is attached to the first side wall 1252 by a stepped guide pin 1272 via the long hole 1104*e* so as to be movable in the up-down direction.

A long hole 1104*f* extending in the up-down direction is formed in a rear end portion of the second attachment portion 1104*b* in the same manner. A rear end side of the second attachment portion 1104*b* is attached to the second side wall 1253 by a stepped guide pin 1273 via the long hole 1104*f* so as to be movable in the up-down direction.

A guide groove 1104*c* is formed in a portion protruding downward from the rear end portion of the first attachment portion 1104*a*. The guide groove 1104*c* includes an inclined surface that is inclined from a front end side toward a rear end side in a direction away from the placement table 1104, and a rear end edge thereof is formed with a cut-out opening. The slide shaft 1261 of the adjustment link 1260 is abutted against the inclined surface and is slidably engaged with the guide groove 1104*c*.

A guide groove 1104*d* is formed in a portion protruding downward from the rear end portion of the second attachment portion 1104*b* in the same manner. The guide groove 1104*d* is formed with an opening which is cut out to be inclined forward from a rear end edge toward the placement table 1104 (obliquely forward). The slide shaft 1262 of the adjustment link 1260 is abutted against the inclined surface and is slidably engaged with the guide groove 1104*d*.

As shown in FIGS. 43 and 46, the adjustment mechanism 1200B includes the adjustment knob 1106, the adjustment screw 1107 to which the adjustment knob 1106 is attached, and the adjustment link 1260 that is movable in the insertion direction D10 of the wedge plate 1112 and the direction opposite to the insertion direction. The adjustment mechanism 1200A is configured to be operable by an operator.

A head portion 1107*a* of the adjustment screw 1107 is attached to a substantially central upper portion of a front surface of the front wall 1254. A screw portion 1107*b* in which a screw groove of the adjustment screw 1107 is formed protrudes toward the front side of the front wall 1254. The adjustment knob 1106 is rotatably attached to the screw portion 1107*b* of the adjustment screw 1107. According to the second embodiment related to the second purpose, the adjustment knob 1106 is provided on a front surface side of the housing 1102 instead of being provided on a side surface side of the housing 1102. When the user rotates the adjustment knob 1106, the adjustment knob 1106 is moved in the front-rear direction, which is an axial direction of the adjustment screw 1107.

As shown in FIGS. 43 and 44, the adjustment link 1260 is a slim and long plate-shaped member having a substantially U shape, and is attached to the case 1250 along upper outer peripheries of the front wall 1254, the first side wall 1252, and the second side wall 1253. Specifically, the adjustment link 1260 includes a front portion 1260*a* extending along the front wall 1254, a first side portion 1260*b* extending along the first side wall 1252, and a second side portion 1260*c* extending along the second side wall 1253.

A recessed portion 1260*d* is formed in a lower end edge of a substantially central portion of the adjustment link 1260 on the side of the front wall 1254. The recessed portion 1260*d* is fitted to the adjustment screw 1107 formed on the front wall 1254 from an upper side. At this time, a front surface of the adjustment link 1260 is abutted against a rear surface of the adjustment knob 1106 as shown in FIG. 46.

As shown in FIGS. 44 and 45, one end portion of the slide shaft 1261 is attached to an inner side of a rear end portion of the first side portion 1260*b*. The other end side of the slide shaft 1261 is slidably engaged with each of the guide groove 1252*a* of the first side wall 1252 and the guide groove 1104*c* of the first attachment portion 1104*a*.

One end portion of the slide shaft 1262 is attached to an inner side of a rear end portion of the second side portion 1260*c*. The other end side of the slide shaft 1262 is slidably engaged with each of the guide groove 1252*a* of the second side wall 1253 and the guide groove 1104*d* of the second attachment portion 1104*b*.

With this configuration, when the adjustment knob 1106 is moved in the front-rear direction, the adjustment link 1260 is moved in the front-rear direction in conjunction with the movement of the adjustment knob 1106, and thus the slide shaft 1261 slides in the guide grooves 1104*c* and 1252*a*, while the slide shaft 1262 slides in the guide grooves 1104*d* and 1253*a*. At this time, since the slide shafts 1261 and 1262 are moved in the front-rear direction along the guide grooves 1252*a* and 1253*a* without displacement in the up-down direction, the slide shafts 1261 and 1262 are abutted against the inclined surfaces of the guide grooves 1104*c* and 1104*d* and are pushed to slide in the up-down direction. As a result, in the guide grooves 1104*c* and 1104*d*, the movement in the front-rear direction is converted into the movement in the up-down direction, so that the first attachment portion 1104*a* and the second attachment portion 1104*b* are moved up and down.

[Operation Example of Staple Removal Device 1100B]

Next, an operation example of the staple removal device 1100B according to the second embodiment 2 will be described. Hereinafter, a protrusion amount of the wedge plate 1112 at an intermediate (standard) position among positions of the placement table 1104 relative to the wedge plate 1112 is referred to as a fourth protrusion amount H14. A rotation position of the adjustment knob 1106 in this case is referred to as an intermediate position. Further, hereinafter, an operation of a left side of the staple removal device 1100B will be described. A configuration and an operation of a right side of the staple removal device 1100B is the same, and detailed description thereof will thus be omitted.

Figure 47A:
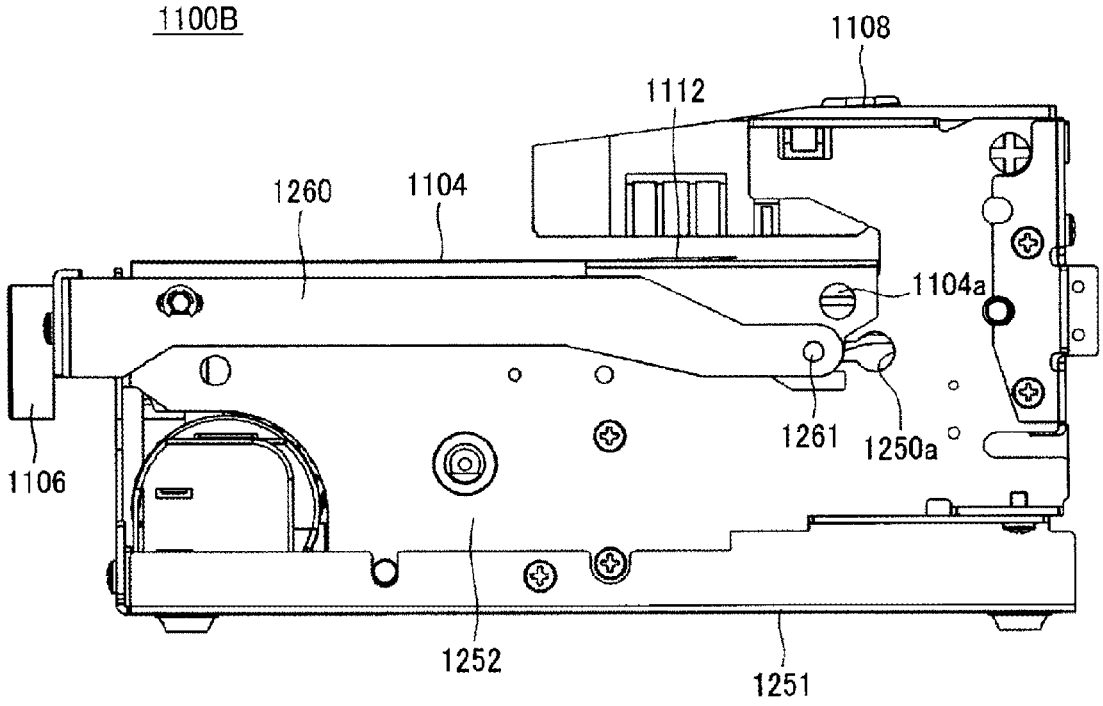
FIG. 47A is an operation diagram of the staple removal device in a case where a protrusion amount of a wedge plate according to the second embodiment 2 is set to a fourth protrusion amount.
Figure 47B:
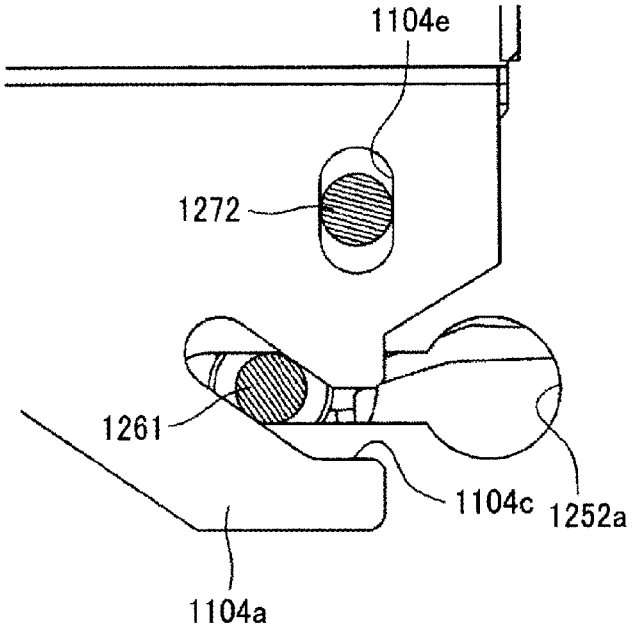
FIG. 47B is an operation diagram of the slide shaft according to the second embodiment 2.
Figure 47C:
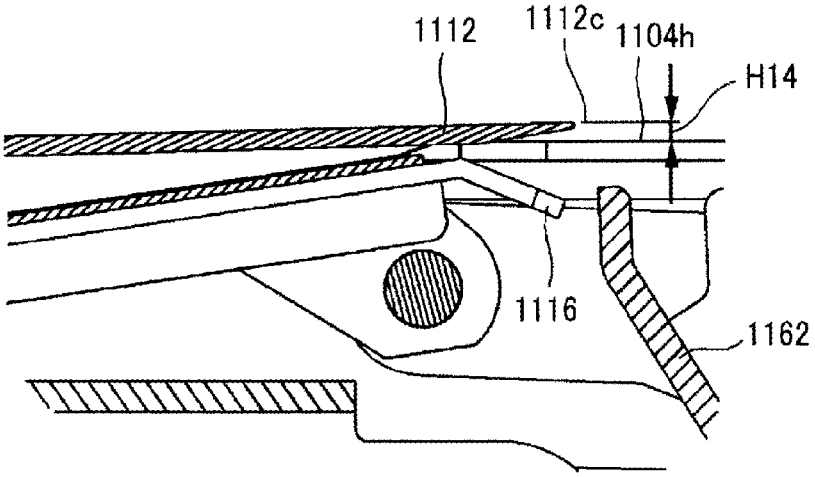
FIG. 47C is an operation diagram of the wedge plate and a placement table according to the second embodiment 2.

FIG. 47A is an operation diagram of the staple removal device 1100B when the protrusion amount of the wedge plate 1112 is set to the fourth protrusion amount H14 according to the second embodiment 2. FIG. 47B is an operation diagram of the slide shaft 1261. FIG. 47C is an operation diagram of the wedge plate 1112 and the placement table 1104.

As shown in FIG. 47A, when the adjustment knob 1106 is set to the intermediate position by the user, as shown in FIG. 47B, the slide shaft 1261 is located substantially in the middle in a long diameter direction of the guide groove 1104*c*, and the stepped guide pin 1272 is located substantially in the middle in a long diameter direction of the long hole 1104*e* of the first attachment portion 1104*a*. As a result, as shown in FIG. 47C, the upper surface 1112*c* of the wedge plate 1112 protrudes from the placement surface 1104*h* by the fourth protrusion amount H14.

Figure 48A:
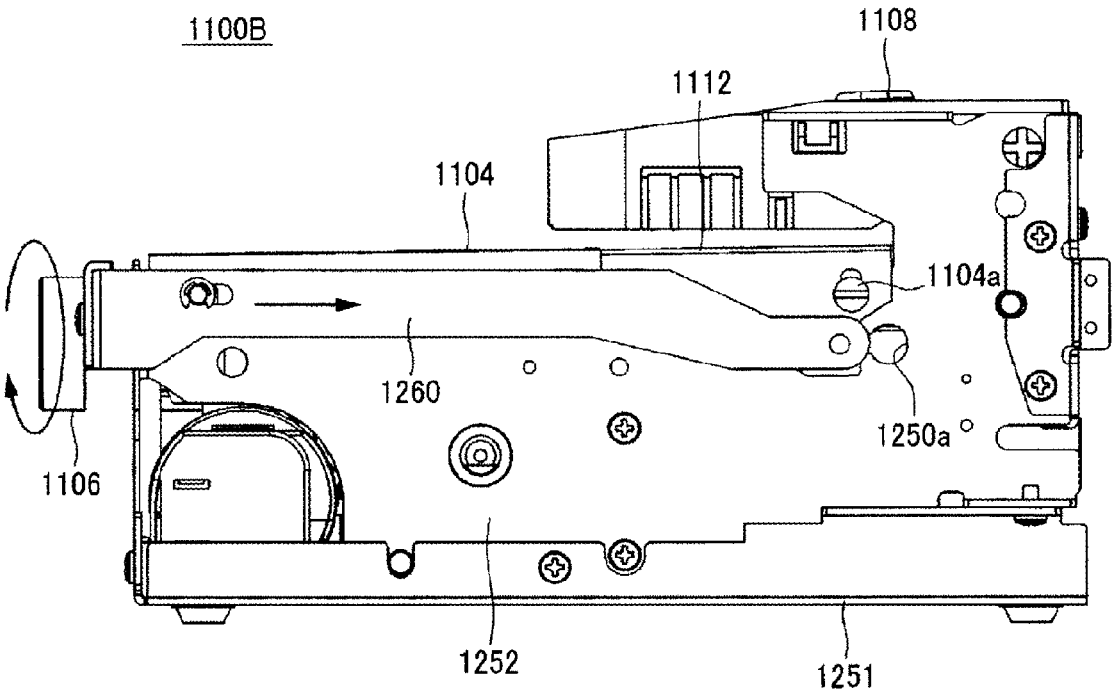
FIG. 48A is an operation diagram of the staple removal device in a case where the protrusion amount of the wedge plate according to the second embodiment 2 is set to a fifth protrusion amount.
Figure 48B:
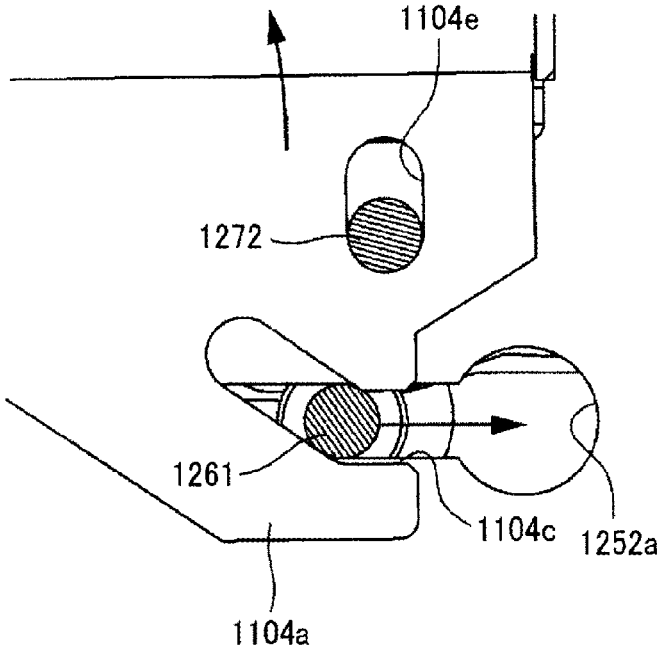
FIG. 48B is an operation diagram of the slide shaft according to the second embodiment 2.
Figure 48C:
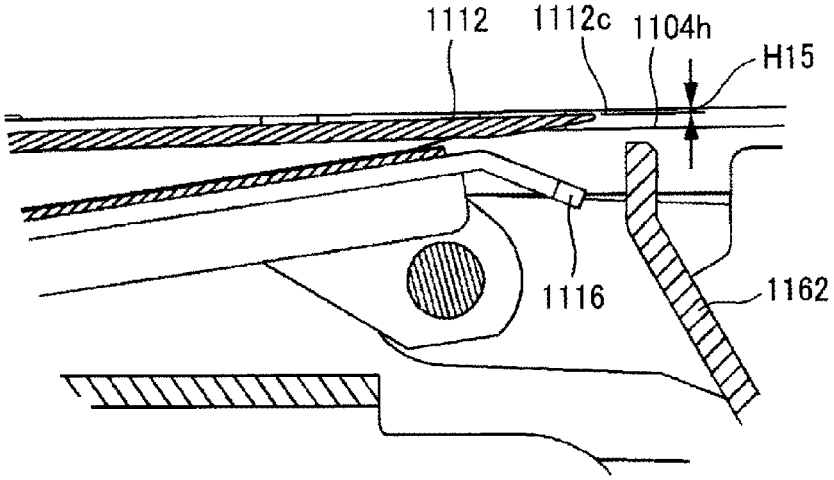
FIG. 48C is an operation diagram of the wedge plate and the placement table according to the second embodiment 2.

FIG. 48A is an operation diagram of the staple removal device 1100B when the protrusion amount of the wedge plate 1112 is set to a fifth protrusion amount H15 according to the second embodiment 2. FIG. 48B is an operation diagram of the slide shaft 1261. FIG. 48C is an operation diagram of the wedge plate 1112 and the placement table 1104.

As shown in FIG. 48A, when the user rotates the adjustment knob 1106 clockwise from the intermediate position by a predetermined angle, the adjustment knob 1106 is moved forward along the adjustment screw 1107, so that the adjustment link 1260 attached to the adjustment knob 1106 is also moved forward. Accordingly, as shown in FIG. 48B, the slide shaft 1261 slides and moves forward along the guide groove 1104*c* of the first attachment portion 1104*a* and the guide groove 1252*a* of the first side wall 1252, so that the first attachment portion 1104*a* is pushed up along the guide groove 1104*c* and the long hole 1104*e*. As shown in FIG. 48C, the placement table 1104 moves in a direction approaching the wedge plate 1112 with the fulcrum shaft 1101 serving as a fulcrum. That is, a height of a tip end side (rear side) of the placement table 1104 is increased. As a result, the upper surface 1112*c* of the wedge plate 1112 has substantially the same height as the placement surface 1104*h*, and has the fifth protrusion amount H15 which is smaller than the fourth protrusion amount H14.

Figure 49A:
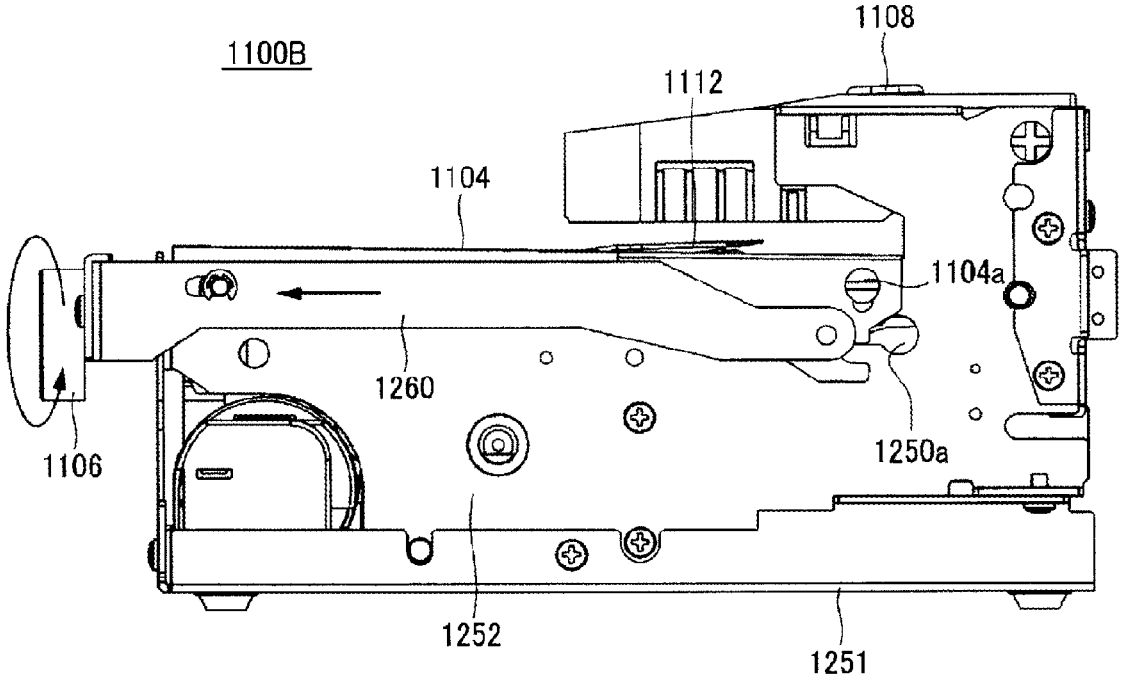
FIG. 49A is an operation diagram of the staple removal device in a case where the protrusion amount of the wedge plate according to the second embodiment 2 is set to a sixth protrusion amount.
Figure 49B:
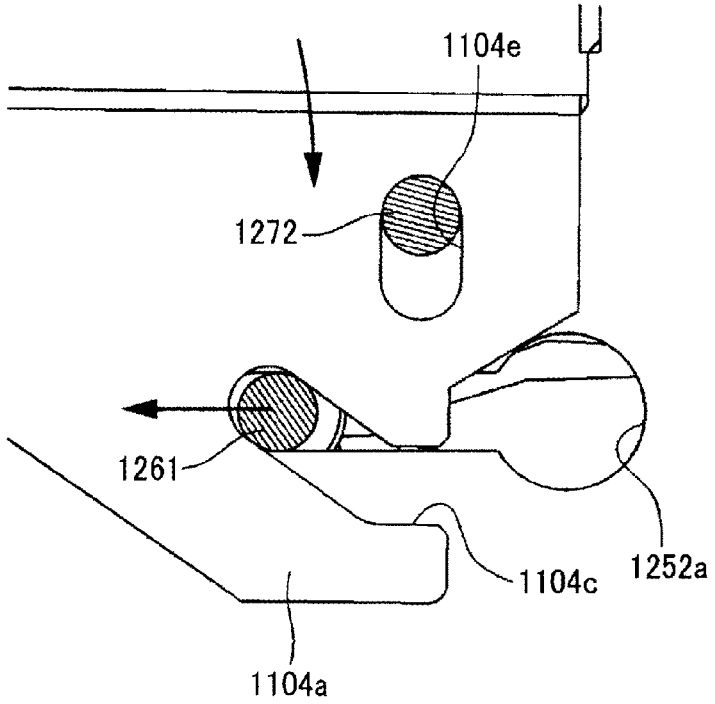
FIG. 49B is an operation diagram of the slide shaft according to the second embodiment 2.
Figure 49C:
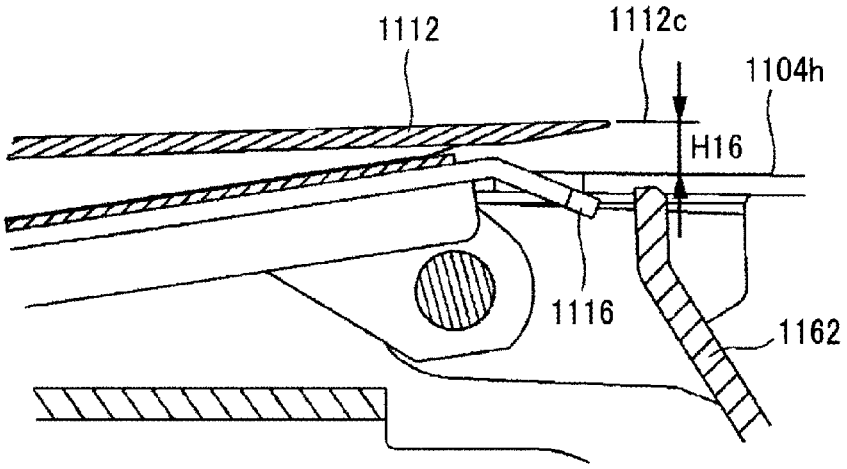
FIG. 49C is an operation diagram of the wedge plate and the placement table according to the second embodiment 2.

FIG. 49A is an operation diagram of the staple removal device 1100B when the protrusion amount of the wedge plate 1112 is set to a sixth protrusion amount H16 according to the second embodiment 2. FIG. 49B is an operation diagram of the slide shaft 1261. FIG. 49C is an operation diagram of the wedge plate 1112 and the placement table 1104.

As shown in FIG. 49A, when the user rotates the adjustment knob 1106 counterclockwise from the intermediate position by a predetermined angle, the adjustment knob 1106 is moved backward along the adjustment screw 1107, so that the adjustment link 1260 attached to the adjustment knob 1106 is also moved backward. Accordingly, as shown in FIG. 49B, the slide shaft 1261 slides and moves backward along the guide groove 1104*c* of the first attachment portion 1104*a* and the guide groove 1252*a* of the first side wall 1252, so that the first attachment portion 1104*a* is pushed down along the guide groove 1104*c* and the long hole 1104*e*. As shown in FIG. 49C, the placement table 1104 is moved in a direction away from the wedge plate 1112 with the fulcrum shaft 1101 serving as a fulcrum. That is, the height of the tip end side of the placement table 1104 is decreased. As a result, the upper surface 1112*c* of the wedge plate 1112 is located at a position protruding from the placement surface 1104*h*, and has the sixth protrusion amount H16 which is larger than the fourth protrusion amount H14.

As described above, according to the second embodiment 2, the adjustment link 1260 is moved in the front-rear direction by operating the adjustment knob 1106, and the front-rear direction movement of the adjustment link 1260 is converted into the up-down direction movement of the placement table 1104. As a result, since the protrusion amount of the wedge plate 1112 relative to the placement table 1104 can be changed in accordance with the types of the paper bundle P10 and the staple S10, even when the types of paper of the paper bundle P10 and the staple S10 subjected to the staple removal or the binding position varies, the optimum protrusion amount of the wedge plate 1112 relative to the placement table 1104 can be set in accordance with various situations such as the types of the paper and the staple S10. As a result, the damage to the paper during the staple removal and the failure of the staple removal can be prevented.

Second Embodiment 3

According to a second embodiment 3, the protrusion amount of the wedge plate 1112 relative to the placement table 1104 is changed by directly changing an attachment position of the wedge plate 1112. Configurations, operations, and the like common to those of the staple removal device 1100A according to the second embodiment 1 are denoted by the same reference numerals, and detailed description thereof will be omitted.

[Configuration Example of Staple Removal Device 1100C]

Figure 50:
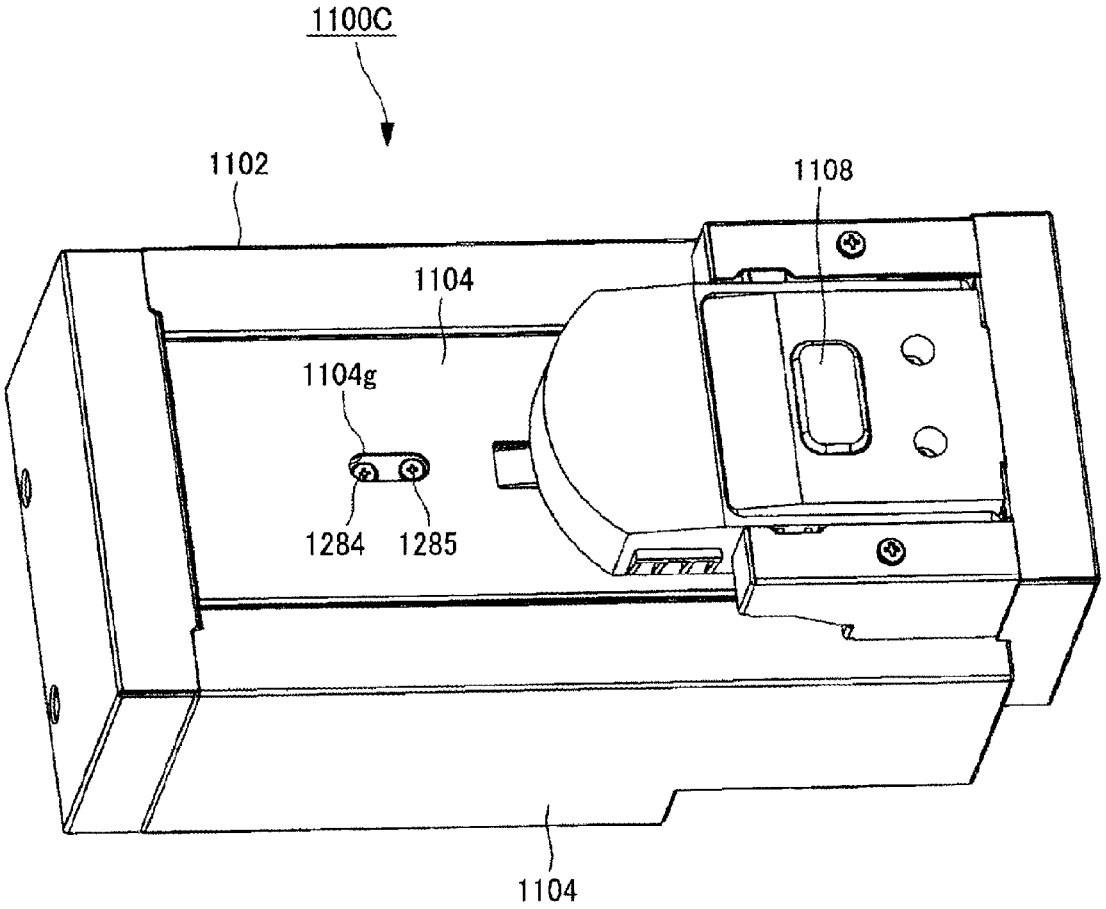
FIG. 50 is a perspective view of a staple removal device according to a second embodiment 3.
Figure 51:
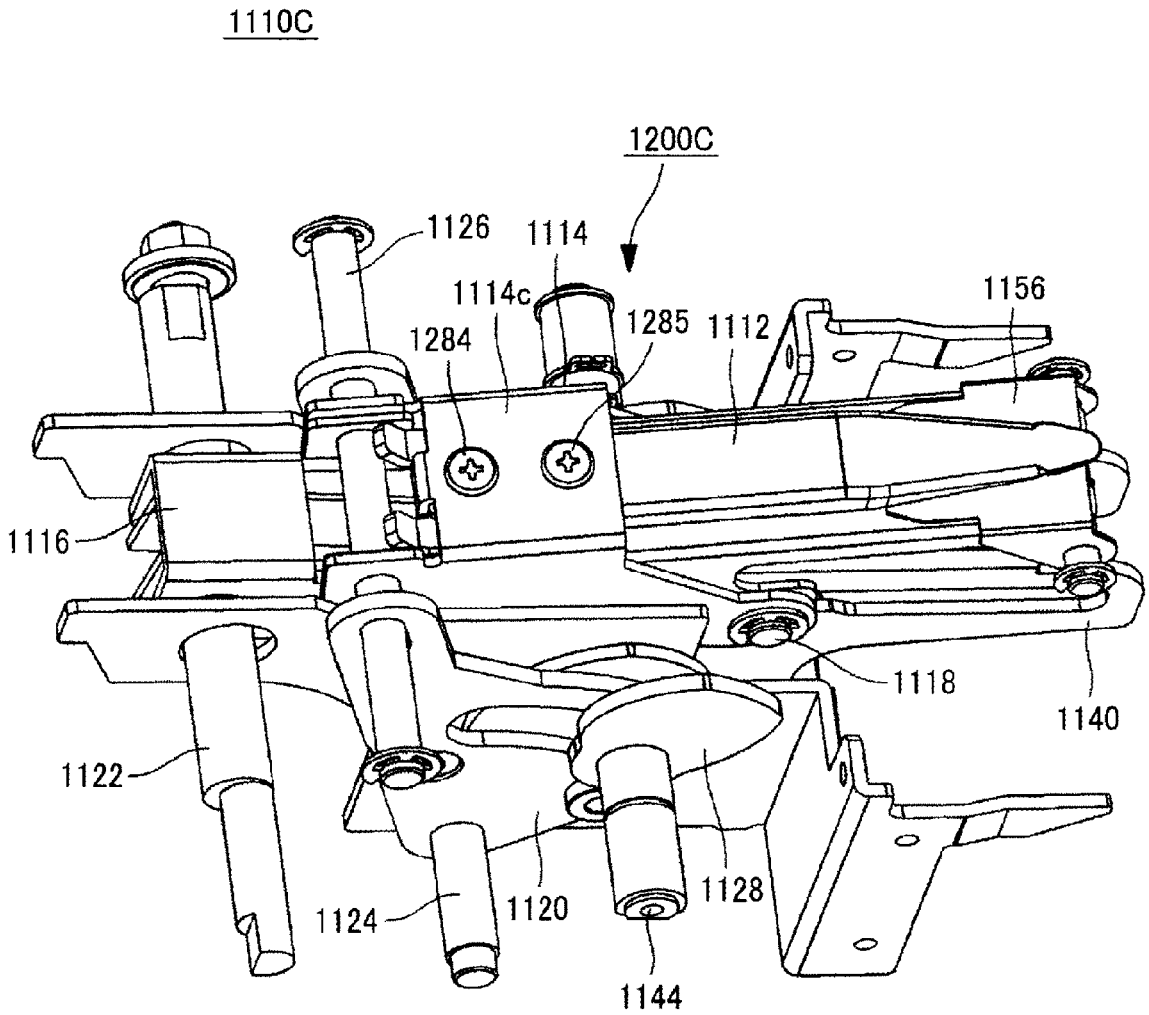
FIG. 51 is a perspective view of the staple removal device according to the second embodiment 3.
Figure 52:
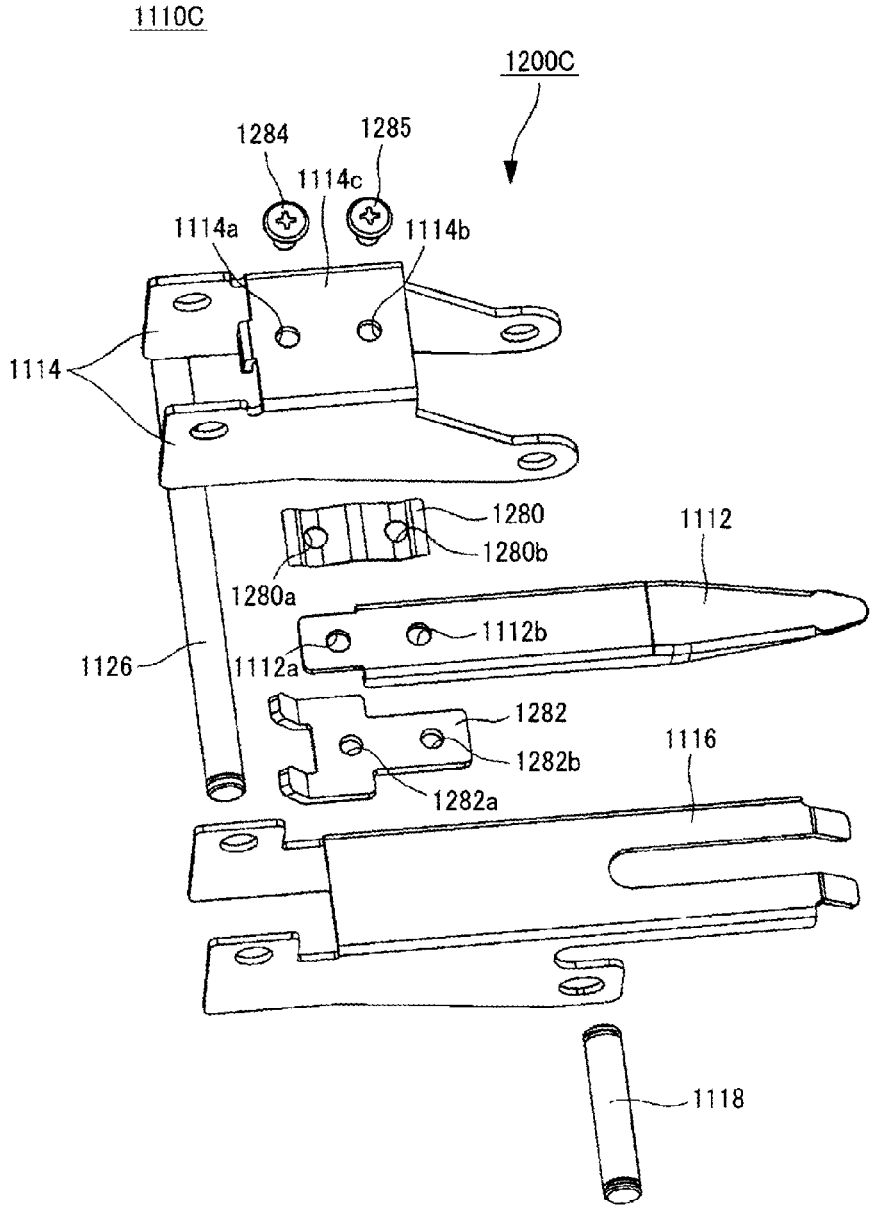
FIG. 52 is an exploded perspective view of a needle removing device according to the second embodiment 3.
Figure 53A:
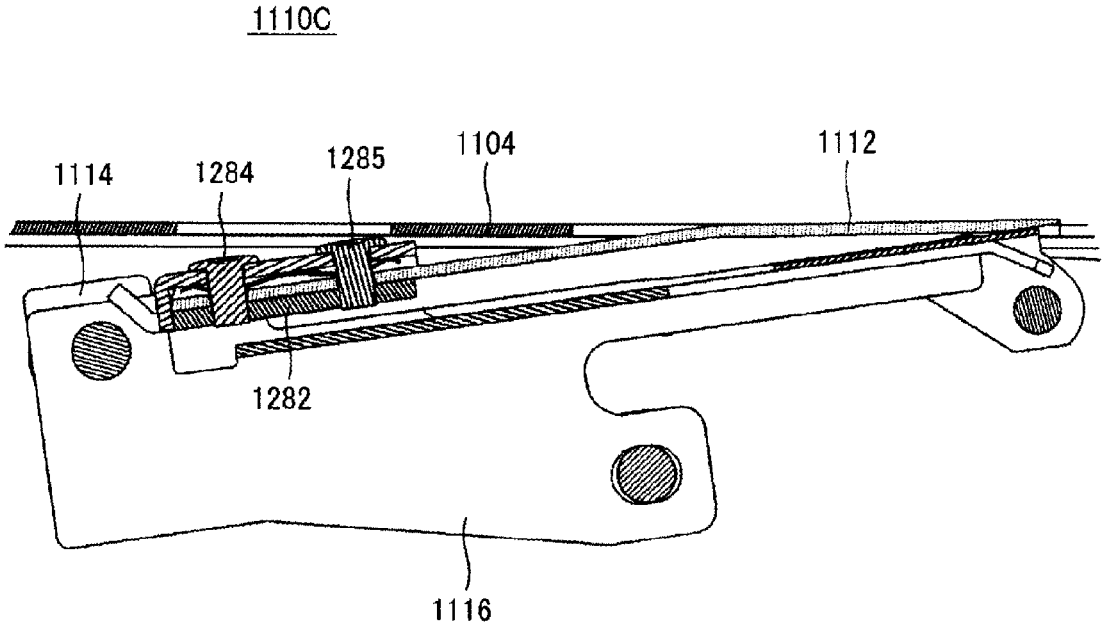
FIG. 53A is a cross-sectional view of the staple removal device according to the second embodiment 3.
Figure 53B:
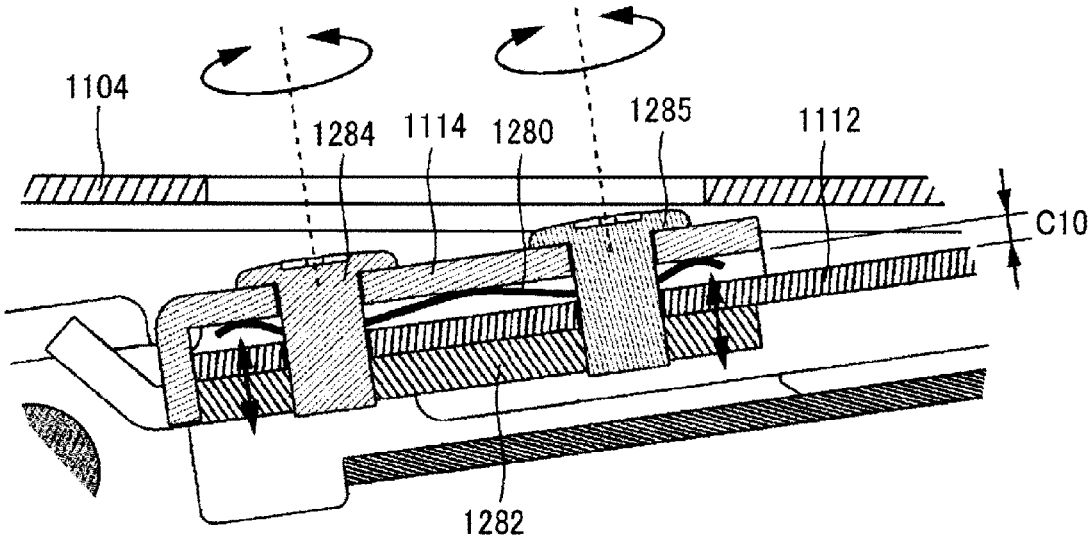
FIG. 53B is a main part enlarged view of FIG. 53A.

FIG. 50 is a perspective view of the staple removal device 1100C according to the second embodiment 3. FIG. 51 is a perspective view of an adjustment mechanism 1200C according to the second embodiment 3. FIG. 52 is an exploded perspective view of the adjustment mechanism 1200C according to the second embodiment 3. FIG. 53A is a cross-sectional view of the adjustment mechanism 1200C according to the second embodiment 3. FIG. 53B is a main part enlarged view of FIG. 53A.

As shown in FIG. 50, an adjustment hole 1104*g* through which a tool is inserted into the housing 1102 to operate adjustment screws 1284 and 1285 is formed in the placement table 1104. The adjustment hole 1104*g* penetrates the placement table 1104 in a thickness direction thereof, and is formed of an opening having an outer shape that can include the two adjustment screws 1284 and 1285. The adjustment hole 1104*g* may also be formed by two openings in accordance with the number of the adjustment screws 1284 and 1285.

As shown in FIGS. 51, 52, 53A, and 53B, a staple pulling mechanism portion 1110C includes the wedge plate holder 1114, the wedge plate 1112, and the adjustment mechanism 1200C. The adjustment mechanism 1200C includes a wave spring 1280, a wedge plate support 1282, and the adjustment screws 1284 and 1285.

Two insertion holes 1114*a* and 1114*b* (see FIG. 52) into which the adjustment screws 1284 and 1285 are inserted are formed in a ceiling surface portion 1114*c* of the wedge plate holder 1114. The wave spring 1280 is provided between the wedge plate 1112 and the wedge plate holder 1114. The wave spring 1280 is configured to bias the wedge plate 1112 and the wedge plate holder 1114 in directions in which the wedge plate 1112 and the wedge plate holder 1114 are separated from each other such that a gap C10 (see FIG. 53B) is constantly widened between the wedge plate 1112 and the wedge plate holder 1114. As a result, rattling of the wedge plate 1112 and the like can be prevented. Two insertion holes 1280*a* and 1280*b* into which the adjustment screws 1284 and 1285 are inserted are formed in the wave spring 1280.

Two insertion holes 1112*a* and 1112*b* (see FIG. 52) into which the adjustment screws 1284 and 1285 are fitted are formed on a base end side of the wedge plate 1112. The wedge plate support 1282 that supports the wedge plate 1112 is provided on a lower surface side of the wedge plate 1112. Two screw holes 1282*a* and 1282*b* (see FIG. 52) into which the adjustment screws 1284 and 1285 are fitted are formed in the wedge plate support 1282.

The adjustment screws 1284 and 1285 are inserted into the insertion holes 1114*a* and 1114*b* of the wedge plate holder 1114, the insertion holes 1280*a* and 1280*b* of the wave spring 1280, and the insertion holes 1112*a* and 1112*b* of the wedge plate 1112 from the side of the ceiling surface portion 1114*c* of the wedge plate holder 1114, and are fitted into the screw holes 1282*a* and 1282*b* of the wedge plate support 1282. In this way, in the staple pulling mechanism portion 1110C, the wedge plate holder 1114, the wave spring 1280, the wedge plate 1112, and the wedge plate support 1282 are integrated.

[Operation Example of Staple Removal Device 1100C]

With reference to FIGS. 53A and 53B, an operation of changing the attachment position of the wedge plate 1112 relative to the placement table 1104 will be described.

When the protrusion amount of the wedge plate 1112 relative to a surface of the placement table 1104 is changed, a tool is inserted into the adjustment hole 1104*g* of the placement table 1104 shown in FIG. 50, and the adjustment screws 1284 and 1285 are rotated clockwise or counterclockwise by the tool.

For example, when the adjustment screws 1284 and 1285 are rotated clockwise by the tool, the wedge plate 1112 and the wedge plate support 1282 are moved in a direction approaching the wedge plate holder 1114 against an elastic force of the wave spring 1280, and the gap C10 between the wedge plate 1112 and the wedge plate holder 1114 becomes narrow. That is, the attachment position of the wedge plate 1112 relative to the placement table 1104 is lifted. As a result, the protrusion amount by which the wedge plate 1112 protrudes from the surface of the placement table 1104 can be increased.

On the other hand, for example, when the adjustment screws 1284 and 1285 are rotated counterclockwise by the tool, the wedge plate 1112 and the wedge plate support 1282 are moved in a direction away from the wedge plate holder 1114, and the gap C10 between the wedge plate 1112 and the wedge plate holder 1114 is widened. That is, the attachment position of the wedge plate 1112 relative to the placement table 1104 is lowered. As a result, the protrusion amount by which the wedge plate 1112 protrudes from the surface of the placement table 1104 can be reduced.

As described above, according to the third embodiment, the attachment position of the wedge plate 1112 is directly changed by operating the adjustment screws 1284 and 1285. As a result, since the protrusion amount of the wedge plate 1112 relative to the placement table 1104 can be changed in accordance with the types of the paper bundle and the staple, even when the types of paper of the paper bundle P10 and the staple subjected to the staple removal or the binding position varies, the optimum protrusion amount of the wedge plate 1112 relative to the placement table 1104 can be set in accordance with various situations such as the types of the paper and the staple S10. As a result, the damage to the paper during the staple removal and the failure of the staple removal can be prevented.

Third Embodiment

Hereinafter, an example of a staple removal device according to a third embodiment will be described with reference to the drawings.

As described above, when the paper bundle is bound by the staple including the crown portion and the pair of leg portions, the pair of leg portions penetrate the paper bundle and then the pair of leg portions are bent inward so as to bind the paper bundle. In related art, as a device configured to removing a staple from a paper bundle bound by the staple, a configuration is known in which an insertion member is inserted between the paper bundle and a crown portion of the staple binding the paper bundle so as to remove the staple from the paper bundle. With such a configuration, it is necessary to raise leg portions, which are bent inward, by an operation of pulling out the leg portions from the paper bundle. Therefore, a force required to pull out the staple is large. Since the force required to pull out the staple is increased, a load is also applied to the paper bundle, and the paper bundle is thus damaged.

In this regard, Patent Literature 2 discloses a binding member removing device including an insertion member which includes a first insertion member and a second insertion member that is movable toward and away from the first insertion member. According to such a binding member removing device, after the insertion member is inserted toward the staple into the paper bundle, the second insertion member is separated from the first insertion member, so that the paper bundle above an insertion position and the staple can be separated from the paper bundle below the insertion position.

According to such a binding member removing device, the insertion member is inserted into the paper bundle, and the second insertion member is separated from the first insertion member, so that the paper bundle is expanded and leg portions of the staple can be raised.

However, according to such a method, even though the leg portion can be raised, the staple remains in the paper bundle above the insertion position, and the entire staple cannot be completely removed from the paper bundle.

Therefore, hereinafter, a staple removal device according to the third embodiment will be described, which is capable of raising a leg portion binding a paper bundle and removing an entire staple from the paper bundle.

In order to allow the leg portion that binds the paper bundle to be raised and allow the entire staple to be removed from the paper bundle, the staple removal device according to the third embodiment includes a placement portion on which the paper bundle is placed, a pressing portion configured to press the paper bundle against the placement portion, a first insertion portion configured to raise the leg portion of the staple that binds the paper bundle, a second insertion portion configured to be inserted between a crown portion of the staple binding the paper bundle and the paper bundle to remove the staple from the paper bundle, and a driving portion configured to engage with the first insertion portion and insert the first insertion portion into the paper bundle from an end surface of the paper bundle sandwiched between the placement portion and the pressing portion. Among the first insertion portion, one end portion facing the end surface of the paper bundle sandwiched between the placement portion and the pressing portion is formed in a wedge shape.

According to the staple removal device according to the third embodiment, when the first insertion portion is moved in a direction approaching the end surface of the paper bundle sandwiched between the placement portion and the pressing portion and the first insertion portion is inserted between paper surfaces of the paper bundle from the end surface of the paper bundle, the paper bundle is expanded at a portion where the first insertion portion is inserted, and thus leg portions of the staple, which are bent inward to bind the paper bundle, are raised. When the second insertion portion is inserted between the crown portion of the staple binding the paper bundle and the paper bundle, the staple is removed from the paper bundle.

According to the staple removal device of the third embodiment, since the leg portions are raised by inserting the first insertion portion between the paper surfaces of the paper bundle, the leg portions can be reliably raised regardless of shapes of the leg portions which are bent inward. Then the staple can be pulled out from the paper bundle by inserting the second insertion portion between the crown portion of the staple binding the paper bundle and the paper bundle in the state where the leg portions are raised. By pulling out the staple from the paper bundle by the second insertion portion in the state where the leg portions are raised, the entire staple can be pulled out from the paper bundle, and a force required for pulling out the staple is also reduced. In order to increase the force required to remove the staple, it is necessary to use a high torque motor and components having high strength corresponding to the high torque, which results in an increase a size and a cost of a device. However, According to the staple removal device according to the third embodiment, since the force required for removing the staple can be reduced, the increase in the size and the cost of the device can be prevented. Since the force required to pull out the staple can be reduced, a load applied on the paper bundle can also be reduced, and thus damage to the paper bundle can be reduced.

<Configuration Example of Staple Removal Device>

Figure 54:
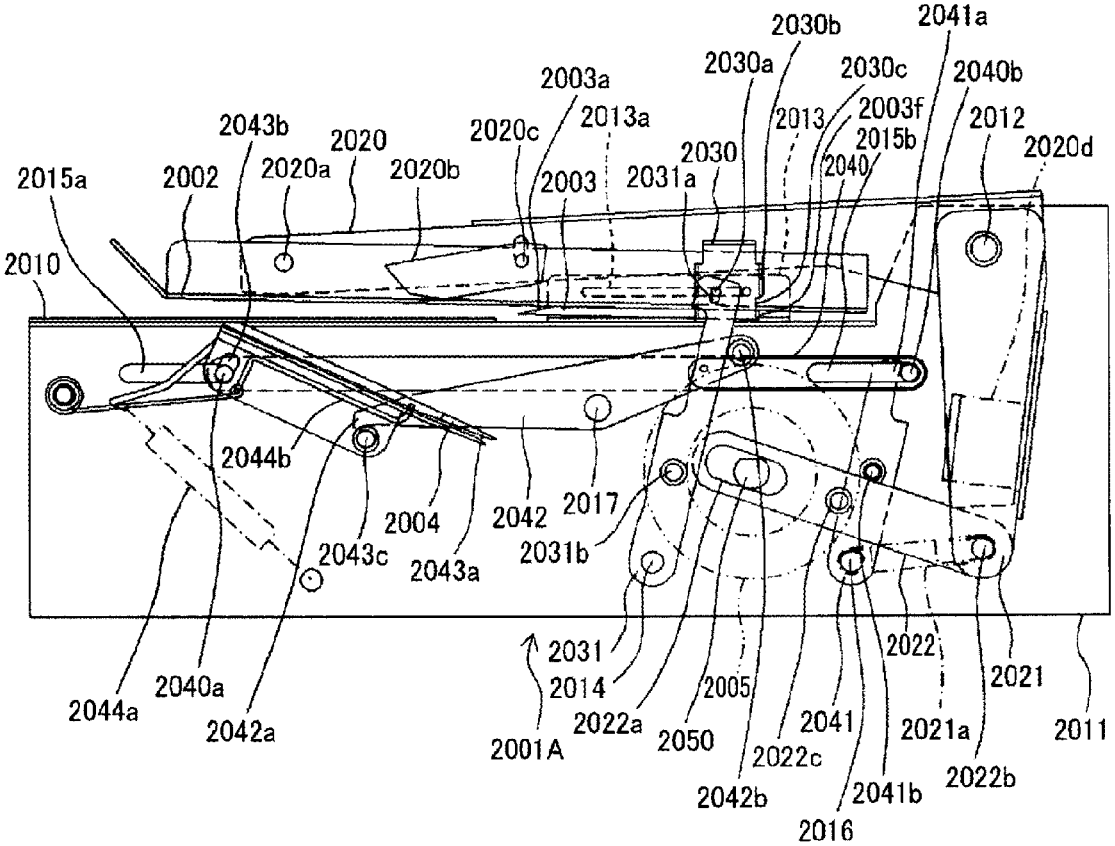
FIG. 54 is a side view showing an example of a staple removal device according to a third embodiment.
Figure 55:
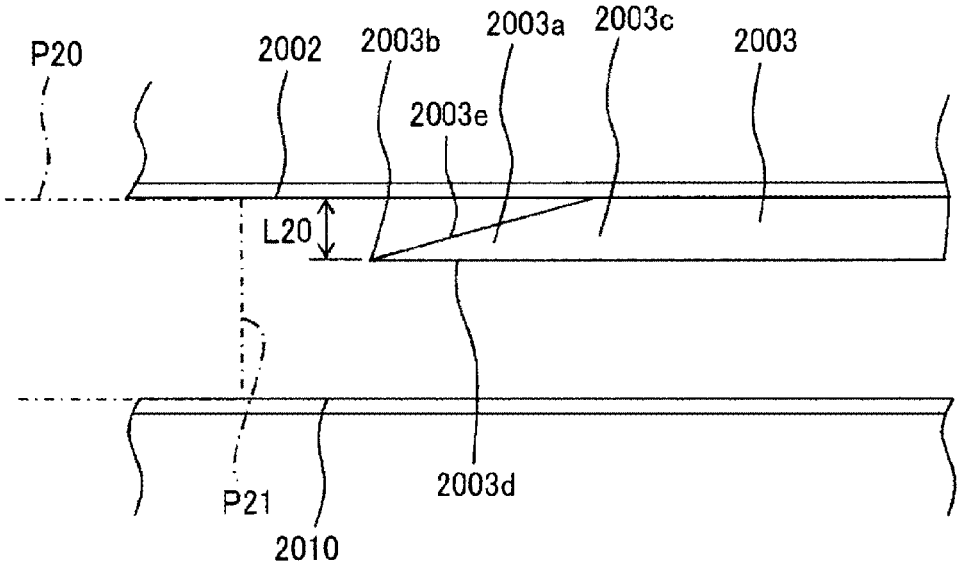
FIG. 55 is a side view showing an example of a leg portion raising plate.
Figure 56A:
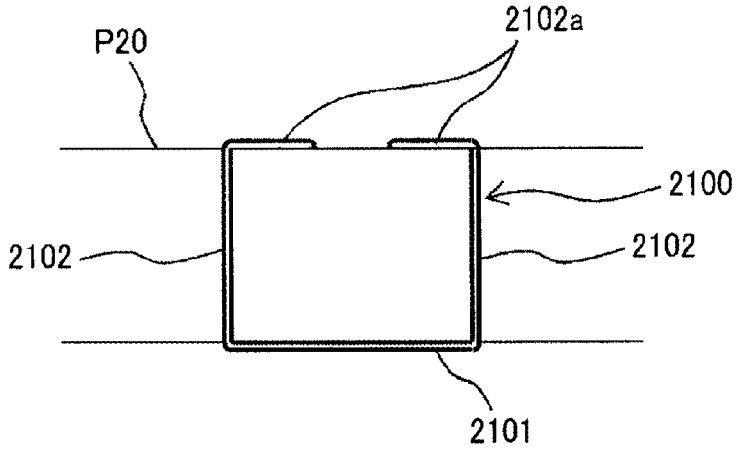
FIG. 56A is an explanatory view showing a state where a paper bundle is bound by a staple.
Figure 57A:
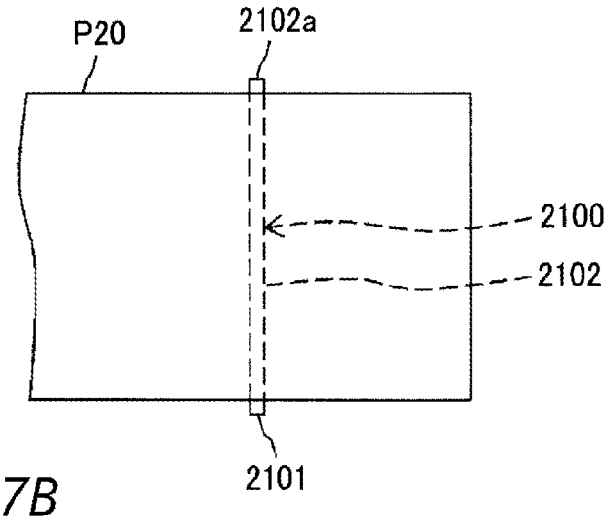
FIG. 57A is an explanatory view showing the state where the paper bundle is bound by the staple.

FIG. 54 is a side view showing an example of the staple removal device according to the third embodiment. FIG. 55 is a side view showing an example of a leg portion raising plate. FIGS. 56A and 57A are explanatory diagrams showing a state where the paper bundle is bound with the staple. First, a form of a staple 2100 binding a paper bundle P20 will be described with reference to FIGS. 56A and 57A.

Two ends of a crown portion 2101 of the staple 2100 are bent in one direction to form a pair of leg portions 2102. The pair of leg portions 2102 of the staple 2100 penetrate the paper bundle P20 and are bent inward. As a result, the paper bundle P20 is bound with the staple 2100.

Next, a staple removal device 2001A configured to remove the staple 2100 from the paper bundle P20 will be described with reference to FIGS. 54 and 55. The staple removal device 2001A includes a table 2010 on which the paper bundle P20 is placed. The table 2010 is an example of a placement portion, and the paper bundle P20 is placed in such a manner that the crown portion 2101 of the staple 2100 binding the paper bundle P20 is faces the table 2010. An opening (not shown) is provided at a position facing the crown portion 2101.

The staple removal device 2001A also includes a paper pressing plate 2002 that presses the paper bundle P20 against the table 2010, a leg portion raising plate 2003 that raises the leg portion 2102 of the staple 2100 binding the paper bundle P20, a wedge plate 2004 that removes the leg portion 2102 from the paper bundle P20, and a cam 2005 that drives the paper pressing plate 2002, the leg portion raising plate 2003, and the wedge plate 2004.

The staple removal device 2001A includes a paper pressing link 2020, a paper pressing drive link 2021, and a paper pressing cam link 2022 that are operated by the cam 2005 so as to move the paper pressing plate 2002 in a direction approaching and a direction away from the table 2010.

The staple removal device 2001A also includes a leg portion raising drive plate 2030 and a leg portion raising plate cam link 2031 which are operated by the cam 2005 so as to move the leg portion raising plate 2003 in a direction along the paper pressing plate 2002.

Further, the staple removal device 2001A includes a wedge plate drive link 2040 and a wedge plate cam link 2041 which are operated by the cam 2005 to move the wedge plate 2004 in a direction along the table 2010, and a wedge plate pull-down link 2042 which moves the wedge plate 2004 in the direction approaching and the direction away from the table 2010.

The paper pressing plate 2002 is an example of the pressing portion, and is provided to face the table 2010. The paper pressing link 2020 extends in a front-rear direction, which is the direction along the table 2010. The paper pressing plate 2002 is attached to one end portion of the paper pressing link 2020 so as to be rotatable about a shaft 2020*a* which serves as a fulcrum. The other end portion of the paper pressing link 2020 is rotatably attached to a shaft 2012 provided on a body portion 2011 of the staple removal device 2001A. The paper pressing link 2020 includes a pressing member 2020*b* that retracts upward when the leg portion raising plate 2003 is inserted into the paper bundle P20 to push up a part of the paper bundle P20. The pressing member 2020*b* is attached to be rotatable about a shaft 2020*c* which serves as a fulcrum.

The paper pressing drive link 2021 extends in an up-down direction which is a direction intersecting the table 2010. An upper end portion of the paper pressing drive link 2021 is rotatably attached to the shaft 2012 of the body portion 2011. The paper pressing link 2020 and the paper pressing drive link 2021 are connected via a biasing member 2020*d* such as a coil spring, and rotate in conjunction with each other about the shaft 2012 which serves as a fulcrum. The paper pressing plate 2002 is moved in the direction approaching and the direction away from the table 2010 by rotation of the paper pressing link 2020 and the paper pressing drive link 2021 about the shaft 2012 which serves as the fulcrum. By rotating the paper pressing plate 2002 relative to the paper pressing link 2020 about the shaft 2020*a* which serves as the fulcrum, the paper pressing plate 2002 maintains a substantially parallel orientation relative to the table 2010 regardless of a distance between the paper pressing plate 2002 and the table 2010.

A lower end portion of the paper pressing drive link 2021 is connected to the body portion 2011 by a biasing member 2021*a* such as a tension coil spring. By rotating the paper pressing drive link 2021 about the shaft 2012 which serves as the fulcrum, the paper pressing plate 2002 is biased by the biasing member 2021*a* in the direction away from the table 2010.

A long hole 2022*a* into which a drive shaft 2050 configured to rotate the cam 2005 is inserted is provided in one end portion of the paper pressing cam link 2022. The paper pressing drive link 2021 is attached to the other end portion of the paper pressing cam link 2022 so as to be rotatable about an axis 2022*b* which serves as a fulcrum. Further, the paper pressing cam link 2022 is connected to the cam 2005 by a pin 2022*c* provided between the long hole 2022*a* and the shaft 2022*b*.

When the pin 2022*c* is moved following a cam surface (not shown) of the cam 2005, the paper pressing cam link 2022 is moved along an extending direction of the long hole 2022*a* and rotated about the drive shaft 2050 which serves as a fulcrum such that the paper pressing drive link 2021 is rotated about the shaft 2012 which serves as the fulcrum.

The leg portion raising plate 2003 is an example of the first insertion portion, and is attached to a surface of the paper pressing plate 2002 facing the table 2010 at a position facing an end surface P21 of the paper bundle P20 so as to be movable in the front-rear direction along the paper pressing plate 2002. One end portion 2003*a* of the leg portion raising plate 2003 along a moving direction thereof is formed in a wedge shape. The one end portion 2003*a* of the leg portion raising plate 2003 is a portion facing the end surface P21 of the paper bundle P20 placed on the table 2010. The one end portion 2003*a* of the leg portion raising plate 2003 has a shape whose thickness along the up-down direction, which is the direction intersecting the table 2010, gradually increases from a tip end 2003*b* toward a base portion 2003*c*. A thickness of the base portion 2003*c* is preferably 1.5 mm or more. A width of the one end portion 2003*a* of the leg portion raising plate 2003 is shorter than a distance between the pair of leg portions 2102.

The one end portion 2003*a* of the leg portion raising plate 2003 is configured such that a first surface 2003*d* facing the table 2010 is a flat surface parallel to the table 2010 when the paper pressing plate 2002 is parallel to the table 2010. The one end portion 2003*a* of the leg portion raising plate 2003 has a second surface 2003*e* facing the paper pressing plate 2002. The second surface 2003*e* is formed of an inclined surface inclined relative to the first surface 2003*d*. A distance L20 between the tip end 2003*b* of the one end portion 2003*a* of the leg portion raising plate 2003 and the paper pressing plate 2002 is constant regardless of a position of the paper pressing plate 2002 relative to the table 2010.

The leg portion raising drive plate 2030 is an example of the driving portion. The leg portion raising drive plate 2030 is guided by a guide hole 2013*a* of a guide 2013 provided on the body portion 2011, and is attached to be movable along the table 2010. The guide hole 2013*a* is a long hole extending in the direction along the table 2010, and a shaft 2030*a* provided on the leg portion raising drive plate 2030 is inserted therein.

The leg portion raising drive plate 2030 includes an engagement portion 2030*b* that engages with the leg portion raising plate 2003. The engagement portion 2030*b* is configured by providing a portion which is standing relative to a moving direction of the leg portion raising drive plate 2030, and engages with the other end portion 2003*f* of the leg portion raising plate 2003.

The leg portion raising drive plate 2030 includes a non-engagement portion 2030*c* between the engagement portion 2030*b* and the table 2010. The non-engagement portion 2030*c* is configured by providing a space through which the leg portion raising plate 2003 can pass between the engagement portion 2030*b* and the table 2010.

The shaft 2030*a* of the leg portion raising drive plate 2030 is inserted into the guide hole 2013*a* of the guide 2013 provided on the body portion 2011, so that a distance between the engagement portion 2030*b* and the table 2010 is constant. Meanwhile, the leg portion raising plate 2003 is attached to the paper pressing plate 2002. A distance between the paper pressing plate 2002 and the table 2010 changes in accordance with a thickness of the paper bundle P20. As a result, when the thickness of the paper bundle P20 is thin, a distance between the leg portion raising plate 2003 and the table 2010 is closer as compared with a case where the thickness of the paper bundle P20 is thick.

When the thickness of the paper bundle P20 is equal to or greater than a predetermined thickness, the other end portion 2003*f* of the leg portion raising plate 2003 faces the engagement portion 2030*b* of the leg portion raising drive plate 2030, and is located in a movement path of the engagement portion 2030*b*. On the other hand, when the thickness of the paper bundle P20 is less than the predetermined thickness, the other end portion 2003*f* of the leg portion raising plate 2003 faces the non-engagement portion 2030*c* of the leg portion raising drive plate 2030 and is retracted from the movement path of the engagement portion 2030*b*. As a result, engagement and non-engagement between the engagement portion 2030*b* of the leg portion raising drive plate 2030 and the leg portion raising plate 2003 are switched in accordance with the thickness of the paper bundle P20.

An upper end portion of the leg portion raising plate cam link 2031 is provided with a long hole 2031*a* into which the shaft 2030*a* provided on the leg portion raising drive plate 2030 is inserted. A lower end portion of the leg portion raising plate cam link 2031 is rotatably attached to a shaft 2014 provided on the body portion 2011. Further, the leg portion raising plate cam link 2031 is connected to the cam 2005 by a pin 2031*b* provided between the long hole 2031*a* and the shaft 2014.

The leg portion raising plate cam link 2031 is rotated about the shaft 2014 which serves as a fulcrum when the pin 2031*b* is moved following the cam surface (not shown) of the cam 2005. Among the leg portion raising plate cam link 2031, a portion connected to the shaft 2030*a* provided on the leg portion raising drive plate 2030 is formed as the long hole 2031*a*, and thus the shaft 2030*a* is moved along the long hole 2031*a* due to the rotation of the leg portion raising plate cam link 2031 about the shaft 2014 which serves as the fulcrum. As a result, when the leg portion raising plate cam link 2031 is rotated about the shaft 2014 which serves as the fulcrum, the leg portion raising drive plate 2030 is guided by the guide hole 2013*a* of the guide 2013 provided on the body portion 2011 and moved linearly.

Figure 58A:
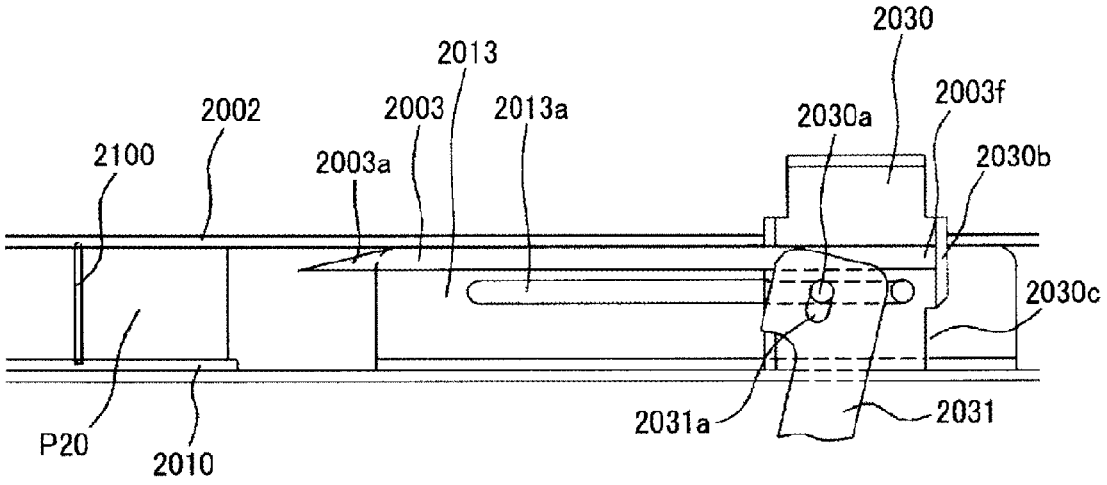
FIG. 58A is an explanatory view showing a state where the leg portion raising plate is engaged with a leg portion raising drive plate.
Figure 58B:
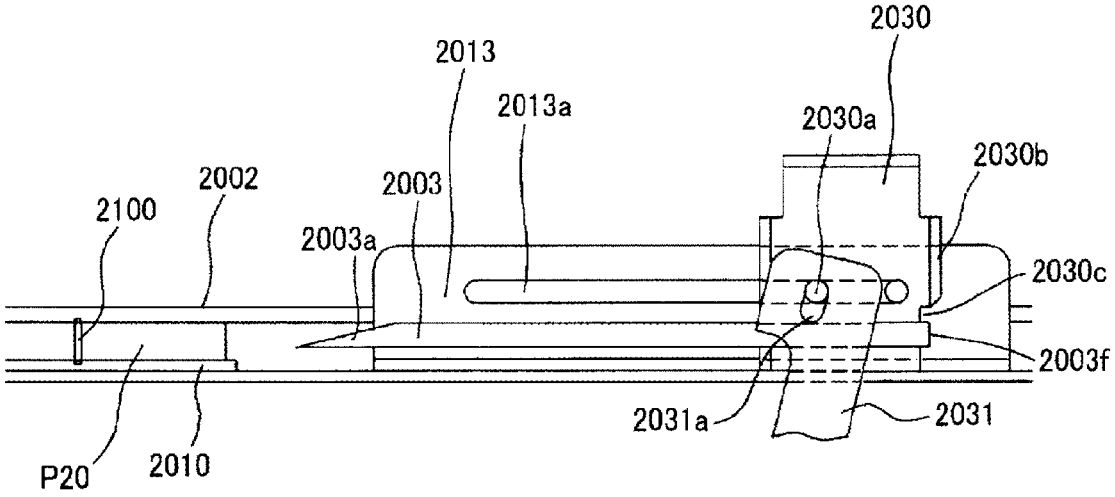
FIG. 58B is an explanatory view showing the state where the leg portion raising plate is engaged with the leg portion raising drive plate.

FIGS. 58A and 58B are explanatory views showing an engagement state between the leg portion raising plate 2003 and the leg portion raising drive plate 2030. As shown in FIG. 58A, when the thickness of the paper bundle P20 is equal to or greater than the predetermined thickness, the other end portion 2003*f* of the leg portion raising plate 2003 faces the engagement portion 2030*b* of the leg portion raising drive plate 2030, and is located in the movement path of the engagement portion 2030*b*. As a result, when the leg portion raising drive plate 2030 is moved, the engagement portion 2030*b* of the leg portion raising drive plate 2030 engages with the leg portion raising plate 2003, and thus the leg portion raising plate 2003 is moved. On the other hand, as shown in FIG. 58B, when the thickness of the paper bundle P20 is less than the predetermined thickness, the other end portion 2003*f* of the leg portion raising plate 2003 faces the non-engagement portion 2030*c* of the leg portion raising drive plate 2030 and is retracted from the movement path of the engagement portion 2030*b*. As a result, even when the leg portion raising drive plate 2030 is moved, the engagement portion 2030*b* of the leg portion raising drive plate 2030 does not engage with the leg portion raising plate 2003, and thus the leg portion raising plate 2003 is not moved.

The wedge plate 2004 is an example of the second insertion portion. The wedge plate 2004 is arranged at a position facing the one end portion 2003*a* of the leg portion raising plate 2003. A wedge portion 2043*a* is formed on one end portion of the wedge plate 2004, while a long hole 2043*b* is formed on an opposite side of a portion where the wedge portion 2043*a* is formed. The wedge plate drive link 2040 extends in the front-rear direction along the table 2010, and a shaft 2040*a* provided on one end of the wedge plate drive link 2040 is inserted into the long hole 2043*b* of the wedge plate 2004. As a result, the wedge plate 2004 is attached to the wedge plate drive link 2040 so as to be rotatable about the shaft 2040*a* which serves as a fulcrum. The wedge portion 2043*a* is moved in the direction approaching and the direction away from the table 2010 due to the rotation of the wedge plate 2004 about the shaft 2040*a* which serves as the fulcrum.

The wedge plate drive link 2040 is an example of a needle removal driving portion, and the shaft 2040*a* is inserted into one long hole 2015*a* provided in the body portion 2011. A shaft 2040*b* provided on the other end portion of the wedge plate drive link 2040 is inserted into the other long hole 2015*b* provided in the body portion 2011. The long holes 2015*a* and 2015*b* extend in the front-rear direction along the table 2010. As a result, the wedge plate drive link 2040 is moved along the table 2010. The wedge plate 2004 attached to the wedge plate drive link 2040 is also moved along the table 2010.

The other end portion of the wedge plate 2004 is connected to the body portion 2011 by a biasing member 2044*a* such as a tension coil spring. The wedge portion 2043*a* is biased by the biasing member 2044*a* in the direction approaching the table 2010 when the wedge plate 2004 is rotated about the shaft 2040*a* which serves as the fulcrum. The wedge plate 2004 also includes a removal member 2044*b* that removes the staple 2100 pulled out from the paper bundle P20 from the wedge plate 2004. The removal member 2044*b* is provided below the wedge plate 2004, and is rotated following the rotation of the wedge plate 2004 about the shaft 2040*a* which serves as the fulcrum. A position of the removal member 2044*b* is fixed with respect to the movement of the wedge plate 2004 along the table 2010. The staple 2100 which is pulled out from the paper bundle P20 and held by the wedge plate 2004 is removed from the wedge plate 2004 by relative movement between the wedge plate 2004 and the removal member 2044*b*.

A connecting portion 2041*a* which is connected to the shaft 2040*b* provided on the wedge plate drive link 2040 is provided on an upper end portion of the wedge plate cam link 2041. The connecting portion 2041*a* is formed by an end surface of the wedge plate cam link 2041 that is in contact with the shaft 2040*b*. A lower end portion of the wedge plate cam link 2041 is rotatably attached to a shaft 2016 provided on the body 2011. Further, the wedge plate cam link 2041 is connected to the cam 2005 by a pin 2041*b* provided between the connecting portion 2041*a* and the shaft 2016.

The wedge plate cam link 2041 is rotated about the shaft 2016 which serves as a fulcrum when the pin 2041*b* is moved following the cam surface (not shown) of the cam 2005. The wedge plate drive link 2040 connected to the wedge plate cam link 2041 is moved along the table 2010 due to the rotation of the wedge plate cam link 2041 about the shaft 2016 which serves as the fulcrum.

One end portion of the wedge plate pull-down link 2042 is provided with a connecting portion 2042*a* connected to a shaft 2043*c* provided on the wedge plate 2004. The connecting portion 2042*a* is formed by an end surface of the wedge plate pull-down link 2042 which is detachably in contact with the shaft 2043*c*. The wedge plate pull-down link 2042 is connected to the cam 2005 by a pin 2042*b* provided on the other end portion. Further, the wedge plate pull-down link 2042 is rotatably attached between the connecting portion 2042*a* and the pin 2042*b* to a shaft 2017 provided on the body portion 2011.

The wedge plate pull-down link 2042 is rotated about the shaft 2017 which serves as a fulcrum when the pin 2042*b* is moved following the cam surface (not shown) of the cam 2005. The wedge plate 2004 connected to the wedge plate pull-down link 2042 is moved in the direction away from the table 2010 due to the rotation of the wedge plate pull-down link 2042 about the shaft 2017 which serves as the fulcrum.

<Operation Example of Staple Removal Device>

Figure 59:
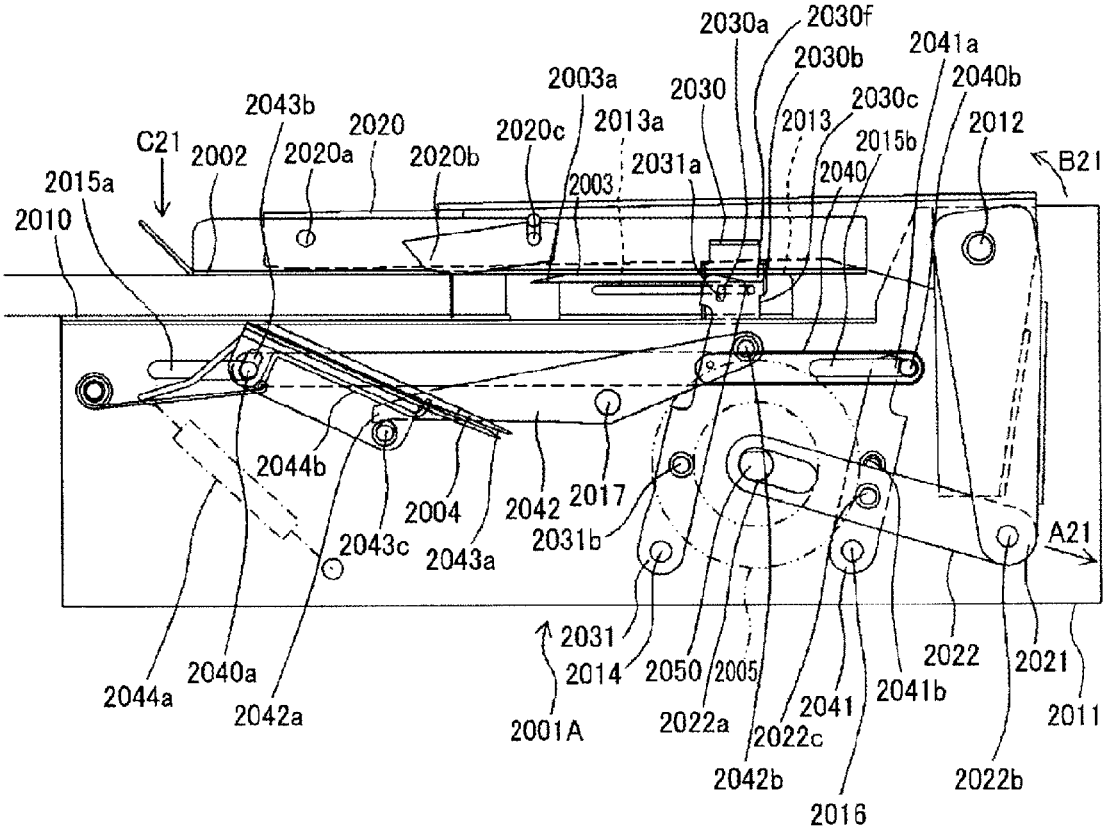
FIG. 59 is a side view showing an operation example of the staple removal device according to the third embodiment.

FIGS. 56B, 56C, 57B, and 57C are explanatory views showing an operation of raising the leg portion and pulling out the staple from the paper bundle. FIGS. 59, 60, 61, 62, and 63 are side views showing an operation example of the staple removal device according to the third embodiment. As shown in FIG. 59, when the paper bundle P20 is placed on the table 2010 and a switch (not shown) is operated, the cam 2005 is rotated in a predetermined direction. When the cam 2005 is rotated, the pin 2022*c* is moved following the cam surface (not shown) of the cam 2005, and thus the paper pressing cam link 2022 is moved in a direction of an arrow A21 along the extending direction of the long hole 2022*a*.

When the paper pressing cam link 2022 is moved in the direction of the arrow A21, the paper pressing drive link 2021 connected by the shaft 2022*b* to the paper pressing cam link 2022 and the paper pressing link 2020 connected by the shaft 2012 to the paper pressing drive link 2021 are rotated in a direction of an arrow B21 with the shaft 2012 serving as a fulcrum.

When the paper pressing link 2020 is rotated about the shaft 2012 in the direction of the arrow B21, the paper pressing plate 2002 connected by the shaft 2020*a* to the paper pressing link 2020 is moved in a direction of an arrow C21 to approach the table 2010. As a result, the paper pressing link 2020 is biased by the biasing member 2020*d*, and the paper bundle P20 is sandwiched between the table 2010 and the paper pressing plate 2002.

Figure 60:
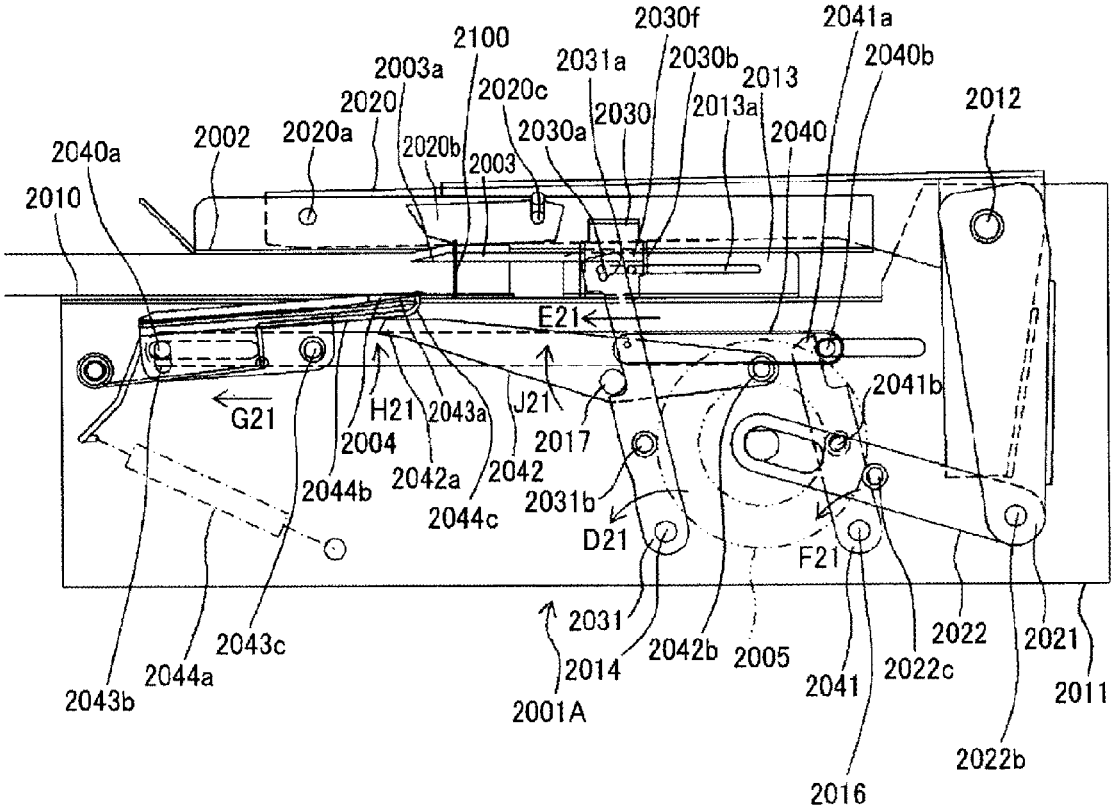
FIG. 60 is a side view showing an operation example of the staple removal device according to the third embodiment.

As shown in FIG. 60, when the cam 2005 is further rotated, the pin 2032*b* is moved following the cam surface (not shown) of the cam 2005, so that the leg portion raising plate cam link 2031 is rotated in a direction of an arrow D21 about the shaft 2014 which serves as a fulcrum.

When the leg portion raising plate cam link 2031 is rotated in the direction of the arrow D21 about the shaft 2014 which serves as the fulcrum, the leg portion raising drive plate 2030 connected by the shaft 2030*a* to the leg portion raising plate cam link 2031 is guided by the guide hole 2013*a* of the guide 2013 and moved in a direction of an arrow E21 along a surface of the table 2010.

It is assumed that the thickness of the paper bundle P20 is equal to or higher than the predetermined thickness. As shown in FIG. 58A, the other end portion 2003*f* of the leg portion raising plate 2003 faces the engagement portion 2030*b* of the leg portion raising drive plate 2030, and is located in the movement path of the engagement portion 2030*b*. As a result, when the leg portion raising drive plate 2030 is moved in the direction of the arrow E21, the engagement portion 2030*b* of the leg portion raising drive plate 2030 engages with the leg portion raising plate 2003, and thus the leg portion raising plate 2003 is moved in the direction of the arrow E21 along the surface of the table 2010.

When the leg portion raising plate 2003 is moved in the direction of the arrow E21, the one end portion 2003*a* of the leg portion raising plate 2003 is moved from a position away from the end surface P21 of the paper bundle P20 in an approaching direction. When the leg portion raising plate 2003 is further moved in the direction of the arrow E21 from a position where the tip end 2003*b* of the one end portion 2003*a* is in contact with the end surface P21 of the paper bundle P20, the leg portion raising plate 2003 is inserted into the paper bundle P20 from the end surface P21 since the one end portion 2003*a* of the leg portion raising plate 2003 has the wedge shape.

Since the thickness of the one end portion 2003*a* of the leg portion raising plate 2003 gradually increases from the tip end 2003*b* toward the base portion 2003*c*, a distance between one side and the other side of the paper bundle P20 in which the leg portion raising plate 2003 is inserted increases. Since the paper bundle P20 is sandwiched between the paper pressing plate 2002 and the table 2010, the first surface 2003*d* of the one end portion 2003*a* of the leg portion raising plate 2003 facing the table 2010 becomes a flat surface parallel to the table 2010 when the paper pressing plate 2002 is parallel to the table 2010. The second surface 2003*e*, which faces the paper pressing plate 2002, of the one end portion 2003*a* of the leg portion raising plate 2003 becomes an inclined surface inclined relative to the first surface 2003*d*.

Figure 56B:
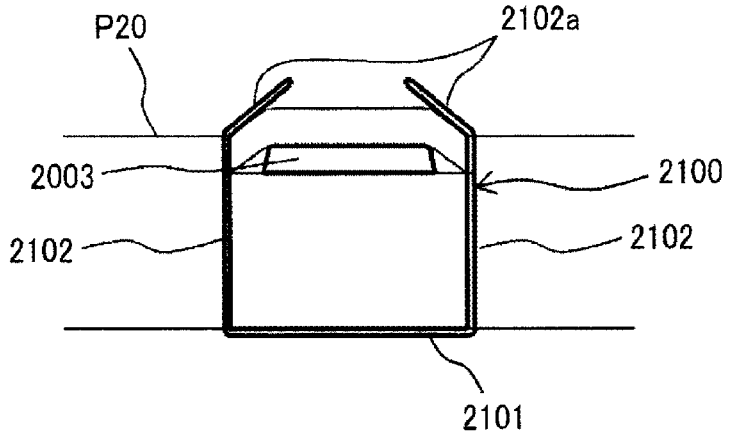
FIG. 56B is an explanatory view showing an operation of pulling out the staple from the paper bundle by raising a leg portion.
Figure 57B:
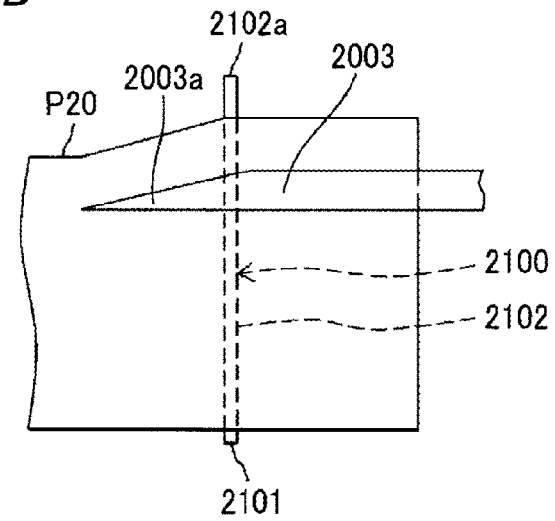
FIG. 57B is an explanatory view showing the operation of pulling out the staple from the paper bundle by raising the leg portion.

As a result, a side bound by the leg portion 2102, which is one side where the leg portion raising plate 2003 is inserted in the paper bundle P20, is expanded in a direction away from the side of the crown portion 2101, which is the other side. When the side of the paper bundle P20 bound by the leg portion 2102 is expanded in the direction away from the other side, a force is applied in a direction in which the bent-inward leg portion 2102*a* is raised. As a result, as shown in FIGS. 56B and 57B, the bent-inward leg portion 2102*a* is raised by a predetermined amount. When a part of the paper bundle P20 is pushed up due to the insertion of the leg portion raising plate 2003 into the paper bundle P20, the pressing member 2020*b* of the paper pressing plate 2002 is retracted upward. As a result, in the state where the paper bundle P20 is pressed by the paper pressing plate 2002, a part of the paper bundle P20 is pushed up by the leg portion raising plate 2003, and the leg portion 2102 is raised. It should be noted that the leg portion 2102 cannot be raised if the thickness of the base portion 2003*c* is 1.0 mm, and the leg portion 2102 cannot be sufficiently raised if the thickness of the base portion 2003*c* is less than 1.5 mm. Therefore, the thickness of the base portion 2003*c* is preferably 1.5 mm or more. The distance L20 between the tip end 2003*b* of the one end portion 2003*a* of the leg portion raising plate 2003 and the paper pressing plate 2002 is constant regardless of the position of the paper pressing plate 2002 relative to the table 2010. As a result, when the thickness of the paper bundle P20 is equal to or greater than the predetermined thickness, the portion into which the leg portion raising plate 2003 is inserted is substantially the same from an upper surface of the paper bundle P20 regardless of the number of pieces of paper. Therefore, the leg portion 2102 can be reliably raised regardless of the number of pieces of paper. When a basis weight of the paper is about 65 gsm, the portion into which the leg portion raising plate 2003 is inserted is a position of about 20 pieces of paper from the upper surface of the paper bundle P20. As described above, according to the present embodiment, since the leg portion 2102 can be raised only by inserting the leg portion raising plate 2003 which is formed of a single member into the paper bundle, a complicated mechanism for rotating the second insertion member relative to the first insertion member as in the binding member removing device described in Patent Literature 1 is not required.

Due to the rotation of the cam 2005 that moves the leg portion raising drive plate 2030 in the direction of the arrow E21, the wedge plate cam link 2041 is rotated in the direction of the arrow F21 about the shaft 2016 which serves as the fulcrum when the pin 2041*b* is moved following the cam surface (not shown) of the cam 2005.

When the wedge plate cam link 2041 is rotated about the shaft 2016 which serves as the fulcrum in the direction of the arrow F21, the wedge plate drive link 2040 connected to the wedge plate cam link 2041 is moved in a direction of an arrow G21 along the table 2010.

When the wedge plate drive link 2040 is moved in the direction of the arrow G21, the wedge plate 2004 connected by the shaft 2040*a* to the wedge plate drive link 2040 is moved in the direction of the arrow G21.

When the wedge plate 2004 is moved in the direction of the arrow G21, the shaft 2043*c* of the wedge plate 2004 is separated from the connecting portion 2042*a* of the wedge plate pull-down link 2042. When the shaft 2043*c* is separated from the connecting portion 2042*a* of the wedge plate pull-down link 2042, the wedge plate 2004 is biased by the biasing member 2044*a* and rotated in a direction of an arrow H21 about the shaft 2040*a* which serves as a fulcrum, so that the wedge portion 2043*a* is moved in the direction approaching the table 2010.

When the wedge plate 2004 is rotated about the shaft 2040*a* which serves as the fulcrum in the direction of the arrow H21, the removal member 2044*b* is rotated following the wedge plate 2004. Further, with respect to the movement of the wedge plate 2004 in the direction of the arrow G21 along the table 2010, the position of the removal member 2044*b* is fixed, and the wedge portion 2043*a* of the wedge plate 2004 is moved in a direction approaching an end portion 2044*c* of the removal member 2044*b*. As a result, when the staple 2100 pulled out from the paper bundle P20 is held by the wedge plate 2004, the staple 2100 is removed from the wedge plate 2004 by the relative movement between the wedge plate 2004 and the removal member 2044*b*.

Due to the rotation of the cam 2005 that moves the leg portion raising drive plate 2030 in the direction of the arrow E21, the wedge plate pull-down link 2042 is rotated in a direction of an arrow J21 about the shaft 2017 which serves as the fulcrum when the pin 2042*b* is moved following the cam surface (not shown) of the cam 2005. The wedge plate pull-down link 2042 is rotated in the direction of the arrow J21 about the shaft 2017 which serves as the fulcrum, and thus the connecting portion 2042*a* is moved in the direction approaching the table 2010.

Figure 61:
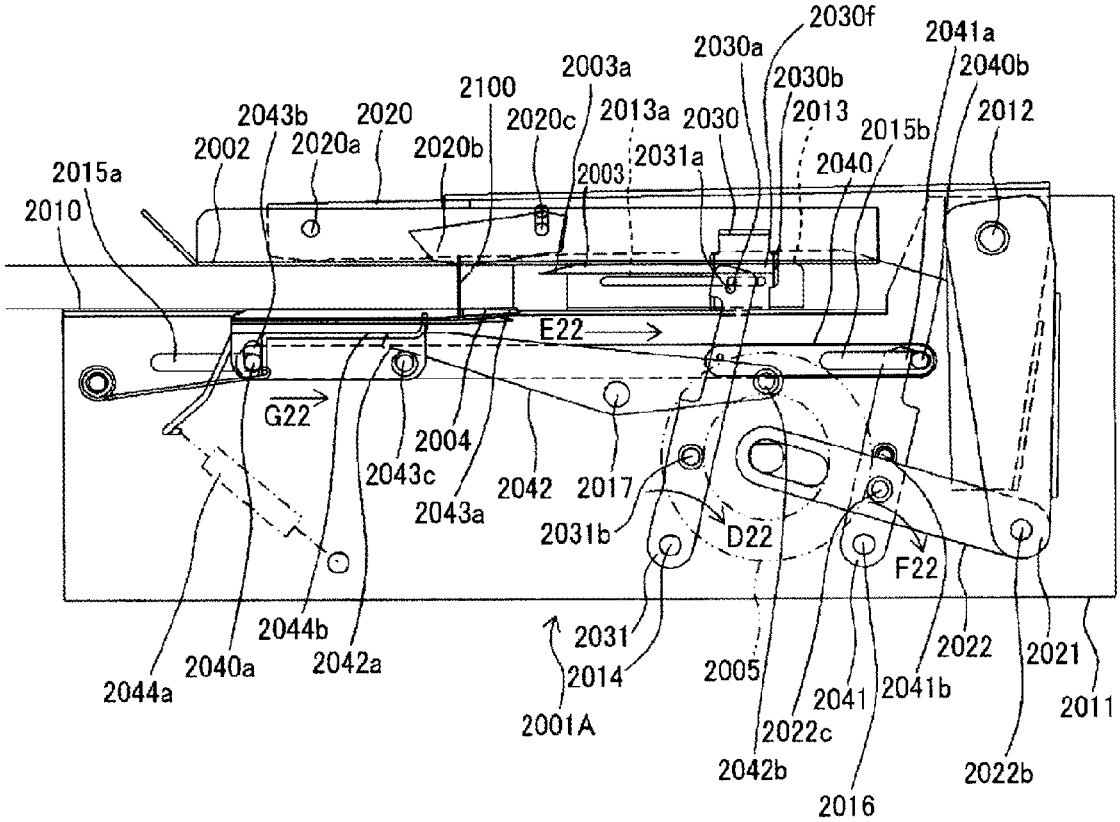
FIG. 61 is a side view showing an operation example of the staple removal device according to the third embodiment.

When the cam 2005 is further rotated from the state where the one end portion 2003*a* of the leg portion raising plate 2003 is inserted to the end surface P21 of the paper bundle P20, as shown in FIG. 61, the leg portion raising plate cam link 2031 is rotated about the shaft 2014 which serves as the fulcrum in a direction of an arrow D22 since the pin 2031*b* is moved following the cam surface (not shown) of the cam 2005.

When the leg portion raising plate cam link 2031 is rotated about the shaft 2014 which serves as the fulcrum in the direction of the arrow D22, the leg portion raising drive plate 2030 connected by the shaft 2030*a* to the leg portion raising plate cam link 2031 is guided by the guide hole 2013*a* of the guide 2013 and moved in a direction of an arrow E22 along the surface of the table 2010.

When the leg portion raising drive plate 2030 is moved in the direction of the arrow E22, the leg portion raising plate 2003 is moved in the direction of the arrow E22 along the surface of the table 2010. When the leg portion raising plate 2003 is moved in the direction of the arrow E22, the one end portion 2003*a* of the leg portion raising plate 2003 is pulled out of the paper bundle P20.

Due to the rotation of the cam 2005 that moves the leg portion raising plate 2003 in the direction of the arrow E22 and removes the leg portion raising plate 2003 from the paper bundle P20, the wedge plate cam link 2041 is rotated in a direction of an arrow F22 about the shaft 2016 which serves as the fulcrum when the pin 2041*b* is moved following the cam surface (not shown) of the cam 2005.

When the wedge plate cam link 2041 is rotated about the shaft 2016 which serves as the fulcrum in the direction of the arrow F22, the wedge plate drive link 2040 connected to the wedge plate cam link 2041 is moved in a direction of an arrow G22 along the table 2010.

When the wedge plate drive link 2040 is moved in the direction of the arrow G22, the wedge plate 2004 connected by the shaft 2040*a* to the wedge plate drive link 2040 is moved in the direction of the arrow G22.

Figure 56C:
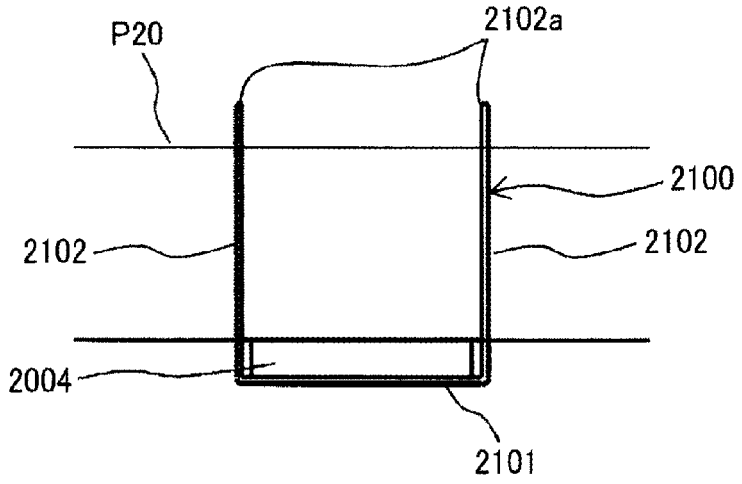
FIG. 56C is an explanatory view showing the operation of pulling out the staple from the paper bundle by raising the leg portion.
Figure 57C:
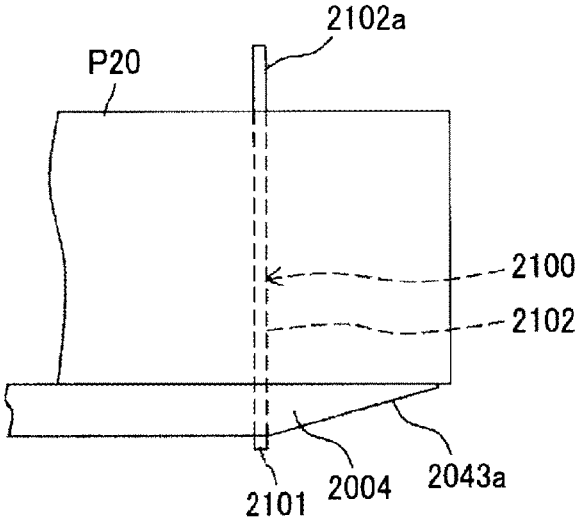
FIG. 57C is an explanatory view showing the operation of pulling out the staple from the paper bundle by raising the leg portion.

When the wedge plate 2004 is moved in the direction of the arrow G22 in the state where the wedge portion 2043*a* is pressed against the paper bundle P20, the wedge portion 2043*a* of the wedge plate 2004 is inserted between the crown portion 2101 of the staple 2100 and the paper bundle P20 from a direction opposite to an insertion direction in which the leg portion raising plate 2003 is inserted into the paper bundle P20. Since the thickness of the wedge plate 2004 gradually increases from the one end portion toward the base portion, a force is applied to the crown portion 2101 in a direction in which the crown portion 2101 is separated from the paper bundle P20. The leg portion 2102*a* which is bent inward is raised by the operation of the leg portion raising plate 2003 described above. As a result, as shown in FIGS. 56C and 57C, the leg portion 2102 of the staple 2100 is removed from the paper bundle P20 by the thickness of the wedge portion 2043*a* without largely deforming the paper bundle P20 at a portion through which the leg portion 2102 penetrates. In the state where the leg portion raising plate 2003 is inserted in the paper bundle P20 while the leg portion 2102 is raised, the wedge portion 2043*a* of the wedge plate 2004 is inserted between the crown portion 2101 of the staple 2100 binding the paper bundle P20 and the paper bundle P20, and thus a force required to insert the wedge plate 2004 is reduced, and a force required to pull out the staple 2100 is reduced.

When the wedge plate 2004 is moved in the direction of the arrow G22, the shaft 2043*c* of the wedge plate 2004 engages with the connecting portion 2042*a* of the wedge plate pull-down link 2042.

Figure 62:
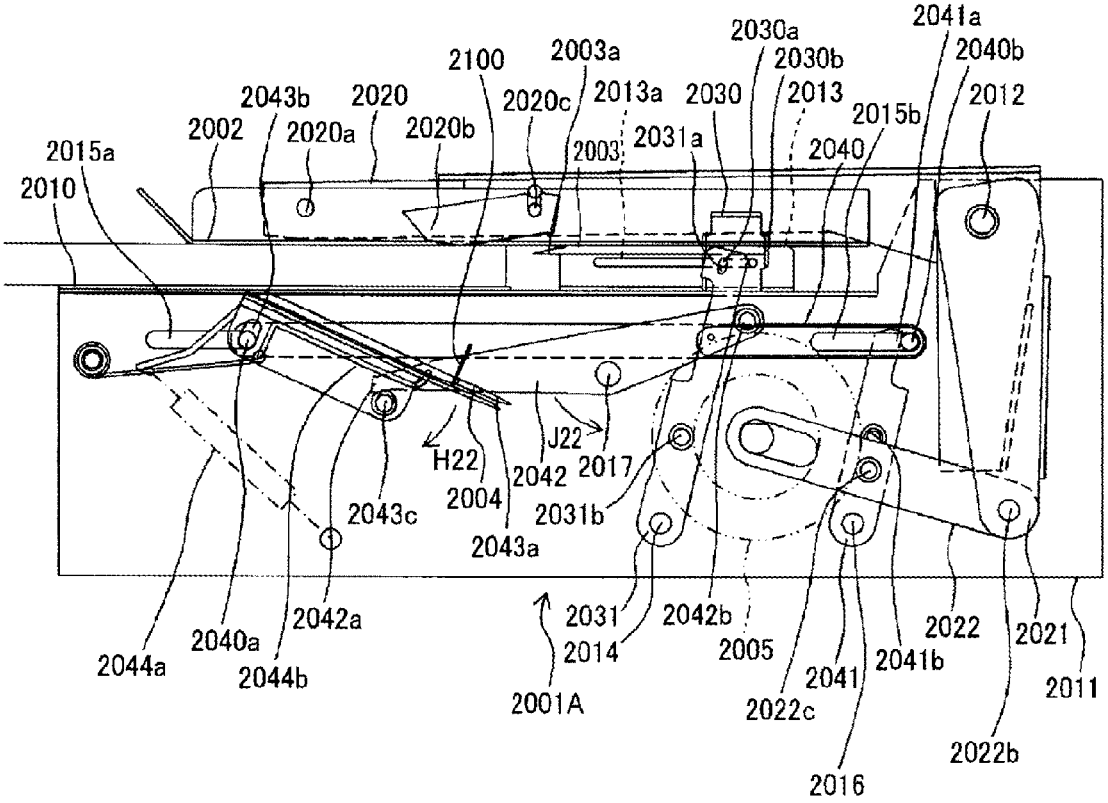
FIG. 62 is a side view showing an operation example of the staple removal device according to the third embodiment.

Due to the rotation of the cam 2005, as shown in FIG. 62, the wedge plate pull-down link 2042 is rotated in a direction of an arrow J22 about the shaft 2017 which serves as the fulcrum when the pin 2042*b* is moved following the cam surface (not shown) of the cam 2005. The wedge plate pull-down link 2042 is rotated in the direction of the arrow J22 about the shaft 2017 which serves as the fulcrum, and thus the connecting portion 2042*a* is moved in the direction away from the table 2010.

Since the shaft 2043*c* of the wedge plate 2004 is engaged with the connecting portion 2042*a* of the wedge plate pull-down link 2042, when the wedge plate pull-down link 2042 is rotated in the direction of the arrow J22 about the shaft 2017 which serves as the fulcrum, the wedge plate 2004 is rotated in a direction of an arrow H22 about the shaft 2040*a* which serves as the fulcrum, and the wedge portion 2043*a* is moved in the direction away from the table 2010. As a result, the entire leg portion 2102 of the staple 2100 is removed from the paper bundle P20.

Figure 63:
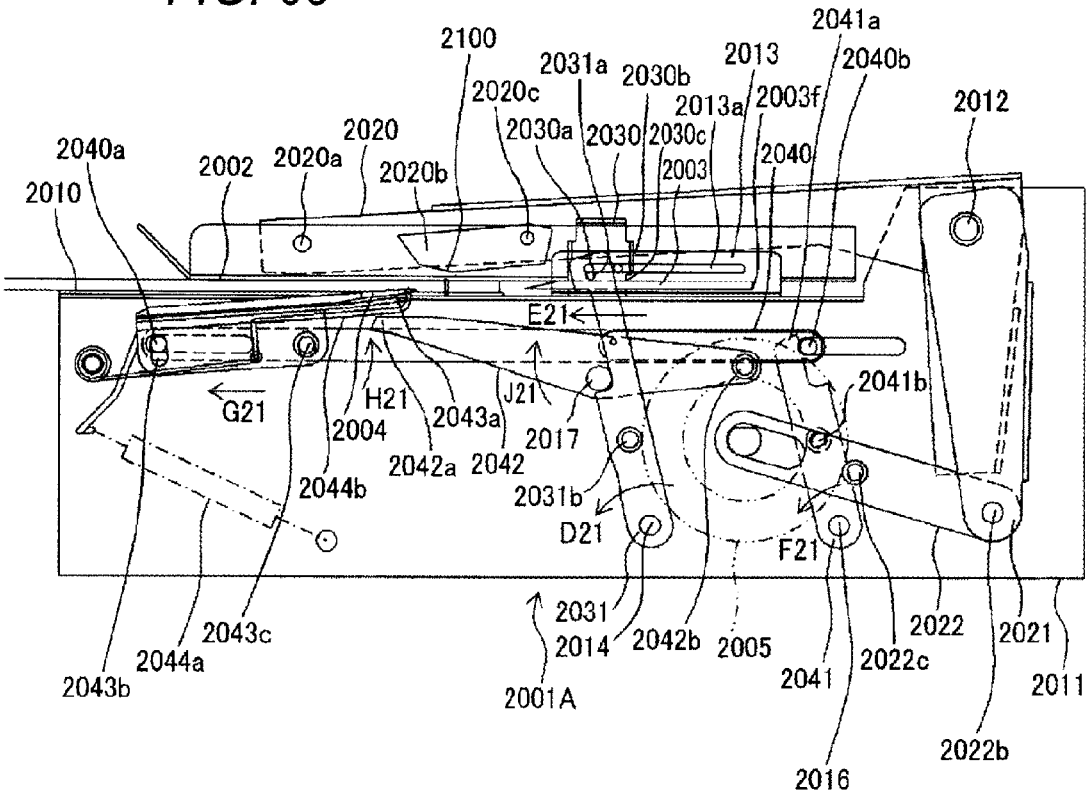
FIG. 63 is a side view showing an operation example of the staple removal device according to the third embodiment.

As shown in FIG. 58B, when the thickness of the paper bundle P20 is less than the predetermined thickness, the other end portion 2003*f* of the leg portion raising plate 2003 faces the non-engagement portion 2030*c* of the leg portion raising drive plate 2030 and is retracted from the movement path of the engagement portion 2030*b*. As a result, as shown in FIG. 63, even when the leg portion raising drive plate 2030 is moved in the direction of the arrow E21, the engagement portion 2030*b* of the leg portion raising drive plate 2030 does not engage with the leg portion raising plate 2003, and thus the leg portion raising plate 2003 is not moved. Therefore, the leg portion raising plate 2003 is not inserted into the paper bundle P20.

In a case where the thickness of the paper bundle P20 is less than the predetermined thickness, that is, in a case where the number of pieces of paper bound by the staple 2100 is small, a problem such as bending of the paper bundle P20 may occur when the leg portion raising plate 2003 is inserted into the paper bundle P20, and thus the leg portion 2102 may not be raised. Therefore, the leg portion raising drive plate 2030 includes the engagement portion 2030*b* and the non-engagement portion 2030*c*. The leg portion raising plate 2003 and the non-engagement portion 2030*c* face each other when the thickness of the paper bundle P20 is less than the predetermined thickness, so that the leg portion raising plate 2003 can be deactivated. The switching between the engagement and non-engagement of the engagement portion 2030*b* of the leg portion raising drive plate 2030 and the leg portion raising plate 2003 is performed with about 50 pieces of paper serving as a threshold value for the number of pieces of paper when the basis weight of the paper is about 65 gsm.

A part of or the entire third embodiment described above can be described as in the following supplementary notes.

<Supplementary Note 1>

The staple removal device 2001A includes: the placement portion 2010 on which the paper bundle P20 is placed;

the pressing portion 2002 that presses the paper bundle P20 against the placement portion 2010;

the first insertion portion 2003 that raises the leg portion 2102 of the staple 2100 binding the paper bundle P20;

the second insertion portion 2004 that is inserted between the crown portion 2101 of the staple 2100 binding the paper bundle P20 and the paper bundle P20 so as to remove the staple 2100 from the paper bundle P20; and the driving portion 2030 that engages with the first insertion portion 2003 and inserts the first insertion portion 2003 into the paper bundle P20 from the end surface P21 of the paper bundle P20 sandwiched between the placement portion 2010 and the pressing portion 2002.

Among the first insertion portion 2003, the one end portion 2003*a* facing the end surface P21 of the paper bundle P20 sandwiched between the placement portion 2010 and the pressing portion 2002 is formed in the wedge shape.

<Supplementary Note 2>

The staple removal device 2001A according to Supplementary Note 1, in which the driving portion 2030 moves the first insertion portion 2003 in the direction approaching and the direction away from the end surface P21 of the paper bundle P20 sandwiched between the placement portion 2010 and the pressing portion 2002.

<Supplementary Note 3>

The staple removal device 2001A according to Supplementary Note 1 or 2, in which the first insertion portion 2003 is movably attached to the pressing portion 2002.

<Supplementary Note 4>

The staple removal device 2001A according to any one of Supplementary Notes 1 to 3, in which the distance between the one end portion 2003*a* of the first insertion portion 2003 and the pressing portion 2002 is kept constant.

<Supplementary Note 5>

The staple removal device 2001A according to any one of Supplementary Notes 1 to 4, in which the first surface 2003*d* of the one end portion 2003*a* of the first insertion portion 2003 facing the placement portion 2010 is a flat surface, while a second surface 2003*e* facing the pressing portion 2002 is an inclined surface inclined with respect to the first surface 2003*d*.

<Supplementary Note 6>

The staple removal device 2001A according to any one of Supplementary Notes 1 to 5, in which the driving portion 2030 includes the engagement portion 2030*b* that engages with the first insertion portion 2003 when the distance between the placement portion 2010 and the pressing portion 2002 is equal to or greater than the predetermined value, and includes the non-engagement portion 2030*c* that does not engage with the first insertion portion 2003 when the distance between the placement portion 2010 and the pressing portion 2002 is smaller than the predetermined value.

<Supplementary Note 7>

The staple removal device 2001A according to any one of Supplementary Notes 1 to 6 further includes the needle removal driving portion 2040 that inserts the second insertion portion 2004 between the crown portion 2101 of the staple 2100 binding the paper bundle P20 and the paper bundle P20 from the direction opposite to the insertion direction in which the first insertion portion 2003 is inserted into the paper bundle P20.

<Supplementary Note 8>

The staple removal device 2001A according to Supplementary Note 7, in which the needle removal driving portion 2040 moves the second insertion portion 2004 in the opposite direction when the first insertion portion 2003 moves in the opposite direction.

<Supplementary Note 9>

The staple removal device 2001A according to any one of Supplementary Notes 1 to 8, in which the first insertion portion 2003 includes the one end portion 2003*a* which is formed in the wedge shape and the body portion constituting a portion from the one end portion 2003*a* to the other end portion 2003*f*, and the body portion is configured to have a maximum thickness of 1.5 mm or more.

The present application is based on Japanese Patent Application No. 2018-213338 filed on Nov. 13, 2018, Japanese Patent Application No. 2018-213339 filed on Nov. 13, 2018, and Japanese Patent Application No. 2018-245546 filed on Dec. 27, 2018, the contents of which are incorporated herein as reference.

REFERENCE SIGNS LIST

100 staple removal device
104 placement table (placement portion)
110A, 110B, 110C staple pulling mechanism portion
111 moving portion

112 wedge plate (tip end portion)
112*a* first surface
112*b* second surface
112*bs* inclined surface
160 staple pressing mechanism
162 staple pressing portion
162*b*, 262*b*, 362*b*, 462*b*, 562*b* abutment portion
205 driving portion
206 motor
210 staple stopper presser (restricting portion)
262*c* recessed portion
362*c* groove portion
562*c* protruding portion
P paper bundle
Pa first paper surface
Pb second paper surface
S staple
Sa crown portion
Sb leg portion
1100A, 1100B, 1100C staple removal device
1104 placement table (placement portion)
1104*h* placement surface
1106 adjustment knob (operation portion)
1112 wedge plate (insertion portion)
1112*c* upper surface
1114 wedge plate holder (engagement portion)
1118 wedge plate shaft (engagement portion)
1122 adjustment fulcrum shaft (first portion moving portion)
1140 pull-down link
1140*b* first portion
1140*c* second portion
1200A, 1200C adjustment mechanism (insertion portion adjustment portion)
1200B adjustment mechanism (placement portion adjustment portion)
1205 driving portion (insertion portion moving portion)
1206 motor
1260 adjustment link
F10 rotation fulcrum portion (rotation shaft)
P10 paper bundle
Pa10 first paper surface (paper surface)
S10 staple
Sa10 crown portion
2001A staple removal device
2010 table (placement portion)
2011 body portion
2012 shaft
2013 guide
2013*a* guide hole
2014 shaft
2015*a*, 2015*b* long hole
2016 shaft
2017 shaft
2002 paper pressing plate (pressing portion)
2020 paper pressing link
2020*a* shaft
2020*b* pressing member
2020*c* shaft
2020*d* biasing member
2021 paper pressing drive link
2021*a* biasing member
2022 paper pressing cam link
2022*a* long hole
2022*b* shaft
2022*c* pin
2003 leg portion raising plate (first insertion portion)
2003*a* end portion
2003*b* tip end
2003*c* base portion
2003*d* first surface
2003*e* second surface
2003*f* end portion
2030 leg portion raising drive plate (driving portion)
2030*a* shaft
2030*b* engagement portion
2030*c* non-engagement portion
2031 leg portion raising plate cam link
2031*a* long hole
2031*b* pin
2004 wedge plate (second insertion portion)
2040 wedge plate drive link (needle removal driving portion)
2040*a*, 2040*b* shaft
2041 wedge plate cam link
2041*a* connecting portion
2041*b* pin
2042 wedge plate pull-down link
2042*a* connecting portion
2042*b* pin
2043*a* wedge portion
2043*b* long hole
2043*c* shaft
2044*a* biasing member
2044*b* removal member
2005 cam
2050 drive shaft

The invention claimed is:

1. A staple removal device comprising:

a placement portion on which a paper bundle bound by a staple including a crown portion and a pair of leg portions is placeable, the paper bundle including a first paper surface on which the crown portion is exposed;

a moving portion which is arranged at a position facing the first paper surface in a state where the paper bundle is placed on the placement portion, and is movable in a direction along the first paper surface, the moving portion including a tip end portion which is inclined in a wedge shape toward a tip end thereof;

a driving portion configured to move the moving portion toward the crown portion in the state where the paper bundle is placed on the placement portion and to insert the tip end portion between the crown portion and the first paper surface; and an abutment portion which is arranged at a position facing the first paper surface in the state where the paper bundle is placed on the placement portion, the abutment portion being abutted against the crown portion from a direction opposite to an insertion direction of the tip end portion at least after the tip end portion is inserted between the crown portion and the first paper surface, wherein the tip end portion includes a first surface which faces the first paper surface, and a second surface located on a side opposite to the first surface and having an inclined surface which is inclined toward the tip end, the tip end portion moves the crown portion in a direction away from the first paper surface by the inclined surface as the tip end portion is inserted between the crown portion and the first paper surface and moved in the insertion direction, the abutment portion is movable in the direction away from the paper surface, the abutment portion is configured to be abutted against the inclined surface after the tip end portion is inserted between the crown portion and the first paper surface, and the abutment portion moves in the direction away from the first paper surface so as to follow movement of the crown portion while being abutted against the inclined surface while the tip end portion moves between the crown portion and the first paper surface in the insertion direction.

2. The staple removal device according to claim 1, further comprising:

a body portion; and a support portion which includes first and second ends, wherein the second end is rotatably supported by the body portion such that the first end is separable from the first paper surface, and wherein the abutment portion is supported on the first end.

3. The staple removal device according to claim 2, wherein the abutment portion is arranged at a position facing a first position of the first paper surface located downstream of the crown portion in the insertion direction, and the support portion allows the abutment portion to be abutted against the second surface of the tip end portion after the tip end portion passes the first position.

4. The staple removal device according to claim 3, further comprising:

a restricting portion which is located between the first paper surface and the abutment portion, and moves in the insertion direction in accordance with movement of the tip end portion in the insertion direction, wherein the restricting portion restricts the abutment portion from being abutted against the second surface until the tip end portion passes the first position, and allows the abutment portion to be abutted against the second surface after the tip end portion passes the first position.

5. The staple removal device according to claim 4, wherein the restricting portion includes a wall portion configured to block communication between the abutment portion and the second surface until the tip end portion passes the first position, and an opening through which the abutment portion and the second surface communicate with each other after the tip end portion passes the first position.

6. The staple removal device according to claim 1, wherein the abutment portion includes a recessed portion cut out at a position facing a tip end of the tip end portion.

7. The staple removal device according to claim 1, wherein the abutment portion includes a recessed portion configured to engage the crown portion at a position facing the crown portion.

8. The staple removal device according to claim 1, wherein the abutment portion includes a portion which is widened toward an end of the first paper surface.

9. The staple removal device according to claim 1, wherein the abutment portion includes, on a surface facing the tip end portion, a protruding portion formed linearly in a direction in which the abutment portion is abutted against and separated from the first paper surface.

10. A staple removal device configured to remove a staple from a paper bundle bound by the staple which includes a crown portion and a pair of leg portions, the staple removal device comprising:

a placement portion which includes a placement surface on which the paper bundle is placeable;

an insertion portion which is arranged to face a paper surface of the paper bundle on a side where the crown portion is exposed in a state where the paper bundle is placed on the placement surface, the insertion portion being insertable between the crown portion and the paper surface;

an insertion portion moving portion which is connected to the insertion portion and configured to move the insertion portion along the paper surface; and an insertion portion adjustment portion which is connected to the insertion portion and is configured to adjust a position of the insertion portion relative to the placement surface in a thickness direction of the paper bundle, wherein the insertion portion adjustment portion includes:

a base end portion;

a tip end portion;

a rotation shaft rotatably arranged between the base end portion and the tip end portion;

a first portion which is located between the base end portion and the rotation shaft and configured to move in a direction away from the placement surface when the rotation shaft rotates in a counterclockwise direction;

a second portion which is located between the rotation shaft and the tip end portion and configured to move in a direction towards the placement surface when the rotation shaft rotates in the counterclockwise direction; and a first portion moving portion configured to move the first portion in the direction away from the placement surface, and the insertion portion is connected to the second portion.

11. The staple removal device according to claim 10, wherein the first portion moving portion includes an eccentric axis-shaft and is configured to be rotatable about the eccentric shaft, and an outer peripheral surface of the eccentric shaft is abutted against the first portion.

12. The staple removal device according to claim 10, wherein the second portion includes a hole which extends from the rotation shaft toward the tip end portion, and the insertion portion includes an engagement portion configured to engage with the hole.

13. The staple removal device according to claim 11, wherein the first portion moving portion is configured to be rotatable by an operator.

14. A staple removal device configured to remove a staple from a paper bundle bound by the staple which includes a crown portion and a pair of leg portions, the staple removal device comprising:

a placement portion which includes a placement surface on which the paper bundle is placeable;

an insertion portion which is arranged to face a paper surface of the paper bundle on a side where the crown portion is exposed in a state where the paper bundle is placed on the placement surface, the insertion portion being insertable between the crown portion and the paper surface;

a moving portion which is connected to the insertion portion and configured to move the insertion portion along the paper surface; and a placement portion adjustment portion which is connected to the placement portion and is configured to adjust a position of the placement surface relative to the insertion portion in a thickness direction of the paper bundle, wherein the placement portion adjustment portion is configured to convert rotational movement of an operator into movement in a vertical or up-down direction to adjust the position of the placement surface, the placement portion adjustment portion further comprising:

an adjustment knob which is configured to be rotated by an operator; and a slide shaft which is slideable in at least one guide groove, and which slides in response to rotation of the adjustment knob.

* * * * *